US011661268B2

(12) United States Patent
Swede et al.

(10) Patent No.: US 11,661,268 B2
(45) Date of Patent: May 30, 2023

(54) PRODUCT PACKAGE

(71) Applicant: R.J. Reynolds Tobacco Company, Winston-Salem, NC (US)

(72) Inventors: Travis M. Swede, Winston-Salem, NC (US); M. Shane Hatcher, Pfafftown, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 926 days.

(21) Appl. No.: 14/922,880

(22) Filed: Oct. 26, 2015

(65) Prior Publication Data

US 2017/0113865 A1 Apr. 27, 2017

(51) Int. Cl.
*B65D 85/10* (2006.01)
*B65D 5/42* (2006.01)

(52) U.S. Cl.
CPC ..... *B65D 85/1036* (2013.01); *B65D 5/422* (2013.01); *B65D 85/1045* (2013.01); *B65D 85/1048* (2020.05); *B65D 85/1056* (2020.05); *B65D 85/1063* (2013.01); *B65D 85/1081* (2013.01)

(58) Field of Classification Search
CPC ..... B65D 5/422; B65D 85/1036; B65D 85/1063; B65D 85/1045; B65D 85/1081; B65D 5/009; B65D 5/427; B65D 21/0201; B65D 71/02; B65D 85/00; B65D 83/0876; B65D 75/585; B65D 83/0847; B65D 5/0085; B65D 5/32; B65D 5/4275; B65D 71/38; B65D 75/04; B65D 75/06; B65D 75/42; B65D 77/003; B65D 81/3205; B65D 81/10; B65D 85/10; B65D 85/1072;
(Continued)

(56) References Cited

U.S. PATENT DOCUMENTS 2,162,094 A * 6/1939 Mahone ..... B65D 5/0085 206/472
2,901,097 A * 8/1959 Tamarin ..... B65D 5/72 206/267

(Continued)

FOREIGN PATENT DOCUMENTS

EP 0 392 737 10/1990
WO WO-03/053818 A1 7/2003

OTHER PUBLICATIONS

International Search Report and Written Opinion for PCT/US16/57531, dated Feb. 23, 2017, 12 pages.

*Primary Examiner* — Robert Poon
*Assistant Examiner* — James M Van Buskirk
(74) *Attorney, Agent, or Firm* — Womble Bond Dickinson (US) LLP; Chris Humphrey; John V. Forcier

(57) ABSTRACT

A product package includes an inner case for storing the product and an outer case for enclosing the inner case. The product package includes a display area for product messaging. The display area includes exterior surfaces of the outer case. The outer case includes an open position in which the display area also includes exterior portions of the inner case. The product package may also include additional features intended to increase the display area of the product package, including a fold-out panel providing an additional exterior surface, an angled outer surface that is visible from a front perspective of the product package, and pivotable sections increasing the surface area of the product package.

18 Claims, 47 Drawing Sheets

(58) Field of Classification Search
CPC ..... A24F 15/00; A24F 15/12; B31B 2105/00; A47K 10/424
USPC ..... 206/268, 257, 264, 273, 271, 745, 757, 206/749–750; 229/108, 149, 160.1; 220/520, 4.23
See application file for complete search history.

(56) References Cited

U.S. PATENT DOCUMENTS 3,227,665 A 1/1966 Schneider
3,645,382 A * 2/1972 Abrams ..... B65D 85/1063 206/45.21
3,695,422 A 10/1972 Tripodi
3,874,581 A 4/1975 Fox et al.
3,944,066 A 3/1976 Niepmann
4,294,353 A 10/1981 Focke et al.
4,485,926 A * 12/1984 Lenzmeier ..... B65D 5/009 206/831
4,717,017 A 1/1988 Sprinkel et al.
4,852,734 A 8/1989 Allen et al.
5,080,227 A 1/1992 Focke
5,178,271 A 1/1993 Adams et al.
5,180,056 A 1/1993 Adams et al.
5,236,084 A 8/1993 Evers
5,261,533 A * 11/1993 Adams ..... B65D 85/1072 229/120.09
5,333,729 A 8/1994 Wolfe
5,341,925 A 8/1994 Fleenor et al.
5,344,008 A * 9/1994 DeBlasio ..... B65D 85/1072 206/256
5,682,986 A 11/1997 Cobler
5,938,018 A 8/1999 Keaveney et al.
6,786,331 B1 9/2004 Zucchini
7,415,812 B2 8/2008 Bray et al.
7,565,969 B2 7/2009 He
7,845,490 B2 12/2010 Moore et al.
7,874,421 B2 * 1/2011 Bardet ..... B65D 85/1045 206/256
8,020,697 B2 9/2011 Chatelain et al.
8,118,160 B2 2/2012 Ghini et al.
8,167,124 B2 5/2012 Uesugi et al.
8,201,683 B2 6/2012 Nakano et al.
8,322,524 B2 12/2012 Mazur
8,413,805 B2 * 4/2013 Bray ..... B65D 5/009 206/257
8,418,845 B2 4/2013 Tawada et al.
8,434,497 B2 5/2013 Yanchev
8,448,784 B2 5/2013 Collins
8,464,867 B2 6/2013 Holloway et al.
8,499,929 B2 8/2013 Chatelain
8,584,844 B2 11/2013 Tearle
8,852,711 B2 * 10/2014 Preisler ..... B60R 13/0275 428/116
8,893,955 B2 * 11/2014 Clark ..... B65D 5/0085 229/120.09
8,910,784 B2 12/2014 Moore et al.
8,925,794 B2 1/2015 Tawada et al.
9,290,314 B2 * 3/2016 D'Alfonso et al. ... B65D 5/422
2003/0217937 A1 * 11/2003 Wilder ..... B65D 85/1072 206/264
2005/0199517 A1 * 9/2005 Petrucci ..... B65D 5/4291 206/261
2008/0230410 A1 9/2008 Steven Jones et al.
2009/0038966 A1 2/2009 Ghini et al.
2009/0045084 A1 2/2009 Roila et al.
2010/0200440 A1 8/2010 Ghini et al.
2010/0248926 A1 9/2010 Pipes et al.
2011/0042249 A1 2/2011 Guerrera et al.
2011/0180444 A1 * 7/2011 Mezzini ..... B65D 5/009 206/526
2013/0140201 A1 6/2013 Ghini et al.
2014/0131233 A1 * 5/2014 Uhrik, Jr. ..... B65D 5/662 206/256
2015/0114879 A1 * 4/2015 Miller ..... B65D 21/0205 206/747

* cited by examiner

PRODUCT PACKAGE

BACKGROUND

Field of the Disclosure

The present application relates generally to the field of containers and packages for products such as cigarettes.

Background

Cigarettes and other smoking articles are commonly sold in packages, each package often containing twenty (20) cigarettes. One type of popular cigarette package employs a container having the form of a so-called "hard-pack," "crush proof box," or "hinged lid package." Such a package may include a lower base (e.g., receptacle) portion and a hinged upper lid portion. These types of packages are typically formed from cardboard blanks that include various panels and flaps, which when folded form the lower base portion and the upper lid portion. See, for example, U.S. Pat. No. 3,874,581 to Fox et al.; U.S. Pat. No. 3,944,066 to Niepmann; U.S. Pat. No. 4,852,734 to Allen et al.; European Pat. 0392737 to Moeller; U.S. Pub. Pat. App. No. 2008/0230410 to Jones et al.; U.S. Pub. Pat. App. No. 2011/0042249 to Guerrera et al.; U.S. Pub. Pat. App. No. 2010/0248926 to Pipes et al.; and U.S. Pat. No. 5,682,986 to Cobler, each of which is incorporated herein by reference. Another type of popular cigarette package employs a container having the form of the so-called "soft pack." See, for example, U.S. Pat. No. 3,695,422 to Tripodi; U.S. Pat. No. 4,717,017 to Sprinkel, Jr., et al.; and, U.S. Pat. No. 5,333,729 to Wolfe; each of which is incorporated herein by reference. These conventional cigarette packages are generally configured to maintain the freshness and moisture content of the cigarettes, and to protect the cigarettes from adverse environmental conditions that could degrade their freshness and quality.

In addition to maintaining the freshness and quality of the product, such packages may be utilized to communicate information to a consumer. For instance, graphics and text are typically applied to the exterior of the package to communicate various information regarding the product, including branding, advertising, regulatory information, nutritional information, and promotional information. Conventional cigarette packages are often relatively small in size and may have a limited visible exterior surface area for providing information. Thus, the information that may be provided via the available display surfaces may also be limited. Cigarette packages having additional display surfaces for communicating product information are known in the art. For example, U.S. Pat. No. 8,020,697 to Chatelain, which is incorporated herein by reference, discloses a hinge-lid container having integral panels providing additional exterior surface areas. U.S. Pat. No. 8,418,845, which is incorporated herein by reference, discloses an inner case that is contained within an outer case, both the inner case and the outer case having outer exposed surfaces. U.S. Pat. No. 8,413,805, which is incorporated herein by reference, discloses a container having two separate packs that are joined together, each of the separate packs having a plurality of exposed outer surfaces.

However, there are a number of potential issues with the conventional cigarette package designs purporting additional display surfaces. For example, some such cigarette package designs may include increased (e.g., excess) litter material, may be formed by manufacturing processes that require expensive tooling and/or greater precision, or may increase the dimensions of the cigarette package such that use of the package may be more burdensome. It would therefore be desirable to provide a package design that includes increased display space while addressing one or more of the above shortcomings.

SUMMARY OF THE DISCLOSURE

Various embodiments provide for a package configured to contain a product. The package includes an inner case defining a storage volume configured to receive the product. The inner case includes an inner case front exterior surface and an inner case rear exterior surface. The package also includes an outer case configured to enclose the inner case. The outer case includes a first outer case section, a second outer case section pivotally coupled to the first outer case section by a hinge portion provided at a bottom portion of the outer case, the first and second outer case sections pivotable about an axis provided by the hinge portion between an outer case closed position, in which the inner case is substantially enclosed by the first and second outer case sections, and an outer case open position, in which at least a portion of the product is accessible, and a plurality of exterior surfaces formed by the first and second outer case sections that are at least partially visible when the outer case is in the outer case closed position, including an outer case front exterior surface, an outer case rear exterior surface, two or more outer case side exterior surfaces, an outer case top exterior surface, and an outer case bottom exterior surface. The inner case front exterior surface and the inner case rear exterior surface are at least partially visible when the outer case is in the outer case open position.

According to a second aspect, a package is configured to contain a product. The package includes an outer case. The outer case includes a case side wall having an opening, a case front wall, a case rear wall, an open side opposite the case side wall, a case top wall extending from the open side to the case side wall, and an open bottom opposite the case top wall. The package also includes one or more inserts coupled to the outer case and configured to store the product, the one or more inserts pivotable relative to the outer case between a closed position, in which the one or more inserts are positioned substantially within the outer case, and an open position, in which the one or more inserts at least partially project from at least one of the open side face and the open bottom face. Each of the one or more inserts includes an insert front wall, an insert rear wall, an insert bottom wall, and insert side walls, at least a portion of the insert side walls visible through the opening of the case side wall when the insert is in the closed position.

According to a third aspect, a package is configured to contain a product. The package includes a first box section, including a first lower body portion defining a first base, the first base configured to receive a first portion of the product, the first base including a first base bottom wall, a first base front wall coupled to a front edge of the first base bottom wall, and a first base rear wall coupled to a rear edge of the first base bottom wall, and a first connecting panel pivotally coupled to the first base rear wall by a first hinge portion. The package also includes a second box section coupled to the first box section, the second box section including a second lower body portion defining a second base, the second base configured to receive a second portion of the product and including a second base bottom wall, a second base front wall coupled to a front edge of the second base bottom wall, and a second base rear wall coupled to a rear edge of the second base bottom wall, and a second connecting panel pivotally coupled to the second base rear wall by a second hinge portion, the second connecting panel pivotally coupling the second box section to the first box section by connecting with the first connecting panel to form a two-way hinge at the first hinge portion and the second hinge portion.

BRIEF DESCRIPTION OF THE DRAWINGS

Exemplary embodiments of the present application will now be described, by way of example only, with reference to the accompanying diagrammatic drawings, in which.

DETAILED DESCRIPTION

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein. Rather, these aspects are provided so that this disclosure will be thorough and complete, will fully convey the scope of the disclosure to those skilled in the art, and will satisfy applicable legal requirements. Like numbers refer to like elements throughout.

Figure 1:
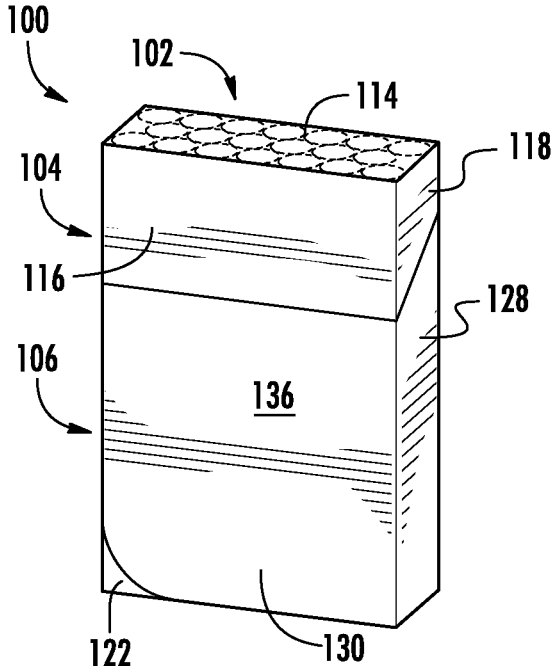
FIG. 1 is a perspective view of a package having a fold-out front panel shown in a closed position, according to an exemplary embodiment.
Figure 2:
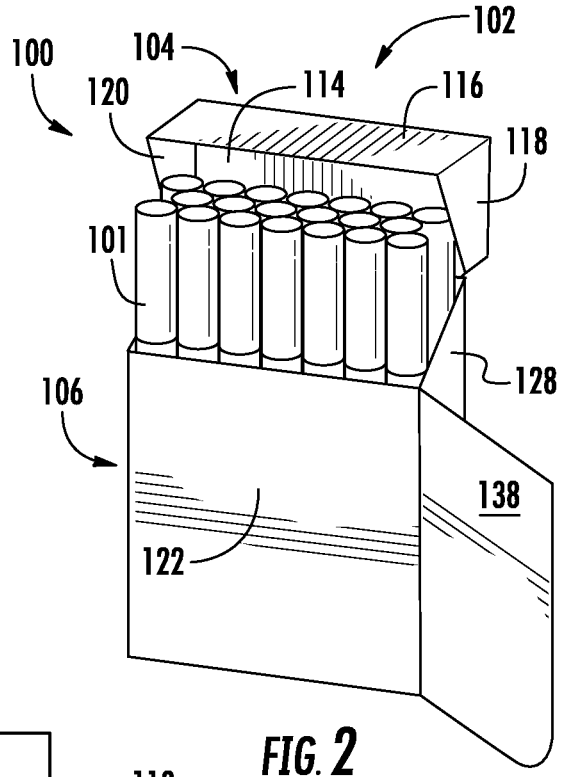
FIG. 2 is another perspective view of the package of FIG. 1, with the front panel being shown in an open position.
Figure 3:
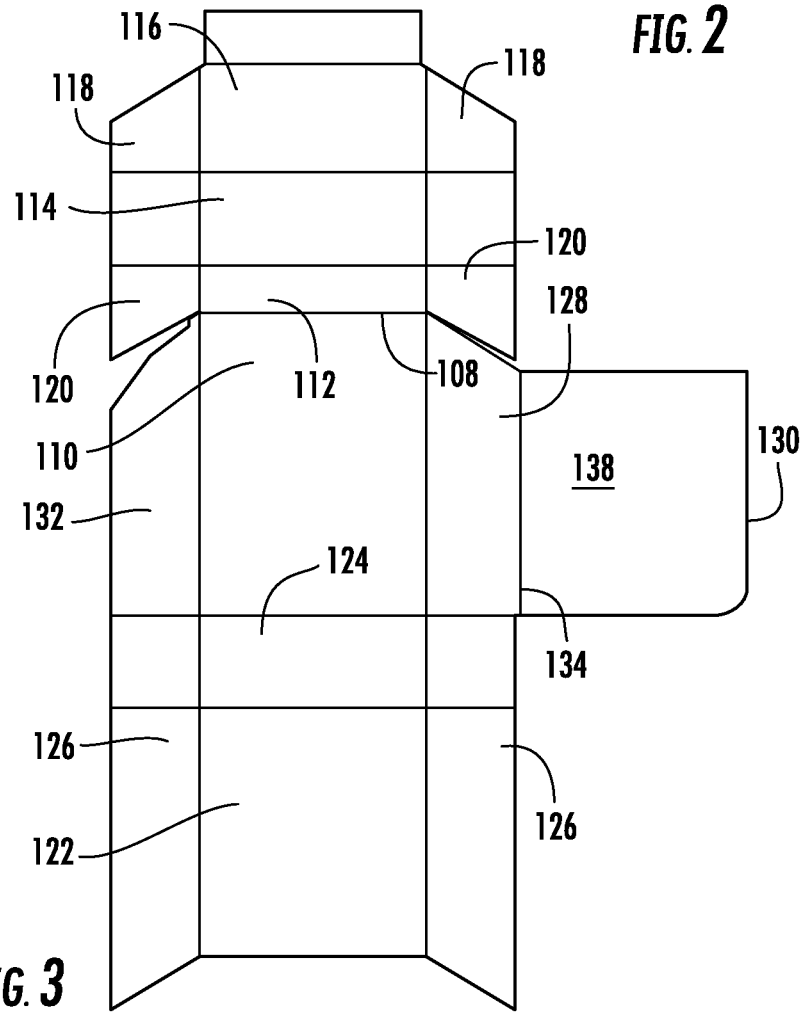
FIG. 3 is a top plan view of a blank used for the package of FIG. 1.

Referring to FIGS. 1 through 3, a cigarette package 100 is shown is shown, according to an exemplary embodiment. The package 100 includes an outer protective box 102 (e.g., case, container, etc.). The box 102 shown in FIGS. 1 and 2 may be formed from a paperboard blank, such as the blank shown in FIG. 3. According to other exemplary embodiments, the box 102 may be formed from any suitable material, such as a polymeric material. The cigarette package 100 may also include an inner case (not shown) that is configured to fit within the box 102. Generally, the inner case defines a storage volume which is used to contain tobacco product 101 (e.g., cigarettes, cigarillos, cigars, etc.) therein.

The box 102 comprises an upper body portion which defines a lid 104 and a lower body portion which defines a base 106. The base 106 and the lid 104 may be cooperatively configured to selectively engage and disengage from each other. As shown in FIG. 3, the lid 104 and the base 106 are coupled together on a rear side of the box 102 via a hinge portion 108 (e.g., a hinge, living hinge, etc.). More particularly, the hinge portion 108 is defined between a rear wall of the base 106 (e.g., a base rear wall 110) and a rear wall of the lid 104 (e.g., a lid rear wall 112). The lid 104 is be configured to pivot rearward relative to the base 106 about an axis generally defined by the hinge portion 108. Thereby, the box 102 may be opened or closed.

Referring still to FIGS. 1 through 3, the lid 104 includes a lid top wall 114, the lid rear wall 112, and a lid front wall 116. Additionally, first lid side tabs 118 (e.g., side wall portions) are provided on left and right sides of the lid front wall 116, and second lid side tabs 120 (e.g., side wall portions) are provided on left and right sides of the lid rear wall 112. When the lid 104 is in folded form (shown in FIGS. 1 and 2), the first lid side tabs 118 of the lid front wall 116 are coupled to the second lid side tabs 120 to form the side walls of the lid 104, and the second lid side tabs 120 of the lid rear wall 112 may be coupled to an inner, or bottom surface of the lid top wall 114 to couple the side walls of the lid 104 to the lid top wall 114. For instance, an adhesive (e.g., glue, double-sided tape, etc.) may be used to couple the aforementioned walls. According to an exemplary embodiment, the lid rear wall 112 is shorter than the lid front wall 116. In other words, the lid front wall 116 extends below the lid rear wall 112 when the lid 104 is closed. According to other exemplary embodiments, the various walls comprising the lid 104 may have any suitable size, and the relative sizes disclosed herein are not intended to be limiting.

The base 106 includes a base front wall 122, a base bottom wall 124, and the base rear wall 110. First base side tabs 126 (e.g., side wall portions) are provided on a left and right side of the base front wall 122. Second base side tab 128 and third base side tab 132 (e.g., side wall portions) are provided on opposite sides of the base rear wall 110. When the box 102 is in folded form, the first base side tabs 126 of the base front wall 122 may be coupled to an inner, or upper, surface of the base bottom wall 124, and the base side tabs 128 and 132 of the base rear wall 110 may be coupled to the first base side tabs 126. According to an exemplary embodiment, the base rear wall 110 is taller than the base front wall 122. In other words, the base rear wall 110 extends upwardly above the base front wall 122 when the box 102 is in folded form. According to other exemplary embodiments, the various walls comprising the base 106 may have any suitable size, and the relative sizes disclosed herein are not intended to be limiting.

When the box 102 is in folded form, a height of a rear edge of the first lid side tabs 118 generally corresponds to a height of the lid rear wall 112, and a height of a front edge of the first lid side tabs 118 generally corresponds to a height of the lid front wall 116. Similarly, a height of a rear edge of the base side tabs 128 and 132 generally corresponds to a height of the base rear wall 110, and a height of a front edge of the base side tabs 128 and 132 generally corresponds to a height of the base front wall 122. When the lid 104 of the box 102 is in the closed position, inner surfaces of the second lid side tabs 120 and the lid front wall 116 may engage outer surfaces of an inner case (if present). Further, bottom portions of the first lid side tabs 118, the second lid side tabs 120, and the lid front wall 116 may engage top portions of the first base side tabs 126, the base side tabs 128 and 132, and the base front wall 122.

Referring still to FIGS. 1-3, the base 106 also includes a fold-out front panel 130 (e.g., flap, door, fold, etc.). The panel 130 is configured to provide additional exterior surface space on the box 102. The panel 130 is coupled to a front edge (according to FIGS. 1 and 2) of the second base side tab 128 via a panel hinge portion 134. The panel 130 is pivotable relative to the second base side tab 128 about an axis generally defined by the panel hinge portion 134. When the box 102 is in folded form, the panel 130 may be pivoted thereby between a closed panel position (shown in FIG. 1) in which the panel 130 at least partially covers the base front wall 122, and an open panel position (shown in FIG. 2) in which the base front wall 122 is revealed.

The panel 130 includes a panel outer surface 136 and a panel inner surface 138. The surfaces 136 and 138 provide additional surface space on the box 102. The exterior surface space provided by the box 102 may be used to provide information to a user of the package 100 (e.g., a purchaser, a consumer, etc.). The additional surface space provided by the panel 130 may be approximately equal to the surface area of the panel surfaces 136 and 138, which may be approximately twice the surface area of the base front wall 122. The surfaces 136 and 138 may be utilized to display branding, instructions, advertising, promotional information, and the like to the user. The panel outer surface 136 is visible when the panel 130 is in the panel closed position, including when the package 100 is sealed. Thus, the panel outer surface 136 may be utilized to display information related to sale of the product (e.g., a brand name, an advertisement, etc.). For instance, the panel outer surface 136 may be utilized to provide information when the package 100 is displayed for sale. The panel inner surface 138 and the base front wall 122 are revealed to the user when the panel 130 is pivoted outwardly away from the base front wall 122 to the panel open position. The panel inner surface 138 and the base front wall 122 may be utilized to provide additional information to a user, including information related to offers or rewards, instructions for using the product or accepting a user offer, and/or advertising for other similar products. When the box 102 is in folded form, the panel hinge portion 134 is positioned on a right side of the base front wall 122 (according to FIGS. 1 and 2). Thus, when the panel 130 is pivoted outwardly from the base front wall 122 about the panel hinge portion 134, the panel inner surface 138 is displayed on a right side of the base front wall 122.

The panel 130 may have dimensions that are similar (e.g., proportional, identical) to the dimensions of the base front wall 122 in order to at least partially cover the base front wall 122 in the closed position. For instance, when the box 102 is in folded form, a height of the panel 130 may generally correspond to a height of the base front wall 122, and a width of the panel 130 may generally correspond to a width of the base front wall 122. The height of the panel 130 may also generally correspond to a height of a front edge of the base side tabs 128 and 132. The width of the panel 130 may also generally correspond to a width of the lid front wall 116 and a width of the base bottom wall 124. When the lid 104 is in the closed position, a bottom portion of the lid front wall 116 may engage a top portion of the panel 130. In one embodiment, the lid 104 engages the panel 130 such that the panel 130 is prevented from pivoting to the open position when the lid 104 is in its closed position.

When the panel 130 is in the panel closed position, the inner surface 138 may engage an outer surface of the base front wall 122. For instance, a temporary (e.g., removable, re-useable, etc.) adhesive or other fastener may be used to removably couple the inner surface 138 to the base front wall 122. In these embodiments, the inner surface 138 may be detached from the base front wall 122 to pivot the panel 130 to the open position, revealing the inner surface 138 and the base front wall 122 in addition to the outer surface 136. In the illustrated embodiment, the panel 130 includes a rounded corner positioned at a bottom edge of the panel 130 opposite the hinge portion 134. The rounded corner of the panel 130 may be utilized to grip the panel 130 in order to detach the inner surface 138 from the base front wall 122 and pivot the panel 130 to the open position. In some embodiments, the inner surface 138 may be re-engaged (e.g., re-attached, re-coupled, etc.) to the base front wall 122 by pivoting the panel 130 to the closed position.

Figure 4:
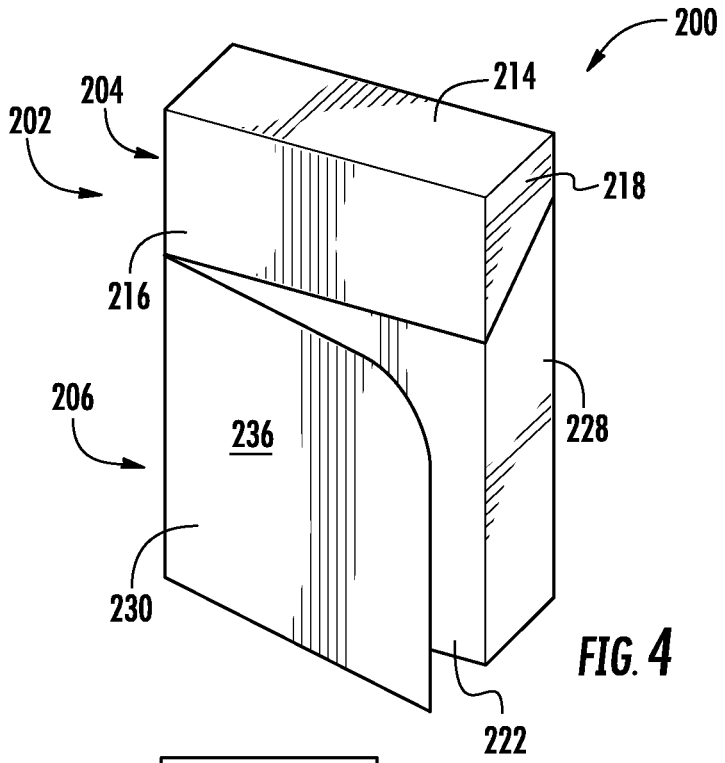
FIG. 4 is a perspective view of another package having a fold-out front panel, with the front panel being shown in a partially open position, according to an exemplary embodiment.
Figure 5:
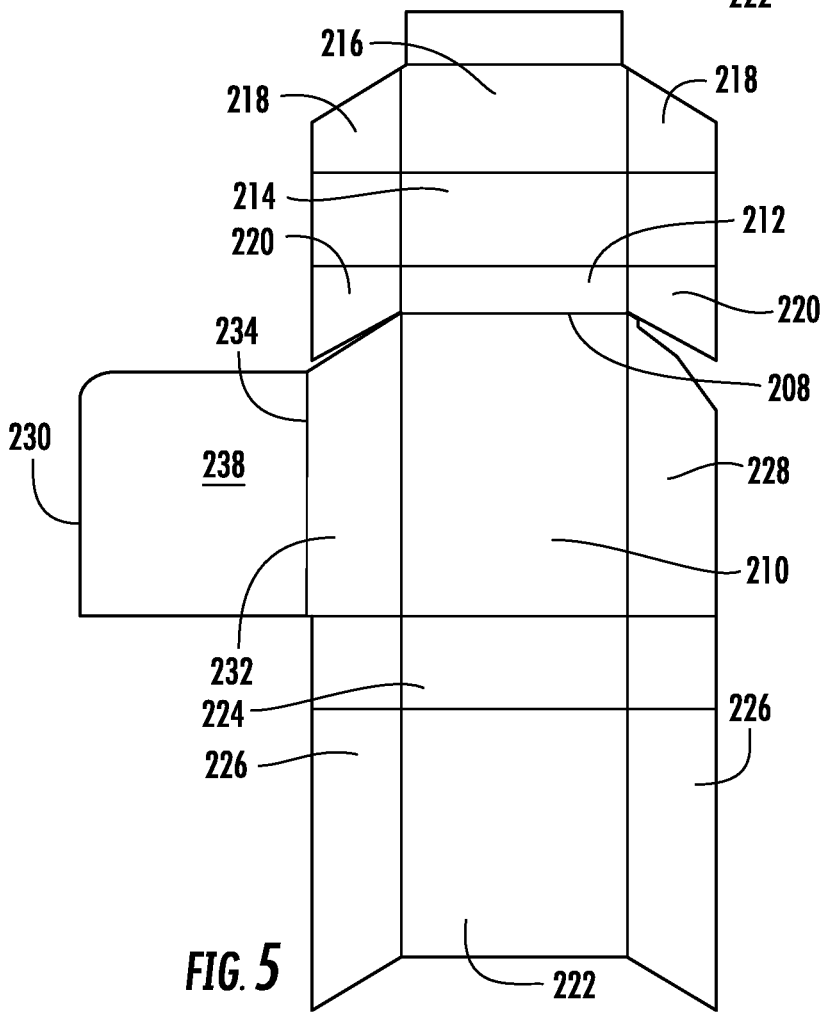
FIG. 5 is a top plan view of a blank used for the package of FIG. 4.

FIGS. 4-5 show an additional embodiment of a box 202 of a cigarette package 200. The box 202 and its features may be similar to the box 102, and any disclosure relating to the box 102 may be applied similarly to the box 202. The box 202 includes a lid 204 and a base 206. The lid 204 includes a lid top wall 214, a lid rear wall 212, and a lid front wall 216. The lid front wall 216 includes first lid side tabs 218 coupled thereto, and the lid rear wall 212 includes second lid side tabs 220 coupled thereto. The base 206 includes a base front wall 222, a base bottom wall 224, and a base rear wall 210. The base front wall 222 includes first base side tabs 226 coupled thereto, and the base rear wall 210 includes a second base side tab 228 and a third base side tab 232 coupled thereto. A hinge portion 208 is formed between the base rear wall 210 and the lid rear wall 212. The lid 204 is pivotable about the hinge portion 208 between open and closed positions.

The base 206 also includes a fold-out front panel 230 (e.g., flap, door, fold, etc.). The panel 230 is substantially similar to the panel 130, although the panel 230 pivots about an opposite side of the base front wall 222. The panel 230 includes a panel outer surface 236 and a panel inner surface 238. The panel 230 is coupled to the front edge (according to FIG. 4) of the third base side tab 232 via a panel hinge portion 234. The panel 230 is configured to pivot relative to the third base side tab 232 about an axis generally defined by the hinge portion 234. When the box 202 is in folded form, the panel 230 is pivotable thereby between a panel closed position in which the panel 230 at least partially covers the base front wall 222, and a panel open position in which the inner surface 238 and the base front wall 222 are revealed. When the box 202 is in folded form, the hinge portion 234 is positioned on a left side of the base front wall 222 (according to FIG. 4). Thus, when the panel 230 is pivoted outwardly from the base front wall 222 about the panel hinge portion 234, the panel inner surface 238 is displayed on a left side of the base front wall 222. In the illustrated embodiment, the panel 230 includes a rounded corner positioned at a top edge of the panel 230 opposite the panel hinge portion 234. The rounded corner of the panel 230 may be utilized to grip the panel 230 in order to detach the panel inner surface 138 from the base front wall 122 and pivot the panel 130 to the panel open position.

Figure 6:
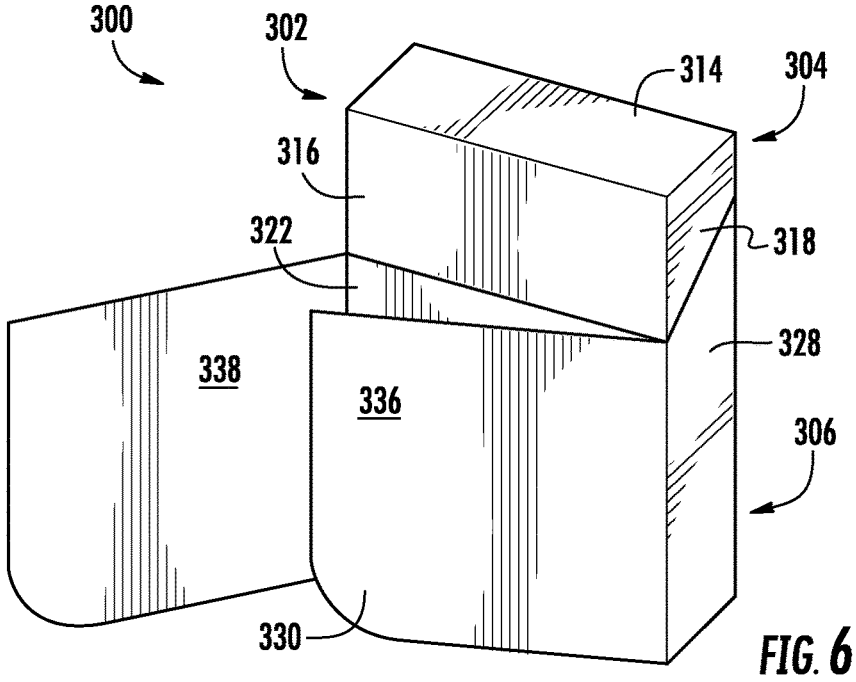
FIG. 6 is a perspective view of a package having a pair of overlapping fold-out front panels, with each of the front panels being shown in a partially open position, according to an exemplary embodiment.
Figure 7:
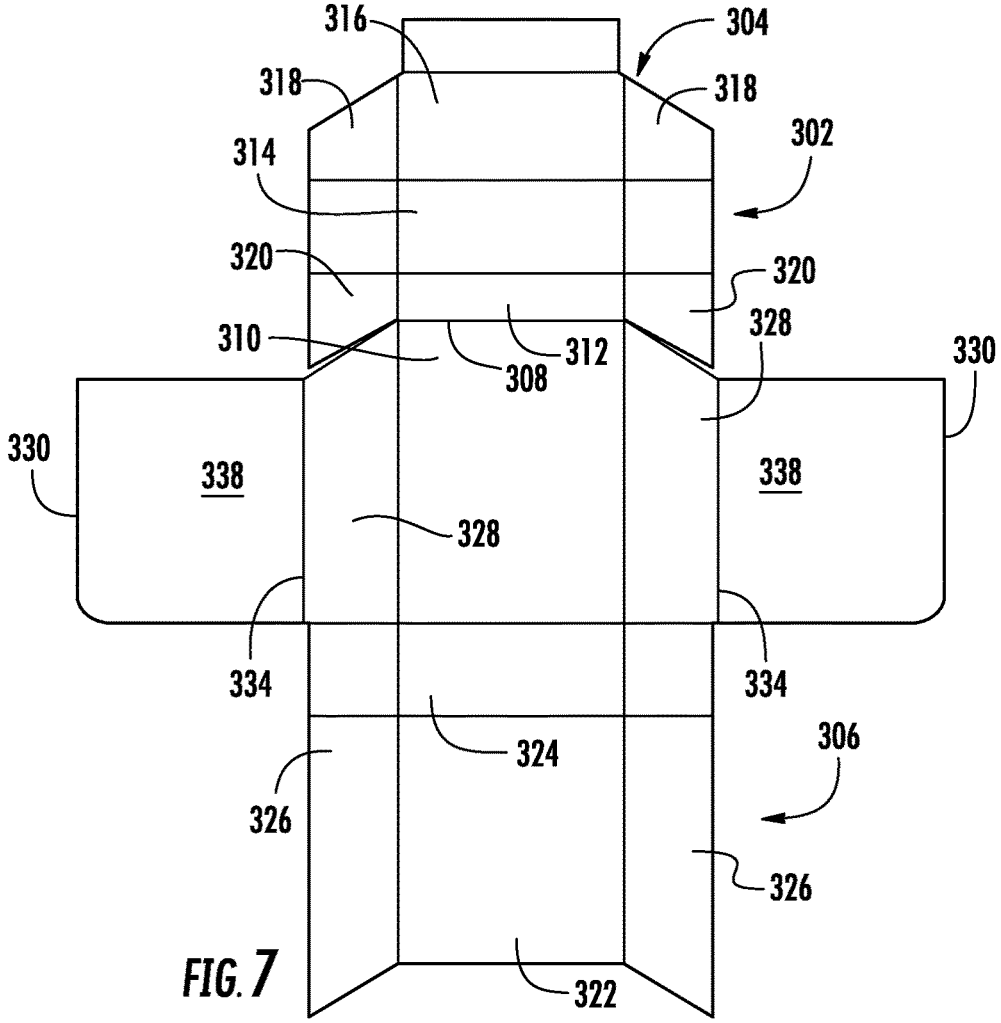
FIG. 7 is a top plan view of a blank used for the package of FIG. 6.

FIGS. 6-7 show an additional embodiment of a box 302 of a cigarette package 300. The box 302 and its features may be similar to the boxes 102 and 202 described herein, and any disclosure relating to the boxes 102 and 202 may be applied similarly to the box 302. The box 302 includes a lid 304 and a base 306. The lid 304 includes a lid top wall 314, a lid rear wall 312, and a lid front wall 316. The lid front wall 316 includes first lid side tabs 318 coupled thereto, and the lid rear wall 312 includes second lid side tabs 320 coupled thereto. The base 306 includes a base front wall 322, a base bottom wall 324, and a base rear wall 310. The base front wall 322 includes first base side tabs 326 coupled thereto, and the base rear wall 310 includes second base side tabs 328 coupled thereto. A hinge portion 308 is formed between the base rear wall 310 and the lid rear wall 312. The lid 304 is pivotable about the hinge portion 308 between open and closed positions.

The base 306 also includes two fold-out front panels 330 (e.g., flaps, doors, folds, etc.). The panels 330 may be similar to each other, and may also be similar to the panels 130 and 230. The panels 330 include panel outer surfaces 336 and panel inner surfaces 338. The panels 330 are coupled to a front edge (according to FIG. 6) of opposite second base side tabs 328 via panel hinge portions 334. The panels 330 are configured to pivot relative to the second base side tabs 328 about an axis generally defined by the panel hinge portions 334. When the box 302 is in folded form, the panels 330 are each pivotable thereby between a panel closed position in which the panels 330 overlap to at least partially cover the base front wall 322, and a panel open position in which the base front wall 322 is revealed. The panels 330 may have dimensions that are similar to the dimensions of the base front wall 322 in order to at least partially cover the base front wall 322 in the closed position.

When the panels 330 are in the overlapping closed position, the inner surface 338 of one of the panels 330 (i.e., a first panel) may engage with an outer surface of the base front wall 322. Likewise, the inner surface 338 of the other of the panels 330 (i.e., a second panel) may overlap the first panel to engage with the outer surface 336 of the first panel. In this configuration, the second panel may be detached from the underlying surface (i.e., the outer surface 336 of the first panel) to pivot the second panel to the open position, revealing the outer surface 336 of the first panel and the inner surface 338 of the second panel (as is shown by way of example in FIG. 6). When the second panel is in the open position, the first panel may be detached from the underlying surface (i.e., the outer surface of the base front wall 322) to pivot the first panel to the open position, revealing the outer surface of the base front wall 322 and the inner surface 338 of the first panel. In the illustrated embodiment, the panels 330 each include a rounded corner positioned at a bottom edge of the panels 330 and opposite the hinge portions 334. The rounded corners of the panels 330 may be utilized to grip the panels 330 in order to pivot the panels 330 to the open position.

The surfaces 336 and 338 provide additional space on the box 302 for displaying information to a user of the package 300. Each of the surfaces 336 and 338 includes a display area (i.e., an area in which information may be displayed) that is approximately equal to the display area of the base front wall 322. When both panels 330 are in the closed position, at least one of the outer surfaces 336 may be utilized to display product identifying information (e.g., a brand name, an advertisement, etc.) to a prospective purchaser of the product, such as when the package 300 is sealed and displayed for sale. When the panels 330 are pivoted outwardly away from the base front wall 322 to an open position, the inner surfaces 338 and the base front wall 322 are revealed to a user of the package 300. In the open position, the two inner surfaces 338 and the base front wall 322 may provide a single display area that is three times the display area of the base front wall 322 itself. In one embodiment, the display area formed by the two inner surfaces 338 and the base front wall 322 may be utilized to display a single set of information, including to display an image or message that spans two or more of the inner surfaces 338 and the outer surface of the base front wall 322.

Figure 8:
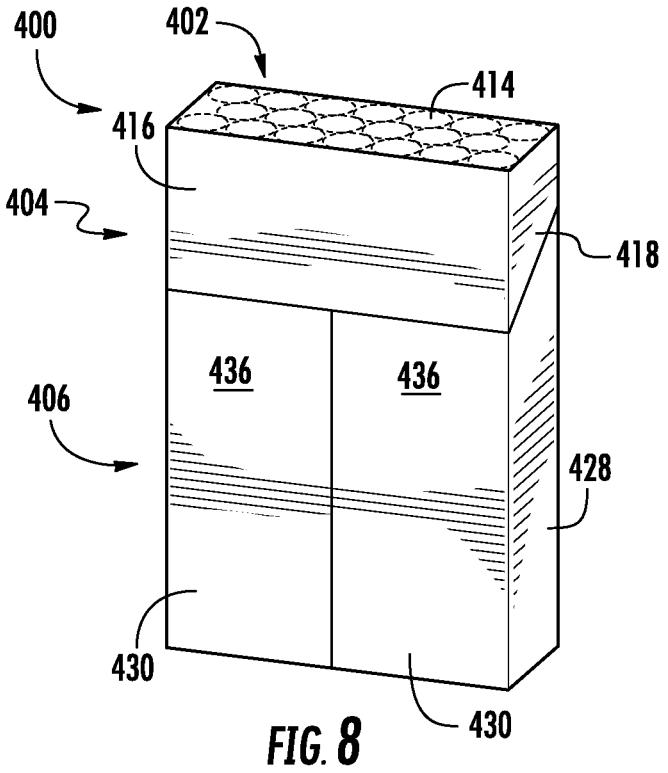
FIG. 8 is a perspective view of a package having a pair of fold-out front panels each shown in a closed position, according to an exemplary embodiment.
Figure 9:
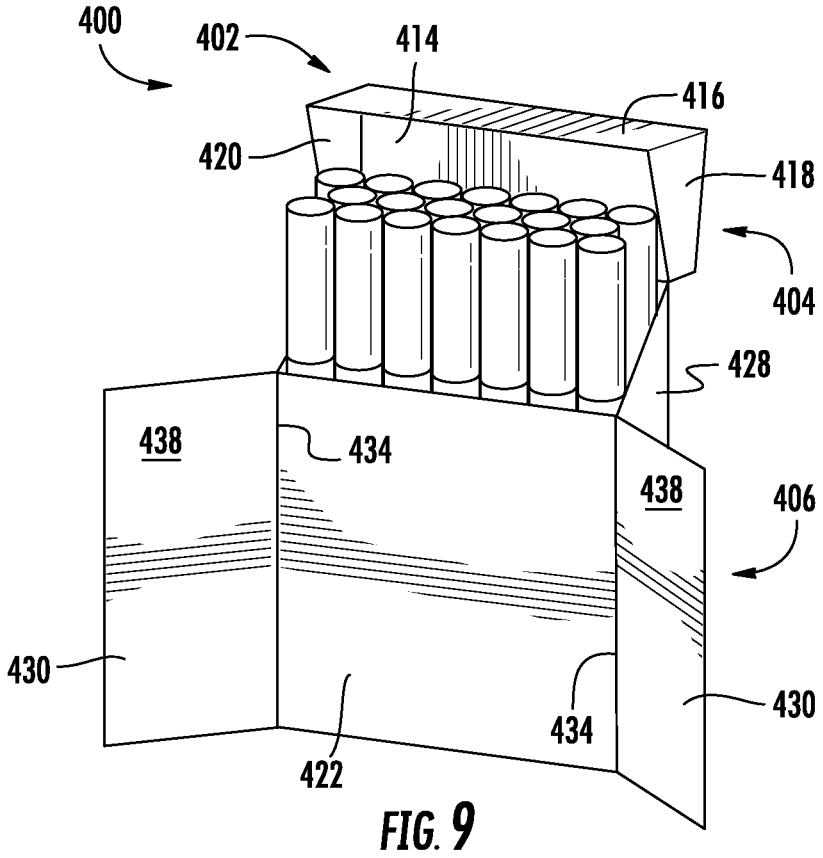
FIG. 9 is a perspective view of the package of FIG. 8, with each of the front panels being shown in an open position.

FIGS. 8-9 show an additional embodiment of a box 402 of a cigarette package 400. The box 402 and its features may be similar to any of the boxes 102-302 described herein, and any disclosure relating to the boxes 102-302 may be applied similarly to the box 402. The box 402 includes a lid 404 and a base 406. The lid 404 includes a lid top wall 414, a lid rear wall (not shown), and a lid front wall 416. The lid front wall 416 includes first lid side tabs 418 coupled thereto, and the lid rear wall includes second lid side tabs 420 coupled thereto. The base 406 includes a base front wall 422, a base bottom wall (not shown), and a base rear wall (also not shown). The base front wall 422 may include first base side tabs (not shown) coupled thereto, and the base rear wall may include second base side tabs 428 coupled thereto. A hinge portion 408 is formed between the base rear wall and the lid rear wall. The lid 404 is pivotable about the hinge portion 408 between open and closed positions.

The base 406 also includes two fold-out front panels 430 (e.g., flaps, doors, folds, etc.). The panels 430 may be similar to each other, and may also be similar to the panels 130-330. The panels 430 each include a panel outer surface 436 and a panel inner surface 438. The panels 430 are coupled to a front edge (according to FIG. 8) of opposite second base side tabs 428 via hinge portions 434. The panels 430 are configured to pivot relative to the second base side tabs 428 about an axis generally defined by the hinge portions 434. When the box 402 is in folded form, the panels 430 are each pivotable thereby between a panel closed position (shown in FIG. 8) in which the panels 430 combine to substantially cover the base front wall 422, and a panel open position (shown in FIG. 9) in which the base front wall 422 and the panel inner surfaces 438 are revealed. In an exemplary embodiment, the panels 430 each cover approximately half of the base front wall 422 in the closed position. In this embodiment, the panels 430 have similar dimensions to each other, including each having a height that is similar to the height of the base front wall 422 and a width that is approximately half of the width of the base front wall 422.

The surfaces 436 and 438 provide additional exterior surface space on the box 402 for displaying information to a user of the package 400. The outer surfaces 436 are visible when the panels 430 are in the closed position, including when the package 400 is sealed. The panel outer surfaces 436 may combine to provide a display area that is approximately equal to the display area of the base front wall 422. The panel inner surfaces 438 and the base front wall 422 are revealed to a user (e.g., a consumer or buyer) when the panels 430 are pivoted outwardly away from the base front wall 422 to the panel open position. The panel inner surfaces 438 and the base front wall 422 may be utilized to provide additional information to the user. The inner surfaces 438 each have a display area that is approximately half of the display area of the base front wall 422. The two inner surfaces 438 and the base front wall 422 may form a single display area that is approximately twice the size of the display area of the base front wall 422 itself. In one embodiment, the display area formed by the two inner surfaces 438 and the base front wall 422 may be utilized to display an image or message that spans two or more of the surfaces 438 and the outer surface of the base front wall 422.

Figure 10:
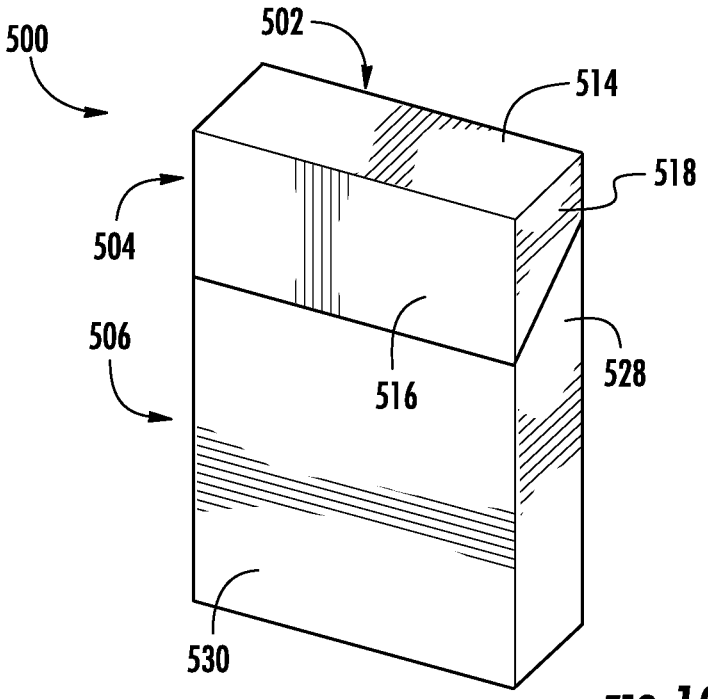
FIG. 10 is a perspective view of another package having a fold-out front panel, with the fold-out front panel being shown in a closed position, according to an exemplary embodiment.
Figure 11:
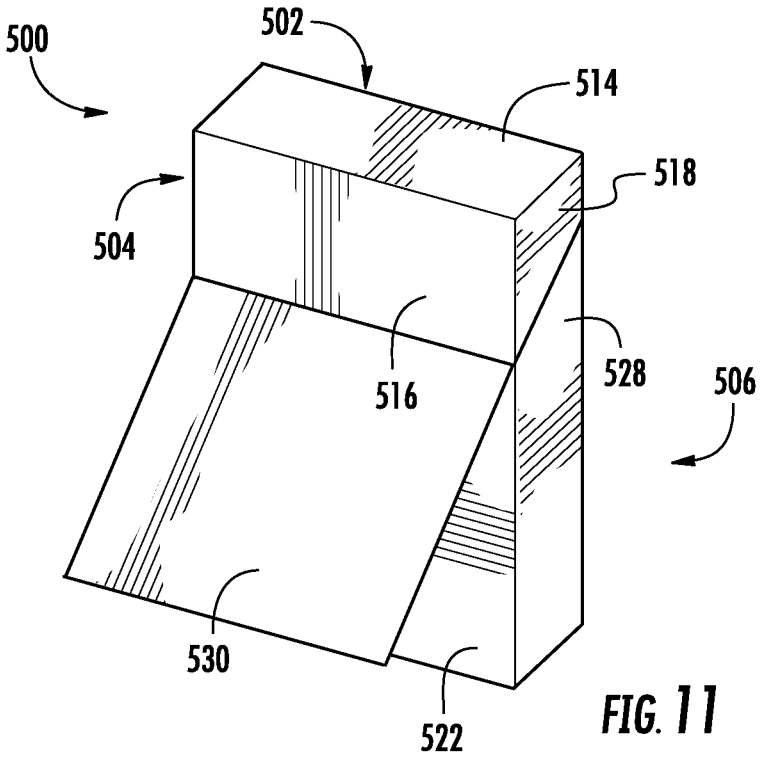
FIG. 11 is a perspective view of the package of FIG. 10, with the fold-out front panel being shown in a partially open position.
Figure 12:
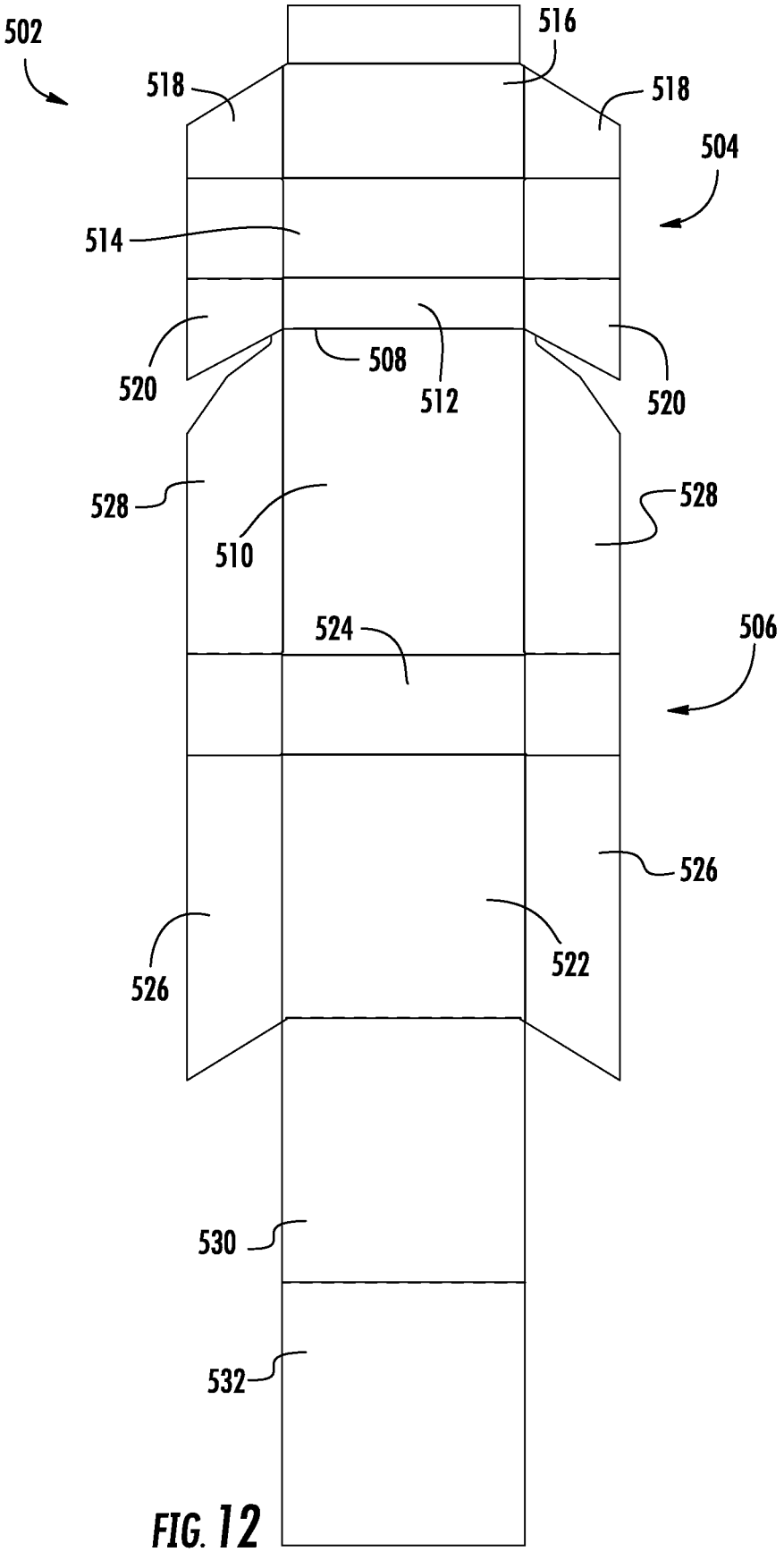
FIG. 12 is a top plan view of a blank used for the package of FIG. 10.

FIGS. 10-12 show an additional embodiment of a box 502 of a cigarette package 500. The box 502 and its features may be similar to any of the boxes 102-402 described herein, and any disclosure relating to the boxes 102-402 may be applied similarly to the box 502. The box 502 includes a lid 504 and a base 506. The lid 504 includes a lid top wall 514, a lid rear wall 512, and a lid front wall 516. The lid front wall 516 includes first lid side tabs 518 coupled thereto, and the lid rear wall 512 includes second lid side tabs 520 coupled thereto. The base 506 includes a base front wall 522, a base bottom wall 524, and a base rear wall 510. The base front wall 522 includes first base side tabs 526 coupled thereto, and the base rear wall 510 includes second base side tabs 528 coupled thereto. A hinge portion 508 is formed between the base rear wall 510 and the lid rear wall 512. The lid 504 is pivotable about the hinge portion 508 between open and closed positions.

The base 506 also includes a fold-out front panel 530 (e.g., flap, door, fold, etc.). The panel 530 may be similar to panels 130 and 230, although the panel 530 pivots about a top end of the base front wall 522. The panel 530 includes an outer panel portion 532 and an inner panel portion 534. The panel 530 is coupled to the top edge (according to FIG. 10) of the base front wall 522 via a panel hinge portion 536. The panel 530 is configured to pivot relative to the base front wall 522 about an axis generally defined by the hinge portion 536. When the box 502 is in folded form (shown in FIGS. 10 and 11), the panel 530 is pivotable thereby between a panel closed position in which the panel 530 at least partially covers the base front wall 522, and a panel open position in which the inner panel portion 534 and the base front wall 522 are revealed. When the box 502 is in folded form, the hinge portion 536 is positioned on a top side of the base front wall 522 (according to FIG. 10). Thus, when the panel 530 is pivoted outwardly from the base front wall 522 about the panel hinge portion 536, the inner panel portion 534 is displayed on a top side of (e.g., above) the base front wall 522.

In the illustrated embodiment of FIGS. 10-12, the panel 530 is formed by the two panel portions 532 and 534. The panel portions 532 and 534 are joined together by a hinge portion 538, and configured to pivot 180 degrees about the hinge portion 538. When the box 502 is in the folded configuration (shown in FIG. 10), the panel portions 532 and 534 are pivoted about the hinge portion 538, such that surfaces of the panel portions 532 and 534 contact each other. The panel portions 532 and 534 are coupled together in this configuration to form the panel 530. For instance, adhesive may be applied to the contacting surfaces of the panel portions 532 and 534 to couple the panel portions 532 and 534. Forming the panel 530 from the two panel portions 532 and 534 enables all display (e.g., outer) surfaces of the box 502 to be displayed on a single side of the flat box blank shown in FIG. 12. In this configuration, all information to be displayed on the box 502 may be printed on a single side of the box blank. In other embodiments, the panel 530 may be formed by a single flap in a manner similar to the other panels (e.g., panels 130 and 230) described herein.

FIGS. 13-16 show an additional embodiment of a box 602 of a cigarette package 600 having a serpentine tri-fold configuration. The box 602 and its features may be similar to any of the boxes 102-502 described herein, and any disclosure relating to the boxes 102-502 may be applied similarly to the box 602. The box 602 includes a lid 604 and a base 606. The lid 604 includes a lid top wall 614, a lid rear wall 612, a lid front wall 616, and lid side walls 618. The lid rear wall 612 includes lid side tabs 620 coupled thereto. A hinge portion 608 is formed between the lid rear wall 612 and a rear wall of the base 606 (e.g., third base rear wall 674). The lid 604 is pivotable rearward relative to the base 606 about an axis generally defined by the hinge portion 608. Thereby, the lid 604 may be moved between an open position (shown by way of example in FIG. 14) and a closed position (shown in FIG. 13).

The base 606 includes three coupled segments having a serpentine, or S-shaped, tri-fold configuration, including a front base segment 630, a center base segment 650, and a rear base segment 670. The three segments 630, 650, 670 are configured to fold and unfold in an accordion-like manner between a closed, or compact, position (shown in FIGS. 13 and 14) and an extended position (shown in FIG. 15). For instance, the base 606 may include hinge portions coupling the segments 630, 650, 670 to allow the segments 630, 650, 670 to pivot relative to each other about an axis formed by the hinge portions. When the lid 604 is in the closed position (shown in FIG. 13), the base 606 is prevented from unfolding to the extended position by the closed lid 604. When the lid 604 is pivoted to the open position (shown in FIGS. 14 and 15), the base 606 is no longer restricted and may be unfolded to the extended position.

Each of the segments 630, 650, 670 includes similar features. The front base segment 630 includes a first base front wall 632, a first base rear wall 634, a first base bottom wall 636, and first base side walls 638. The center base segment 650 includes a second base front wall 652, a second base rear wall 654, a second base bottom wall 656, and second base side walls 658. The rear base segment 670 includes a third base front wall 672, a third base rear wall 674, a third base bottom wall 676, and third base side walls 678. When the base 606 is in the compact position, the first base rear wall 634 may engage the second base front wall 652, and the second base rear wall 654 may engage the third base front wall 672 such that the outer surfaces of the walls 634, 652, 654, and 672 may not be visible.

Additionally, when the base 606 is in the compact position, the base side walls 638, 658, 678 of each of the segments 630, 650, and 670 combine to form opposite side walls of the base 606. In the illustrated embodiment, a height of a rear edge of the first base side wall 638 generally corresponds to a height of a front edge of the second base side wall 658, and a height of a rear edge of the second base side wall 658 generally corresponds to a height of a front edge of the third base side wall 678. In an exemplary embodiment, the slope formed by the top edges of the base side walls 638, 658, 678 when the base 606 is in the compact position generally corresponds to the slope of a bottom edge of the lid side wall 618. When the lid 604 is in the closed position and the base 606 is in the compact position, bottom portions of the lid side walls 618 may engage top portions of the base side walls 638, 658, 678.

Figure 13:
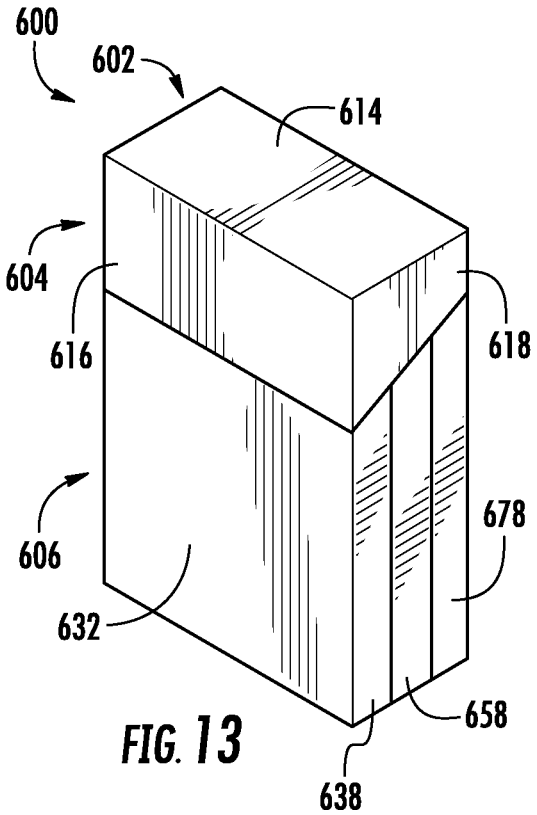
FIG. 13 is a perspective view of a package having a serpentine tri-fold configuration, with the package being shown in a closed, or compact, position, according to an exemplary embodiment.
Figure 14:
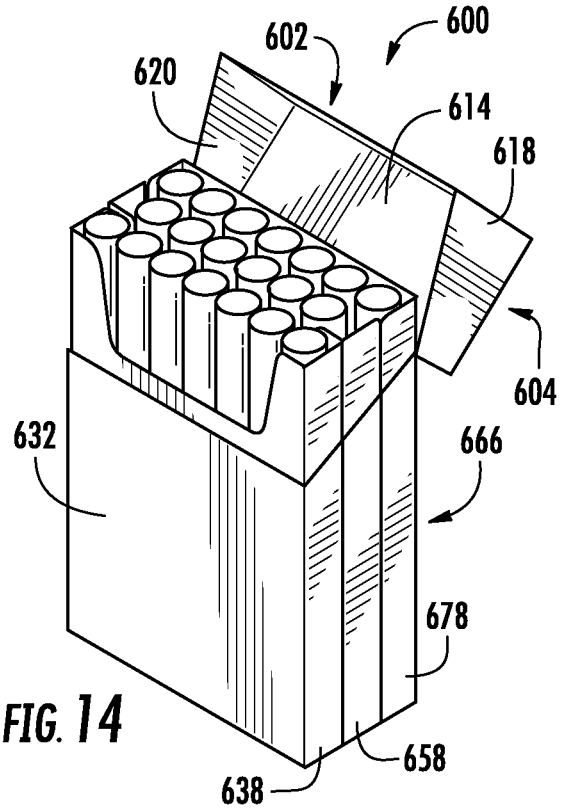
FIG. 14 is a perspective view of the package of FIG. 13, the package having a lid shown in an open position.
Figure 15:
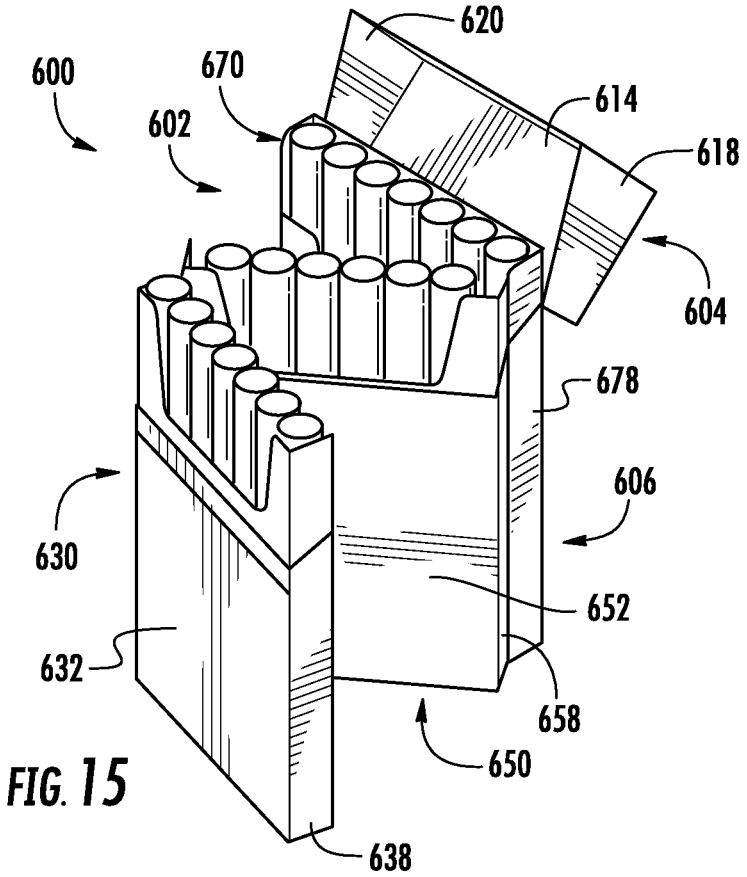
FIG. 15 is a perspective view of the package of FIG. 13, the package having a base shown in a partially extended, or open, position.
Figure 16:
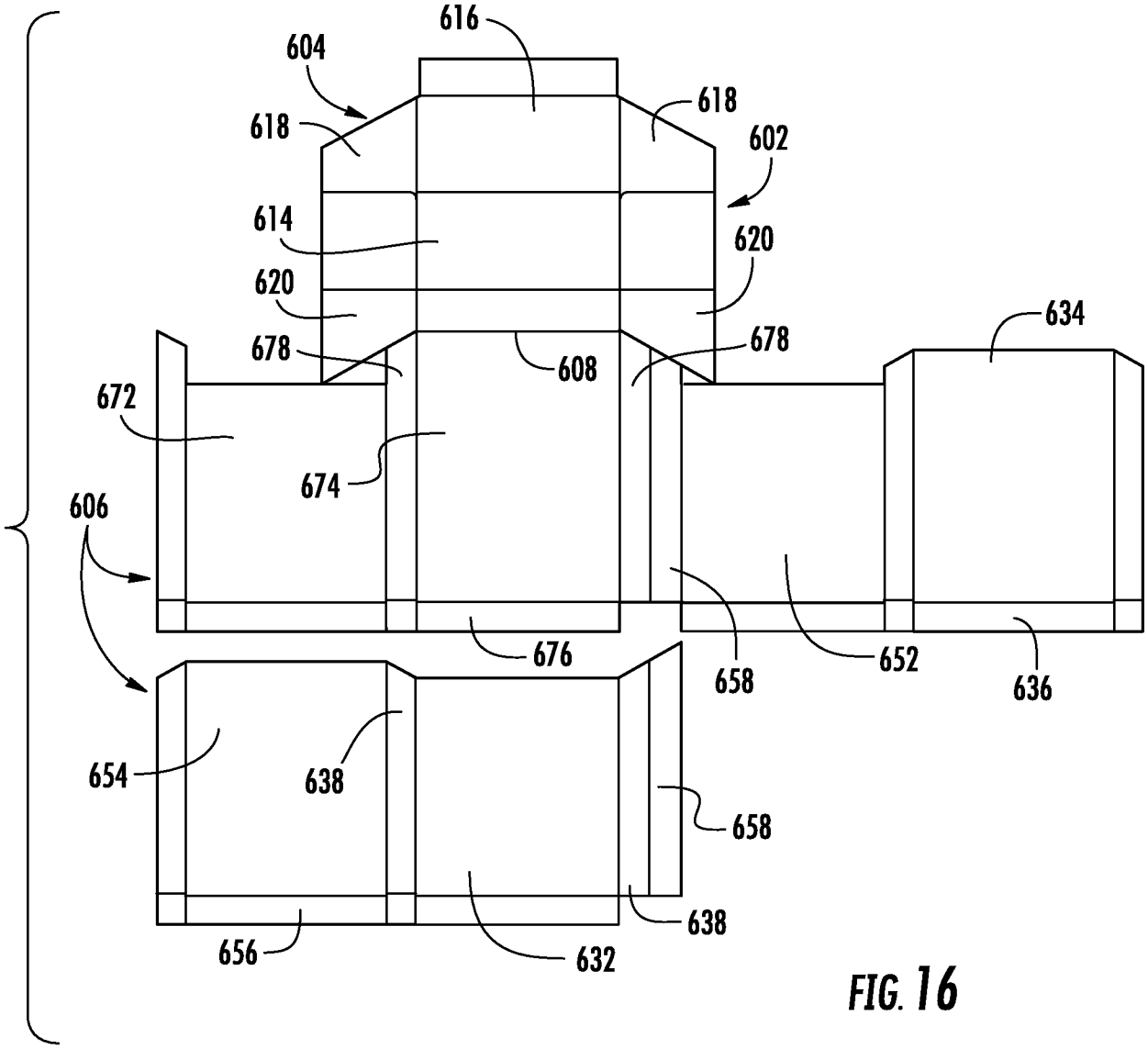
FIG. 16 is a top plan view of a blank used for the package of FIG. 13.

When the base 606 is in the compact position (as shown in FIGS. 13 and 14), the information display area for the box 602 includes outer surfaces of the side walls (e.g., base side walls 638, 658, 678, lid side walls 618), the top wall (e.g., lid top wall 614), the first base front wall 632, and the third base rear wall 674 of the box 602. These surfaces may be visible when the package 600 is sealed (e.g., prior to purchase). When the base 606 is moved to the extended position, additional display surfaces of the box 602 are revealed. The additional display surfaces includes at least outer surfaces provided on the first base rear wall 634, the second base front wall 652, the second base rear wall 654, and the third base front wall 672. These additional display surfaces may not be visible until the package 600 is opened (e.g., the seal of the package 600 is broken) and the lid 604 is moved to the lid open position, enabling the segments 630, 650, 670 to be moved to the extended position.

FIGS. 17-20 show an additional embodiment of a box 702 of a cigarette package 700 having a panoramic tri-fold configuration. The box 702 and its features may be similar to any of the boxes described herein, and any disclosure herein may be applied similarly to the box 702. In particular, the box 702 may be similar to the box 602. The box 702 includes a lid 704 and a base 706. The lid 704 includes a lid top wall 714, a lid rear wall 712, a lid front wall 716, and lid side walls 718. The lid rear wall 712 includes lid side tabs 720 coupled thereto. A hinge portion 708 is formed between the lid rear wall 712 and a rear wall of the base 706 (e.g., third base rear wall 774). The lid 704 is pivotable in a rearward direction relative to the base 706 about an axis generally defined by the hinge portion 708. Thereby, the lid 704 may be moved between an open position (shown by way of example in FIG. 18) and a closed position (shown in FIG. 17).

The base 706 includes three coupled segments having a panoramic tri-fold configuration, including a front base segment 730, a center base segment 750, and a rear base segment 770. The center base segment 750 and the front base segment 730 are each pivotally coupled to the rear base segment 770. The segments 730 and 750 are configured to pivot relative to the rear base segment 770 between a compact position (shown in FIGS. 17 and 18) and an extended position (shown by way of example in FIG. 19). For instance, the base 706 may include hinge portions coupling the segments 730 and 750 to the rear base segment 770. When the lid 704 is in the closed position (shown in FIG. 17), the base 706 is prevented from unfolding to the extended position. When the lid 704 is pivoted to the open position (shown in FIGS. 18 and 19), the base 706 is no longer restricted and may be unfolded to the extended position.

Each of the segments 730, 750, 770 includes similar features. The front base segment 730 includes a first base front wall 732, a first base rear wall 734, a first base bottom wall 736, and first base side walls 738. The center base segment 750 includes a second base front wall 752, a second base rear wall 754, a second base bottom wall 756, and second base side walls 758. The rear base segment 770 includes a third base front wall 772, a third base rear wall 774, a third base bottom wall 776, and third base side walls 778.

Figure 17:
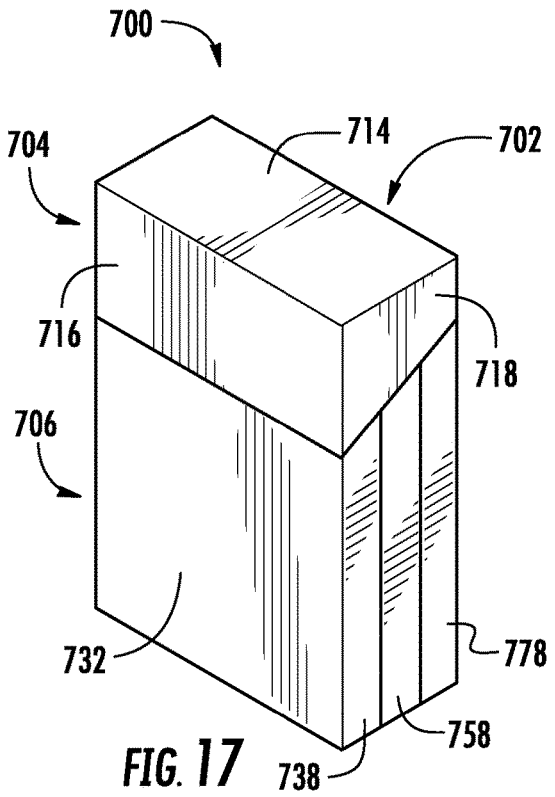
FIG. 17 is a perspective view of a package having a panoramic tri-fold configuration, with the package being shown in a closed, or compact, position, according to an exemplary embodiment.
Figure 18:
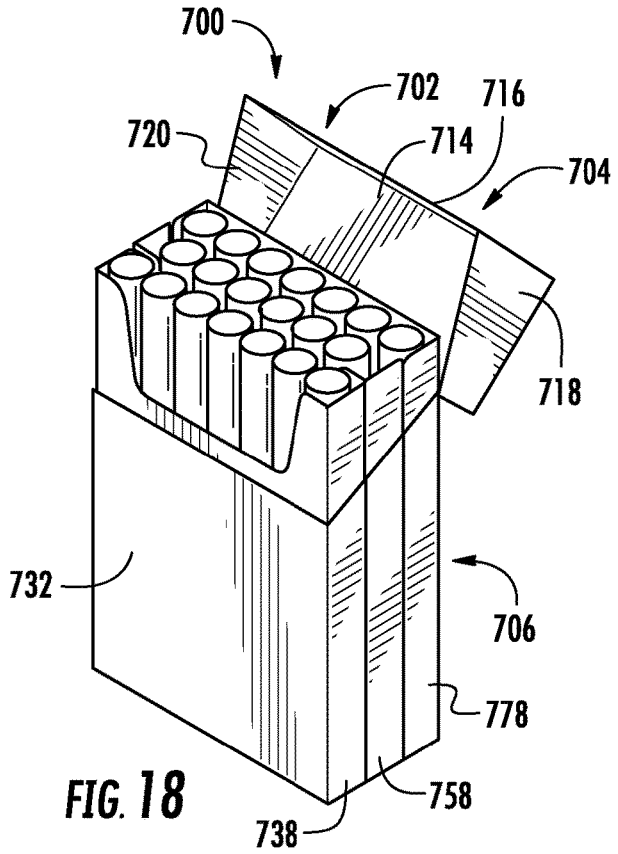
FIG. 18 is a perspective view of the package of FIG. 17, the package having a lid shown in an open position.
Figure 19:
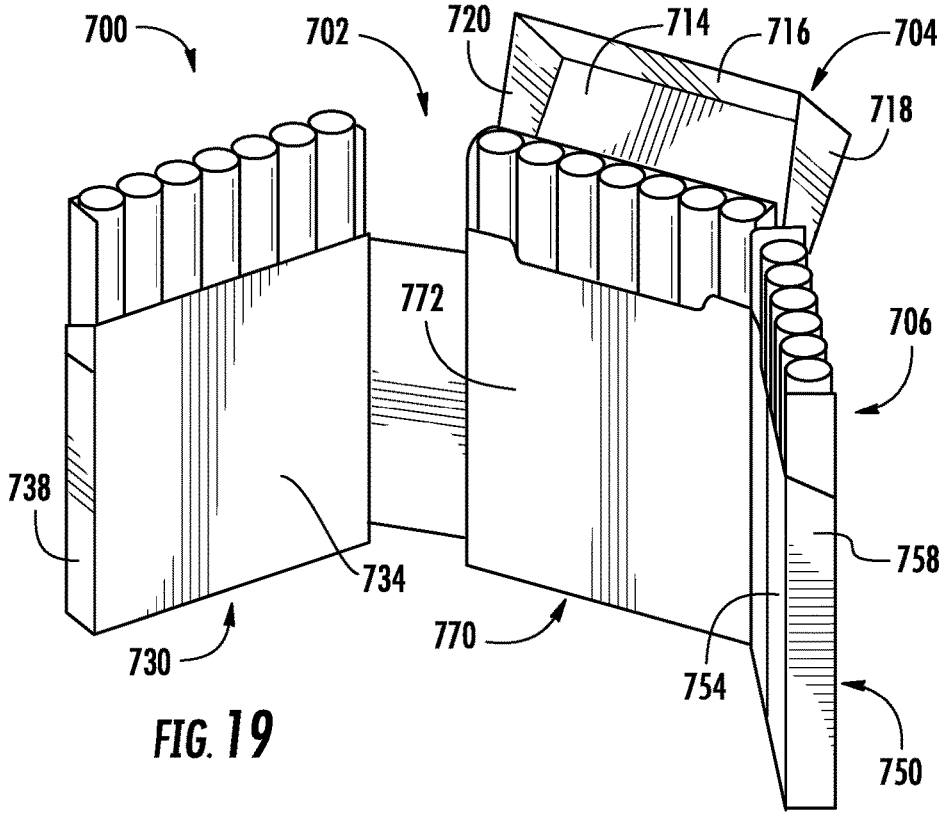
FIG. 19 is a perspective view of the package of FIG. 17, the package having a base shown in a partially extended, or open, position.
Figure 20:
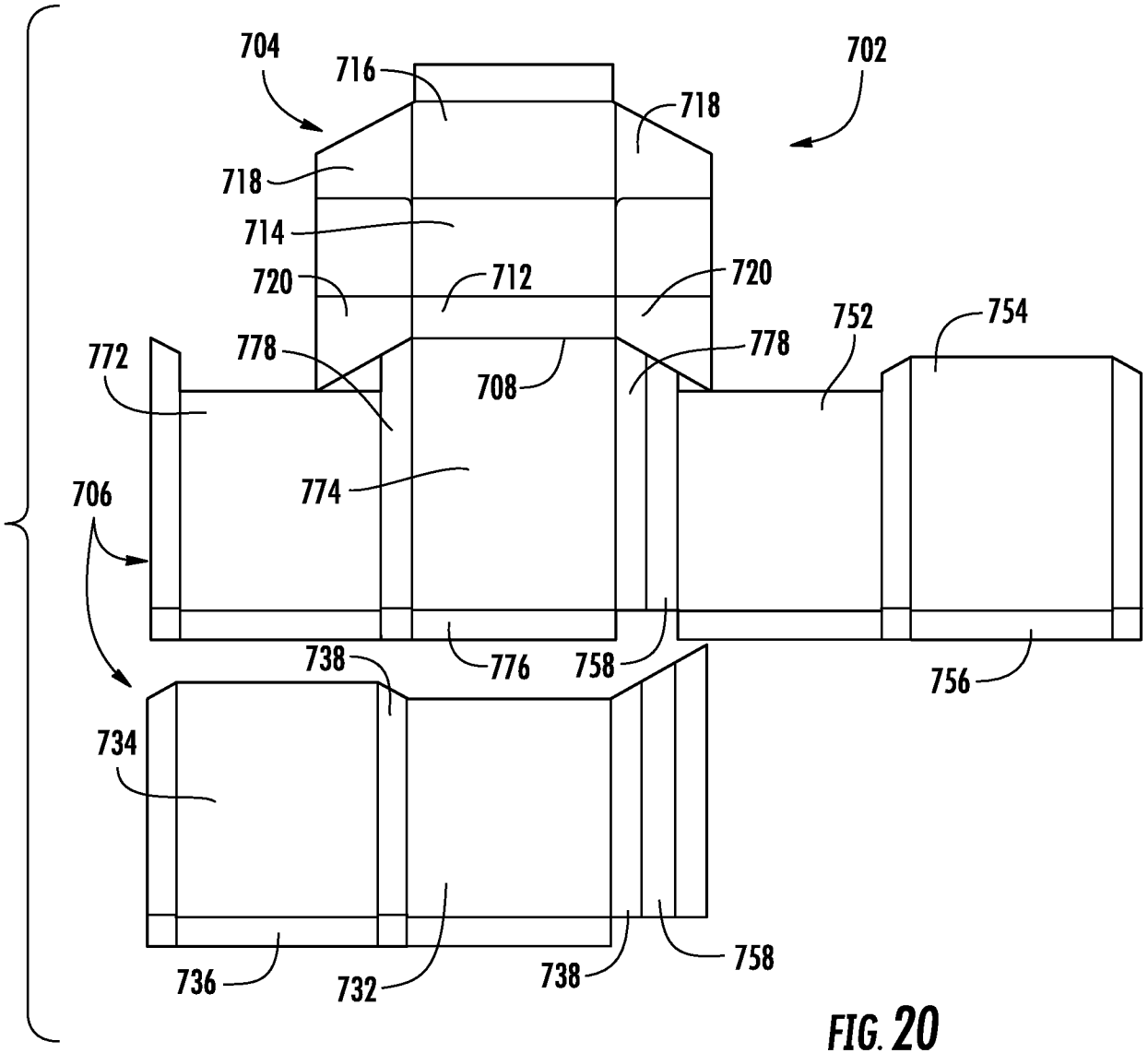
FIG. 20 is a top plan view of a blank used for the package of FIG. 17.

When the base 706 is in the compact position (as shown in FIGS. 17 and 18), the information display area for the box 702 includes outer surfaces of the side walls (e.g., base side walls 738, 758, 778, lid side walls 718), the lid top wall 714, the first base front wall 732, and the third base rear wall 774 of the box 702. These surfaces may be visible when the package 700 is sealed (e.g., prior to purchase). When the base 706 is moved to the extended position, additional display surfaces of the box 702 are revealed. For instance, when the front base segment 730 is pivoted outwardly away from the center base segment 750, the outer surfaces of the first base rear wall 734 and the second base front wall 752 may be revealed. The center base segment 750 may then be pivoted outwardly away from the rear base segment 770 to reveal the outer surfaces of the second base rear wall 754 and the third base front wall 772. These additional display surfaces may not be visible until the package 700 is opened (e.g., the seal of the package 700 is broken) and the lid 704 is moved to the lid open position, enabling the segments 730, 750, 770 to be moved to the extended position.

FIGS. 21-24 show an additional embodiment of a box 802 of a cigarette package 800 having a tri-fold configuration. The box 802 and its features may be similar to any of the boxes described herein, and any disclosure herein may be applied similarly to the box 802. In particular, the box 802 may be similar to the boxes 602 and 702. The box 802 includes a lid 804 and a base 806. The lid 804 includes a lid top wall 814, a lid rear wall 812, a lid front wall 816, and lid side walls 818. The lid rear wall 812 includes lid side tabs 820 coupled thereto. A hinge portion 808 is formed between the lid rear wall 812 and a rear wall of the base 806 (e.g., third base rear wall 874). The lid 804 is pivotable in a rearward direction relative to the base 806 about an axis generally defined by the hinge portion 808. Thereby, the lid 804 may be moved between an open position (shown by way of example in FIGS. 22 and 23) and a closed position (shown in FIG. 21).

The base 806 includes three coupled segments having a tri-fold configuration, including a front base segment 830, a center base segment 850, and a rear base segment 870. The center base segment 850 is pivotally coupled to the rear base segment 870. The front base segment 830 is pivotally coupled to the center base segment 850. The segments 830, 850, 870 are configured to pivot relative to each other in a book-like, or panoramic, manner between a compact position (shown in FIGS. 21 and 22) and an extended position (shown by way of example in FIG. 23). For instance, the base 806 may include hinge portions coupling the segments 830, 850, 870 to each other. Each of the segments 830, 850, 870 includes similar features. The front base segment 830 includes a first base front wall 832, a first base rear wall 834, a first base bottom wall 836, and first base side walls 838. The center base segment 850 includes a second base front wall 852, a second base rear wall 854, a second base bottom wall 856, and second base side walls 858. The rear base segment 870 includes a third base front wall 872, a third base rear wall 874, a third base bottom wall 876, and third base side walls 878.

Figure 21:
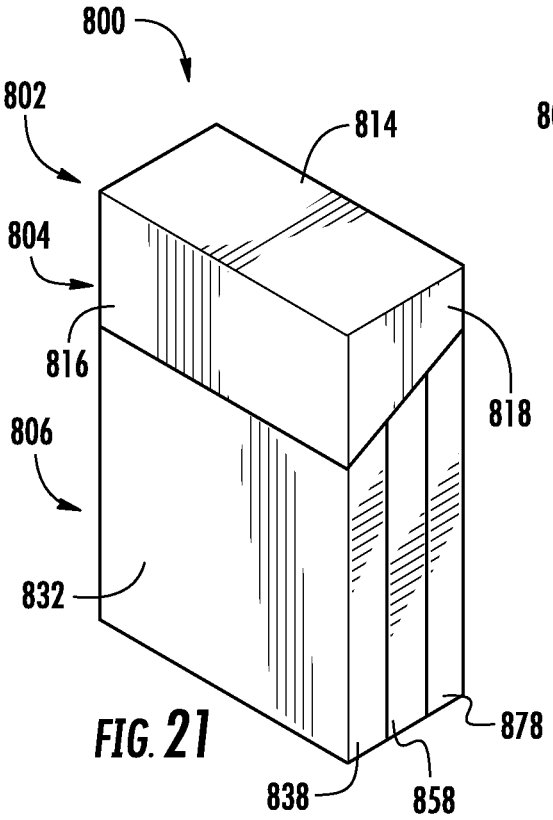
FIG. 21 is a perspective view of a package having a tri-fold configuration, with the package being shown in a closed, or compact, position, according to an exemplary embodiment.
Figure 22:
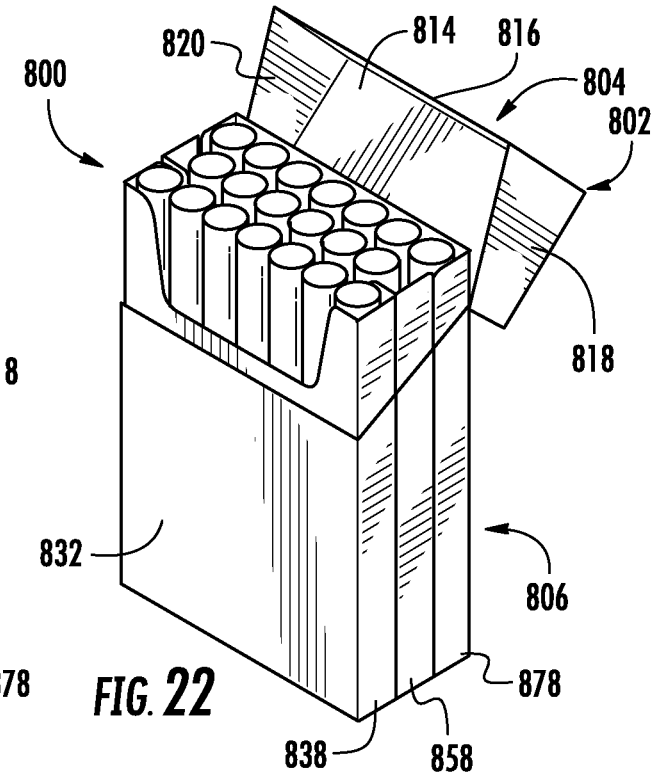
FIG. 22 is a perspective view of the package of FIG. 21, the lid shown in an open position.
Figure 23:
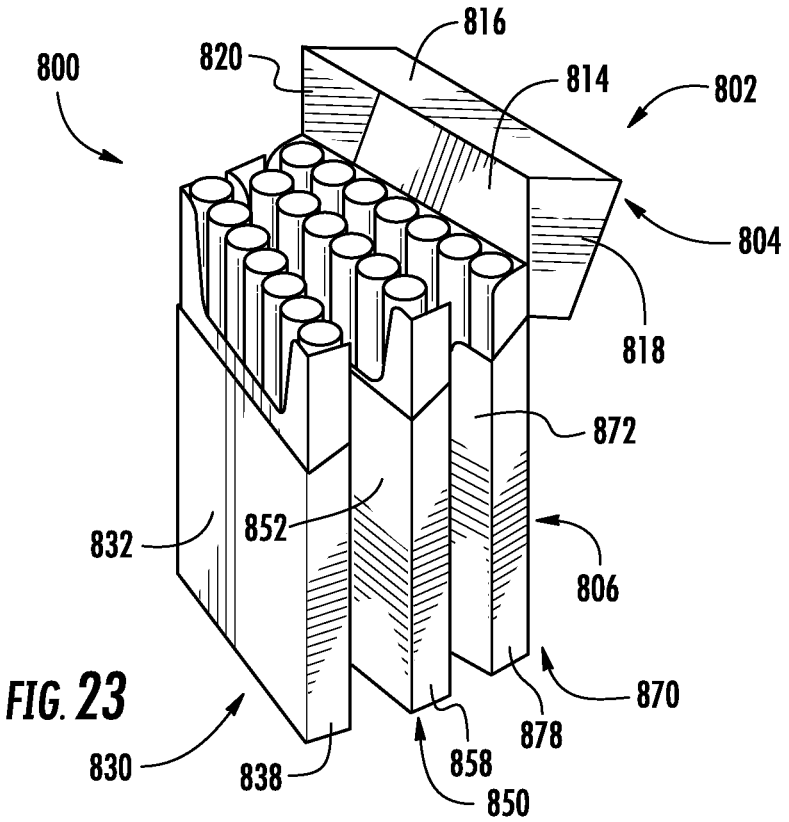
FIG. 23 is a perspective view of the package of FIG. 21, the base shown in a partially extended, or open, position.
Figure 24:
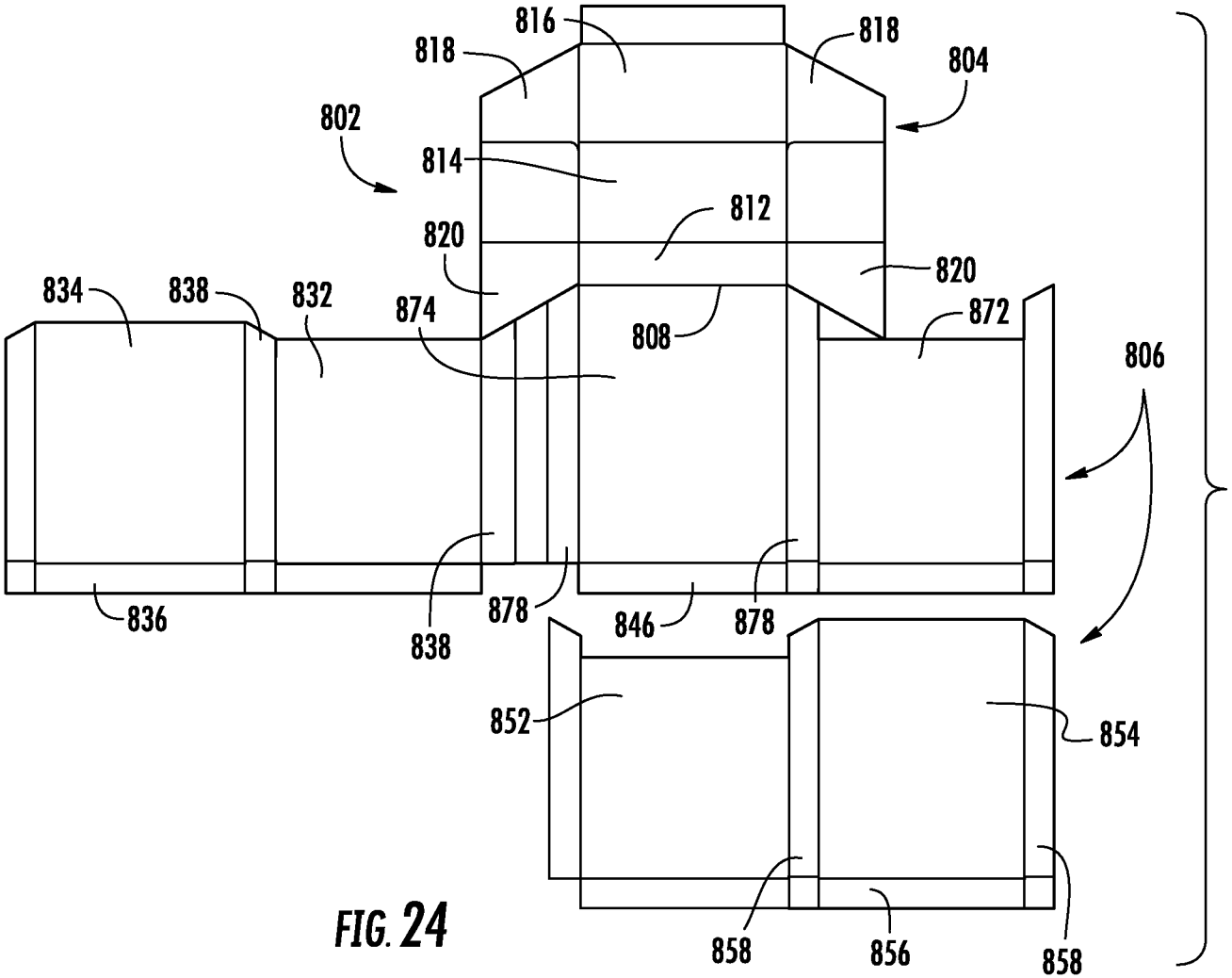
FIG. 24 is a top plan view of a blank used for the package of FIG. 21.
Figure 25:
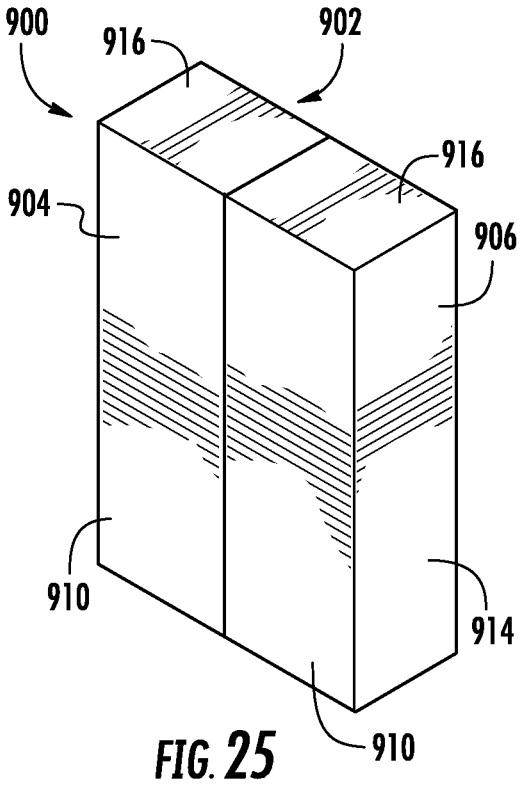
FIG. 25 is a perspective view of a package having a clam shell outer case enclosing an inner case, the outer case being shown in a closed position, according to an exemplary embodiment.
Figure 26:
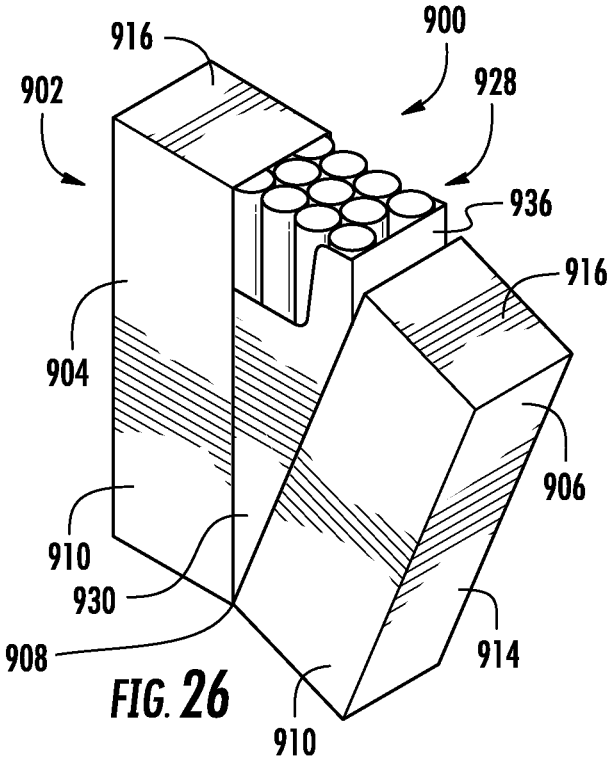
FIG. 26 is a perspective view of the package of FIG. 25, the outer case being shown in a partially open position.

When the base 806 is in the compact position (as shown in FIGS. 21 and 22), the information display area for the box 802 includes outer surfaces of the side walls (e.g., base side walls 838, 858, 878, lid side walls 818), the lid top wall 814, the first base front wall 832, and the third base rear wall 874 of the box 802. These surfaces may be visible when the package 800 is sealed (e.g., prior to purchase). When the base 806 is moved to the extended position, additional display surfaces of the box 802 are revealed. For instance, when the front base segment 830 is pivoted outwardly away from the center base segment 850, the outer surfaces of the first base rear wall 834 and the second base front wall 852 may be revealed. The center base segment 850 may also be pivoted outwardly away from the rear base segment 870 to reveal the outer surfaces of the second base rear wall 854 and the third base front wall 872.

FIGS. 25-28 show an additional embodiment of a cigarette package 900. The package 900 includes an outer case 902 configured to enclose an inner case 928. The outer case 902 (e.g., box, shell) and its features may be similar to the boxes described herein, and any disclosure herein may be applied similarly to the outer case 902. The outer case 902 has a clam shell configuration formed by a first outer case section 904 and a second outer case section 906 (e.g., clam shell sections 904 and 906). In an exemplary embodiment, the outer case sections 904 and 906 are symmetrical and identical to each other, each forming a half of the outer case 902. The first outer case section 904 and the second outer case section 906 are coupled together on a bottom side of the outer case 902 via a hinge portion 908 (e.g., a hinge, living hinge, etc.). More particularly, the hinge portion 908 is defined between a bottom wall of the first outer case section 904 (e.g., a first bottom wall tab 918) and a bottom wall of the second outer case section 906 (e.g., another first bottom wall tab 918). The outer case sections 904 and 906 are each configured to pivot downwardly and away from the other (e.g., independently of the other) about an axis generally defined by the hinge portion 908. Thereby, the outer case 902 may be opened or closed. The inner case 928 includes lock tabs 952 configured to interact with the outer case 902, holding the outer case 902 in a closed position absent manipulation of the outer case 902 by a user of the package 900.

The outer case sections 904 and 906 each include an outer case front wall 910, an outer case rear wall 912, and an outer case side wall 914. A first top wall tab 916 (e.g., a top wall portion) and a first bottom wall tab 918 (e.g., a bottom wall portion) are provided on opposite ends of the front wall 910. A second top wall tab 920 (e.g., a top wall portion) and a second bottom wall tab 922 (e.g., a bottom wall portion) are provided on opposite ends of the rear wall 912. A third top wall tab 924 and a third bottom wall tab 926 are provided on opposite ends of the side wall 914. When the outer case 902 is in folded form, an inner surface of the second top wall tabs 920 may be coupled to (e.g., engaged with) an outer surface of the third top wall tabs 924, and an inner surface of the first top wall tabs 916 may be coupled to an outer surface of the second top wall tabs 920. In this configuration, the top wall tabs 916, 920, and 924 combine to form a top wall of the outer case 902. The bottom wall tabs 918, 922, and 926 are similarly coupled to form a bottom wall of the outer case 902, with the bottom wall tabs 922 forming the outer bottom wall of the outer case 902. A connecting tab 950 is connected to the second bottom wall tab 922. The connecting tab 950 is joined to the second bottom wall tab 922 by a 180 degree fold line. The connecting tab 950 is configured to engage a slot 954 of the inner case 928 to couple the outer case 902 to the inner case 928. Similar features of the outer case sections 904 and 906 are shown and described herein using like reference numbers. However, in other exemplary embodiments, the outer case sections 904 and 906 may include features that are dissimilar, including having walls and tabs of any suitable size. The relative sizes disclosed herein are not intended to be limiting.

Still referring to FIGS. 25-28, the inner case 928 is configured to hold and present the product to a user of the package 900. The clam shell sections 904 and 906 of the outer case 902 are pivotable to an open position (shown in FIG. 27) to reveal the inner case 928, including the product. The inner case 928 is shaped similarly to the outer case 902, and is configured to fit within the outer case 902. The inner case 928 may be coupled to (e.g., engaged with) the outer case 902 to prevent the inner case 928 from dislodging from the outer case 902 when the outer case 902 is in an open position. For instance, a bottom wall of the inner case 928 may be coupled to the outer case 902 at or proximate (e.g., adjacent to, sharing a wall with, etc.) the hinge portion 908.

The inner case 928 includes an inner case front wall 930, an inner case bottom wall 932, an inner case rear wall 934, and inner case side walls 936. An inner case side tab 938 (e.g., a side wall portion) is provided on one side of the case front wall 930. First inner case bottom tabs 940 are provided on a bottom end of the case side walls 936. Second inner case bottom tabs 942 are provided on a bottom end of the case rear wall 934. When the inner case 928 is in folded form, an inner surface of the second case bottom tabs 942 may be coupled to (e.g., engaged with) an outer surface of the first case bottom tabs 940, and an inner surface of the case bottom wall 932 may be coupled to an outer surface of the second case bottom tabs 942. In this configuration, the case bottom wall 932 substantially covers the tabs 940 and 942 when the case 928 is in folded form. Slots 954 are formed between the inner case bottom tabs 942, and between the inner case bottom walls 932. The slots 954 are configured to receive the connecting tabs 950 of the outer case sections 904 and 906 to couple the outer case 902 to the inner case 928. The tabs 940 and 942 may strengthen or stabilize the bottom wall (e.g., the case bottom wall 932) of the case 928. Similarly, an inner surface of the case side wall 936 may be coupled to an outer surface of the case side tab 938.

Figure 27:
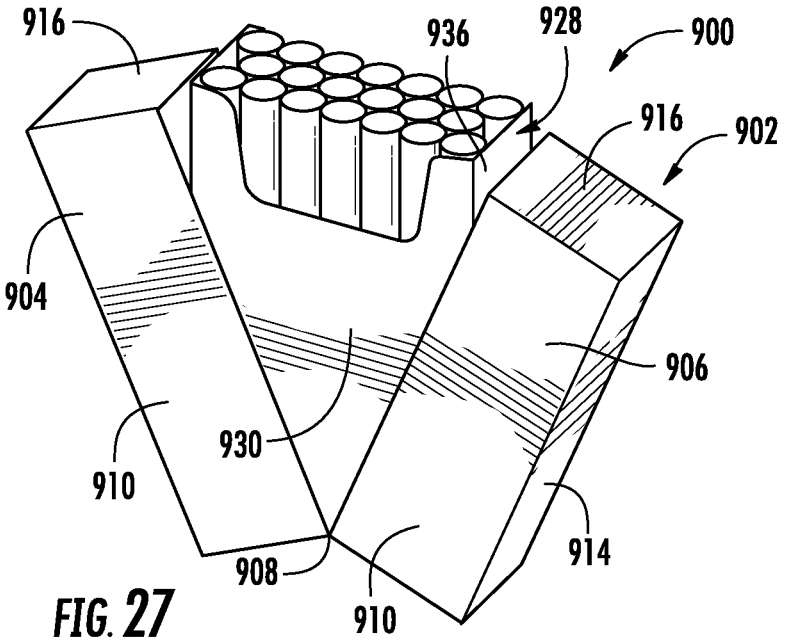
FIG. 27 is a perspective view of the package of FIG. 25, the outer case being shown in another partially open position.
Figure 28:
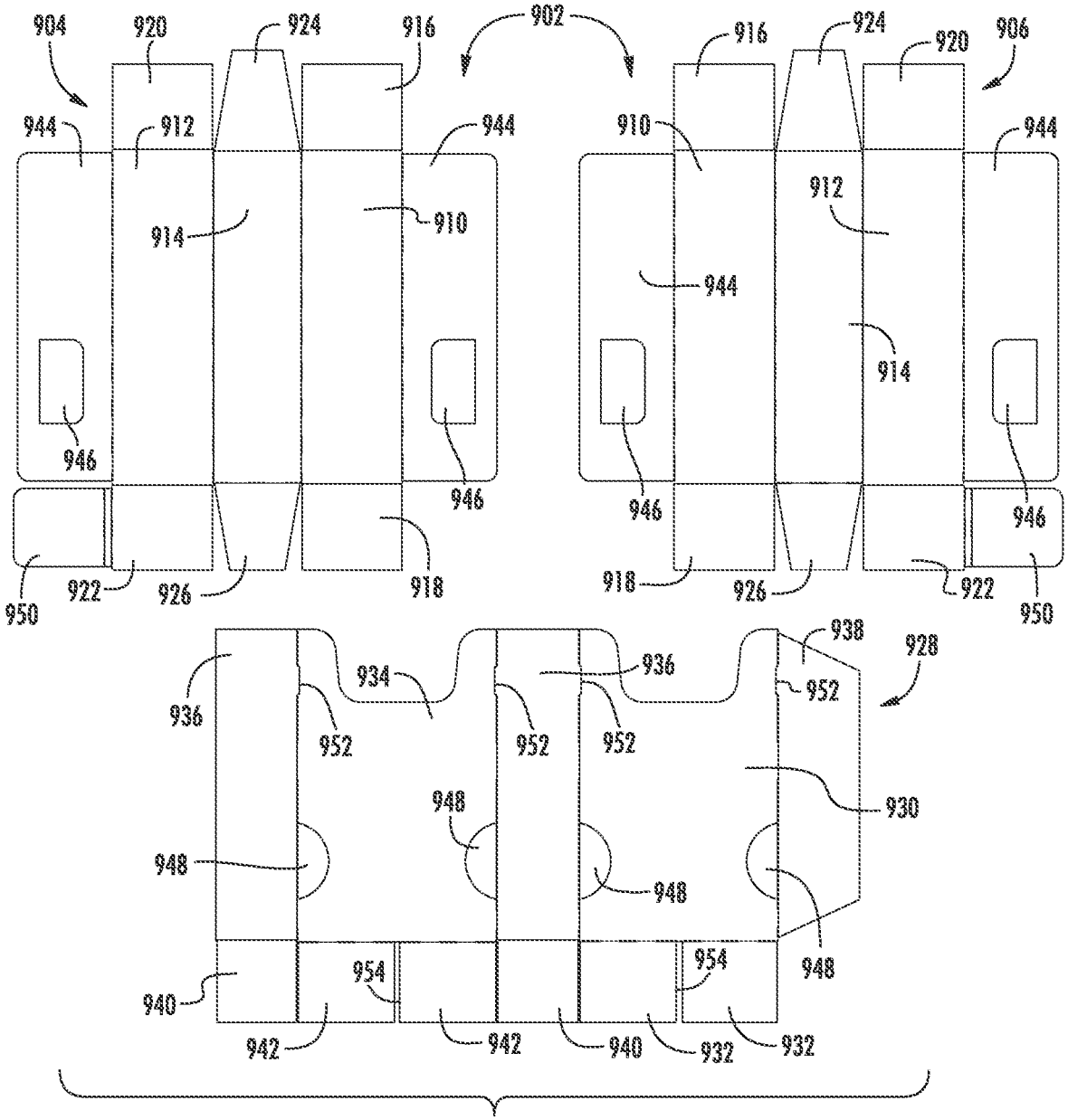
FIG. 28 is a top plan view of a blank used for the package of FIG. 25.

The case front wall 930 and the case rear wall 934 provide additional space on the package 900 for displaying information to a user. The outer surfaces of the case front wall 930 and the case rear wall 934 may be visible when the outer case sections 904 and 906 are pivoted to an open position (as shown in FIG. 27). Thus, these surfaces may be utilized to display information to a user of the package 900 upon opening the package 900. The front walls 910, rear walls 912, and side walls 914, on the other hand, may be visible when the package 900 is sealed, such as when the package 900 is displayed for sale. In an exemplary embodiment, the exterior surfaces of the outer case 902 may be utilized to display product identifying information, or other information related to the sale of the package 900. In this embodiment, the exterior surfaces of the inner case 928 may be utilized to display additional information to a purchaser of the package 900.

The outer case sections 904 and 906 each also include inner tabs 944. The inner tabs 944 are coupled to the front wall 910 and the rear wall 912 on opposite sides of each of the outer case sections 904 and 906. When the outer case sections 904 and 906 are in folded form, an inner surface of the inner tabs 944 may be coupled to an inner surface of the adjacent section wall (e.g., the front wall 910, the rear wall 912). The inner tabs 944 are connected to the front wall 910 or the rear wall 912 by 180 degree fold lines, enabling the inner tabs 944 to be folded from the configuration shown in FIG. 28 (i.e., flat) to the configuration of FIGS. 25-27 (i.e., folded). The inner tabs 944 each include locking features 946 (e.g., pockets, tabs, female slots, etc.). The locking features 946 are configured to receive corresponding locking features 948 (e.g., flaps, tabs, tags, male tabs, etc.) of the inner case 928. When the sections 904 and 906 are pivoted to the open position, the locking features 946 of the outer case 902 are configured to engage the locking features 948 of the inner case 928, preventing the outer case 902 from rotating, or opening, past a desired open position. The locking features 948 and 946 are configured to ensure that the product within the inner case 928 is accessible when the locking features 946 and 948 are engaged (i.e., when the outer case 902 is opened).

FIGS. 29-33 show an additional embodiment of a box 1002 of a cigarette package 1000. The box 1002 and its features may be similar to the other boxes described herein, and any disclosure herein may be applied similarly to the box 1002. The box 1002 includes two separate box sections 1050*a* and 1050*b*, each having features that are similar to the other boxes described herein. In an exemplary embodiment, the box sections 1050*a-b* are substantially symmetrical and identical to each other. Each of the box sections 1050*a-b* may be used to store approximately half of the product that is provided by the box 1002. The box sections 1050*a-b* are coupled together by a connecting portion 1040 at a rear wall (e.g., a base rear wall 1010). The box sections 1050*a-b* are configured to move (e.g., pivot, rotate, etc.) relative to each other via the connecting portion 1040 between a box closed (e.g., compact) position (shown in FIG. 29) and a box open (e.g., extended) position (shown in FIG. 31).

Figure 30:
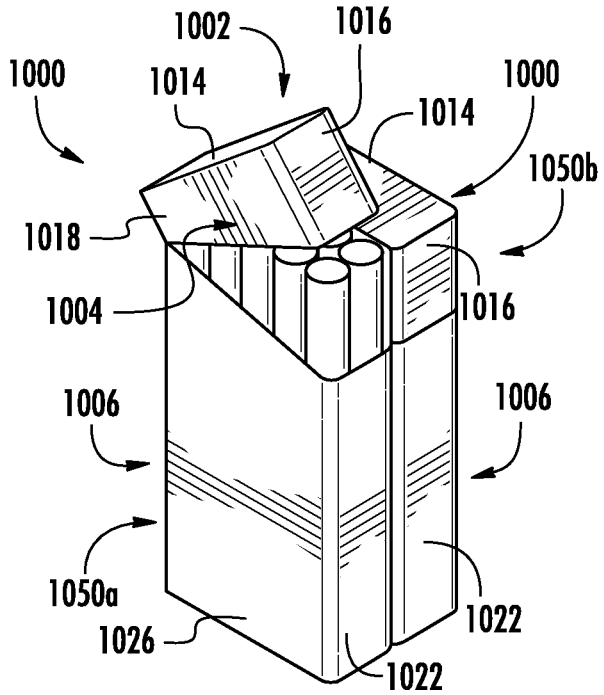
FIG. 30 is another perspective view of the package of FIG. 29, with one of the lids being shown in a partially open position.
Figure 31:
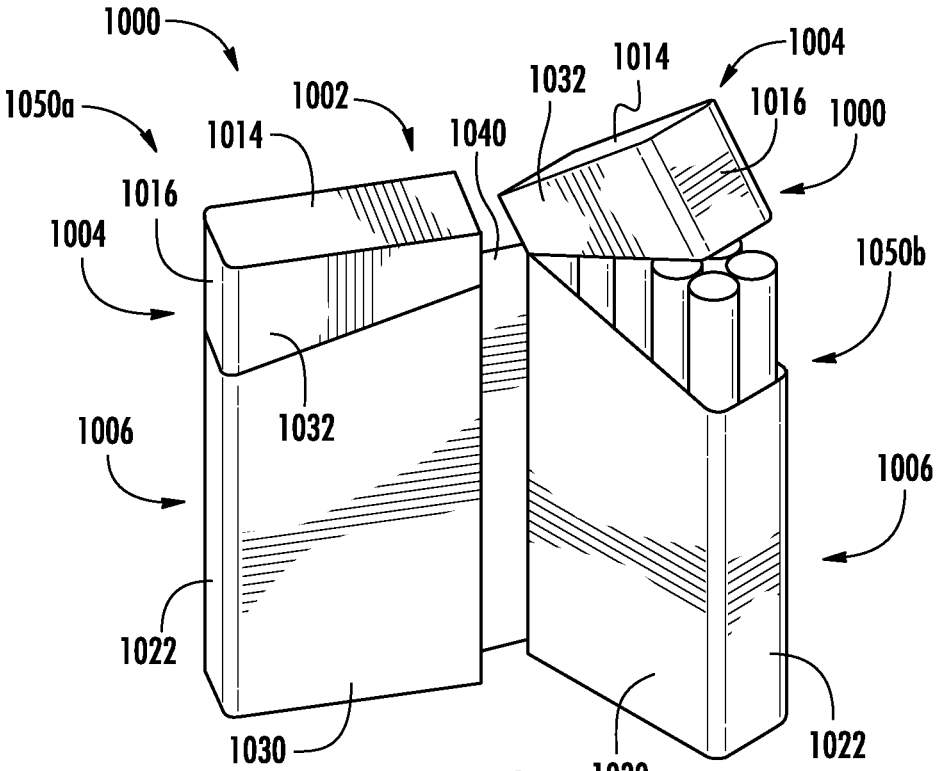
FIG. 31 is a perspective view of the package of FIG. 29, with one of the lids being shown in a partially open position and the package being shown in a partially extended, or open, position.
Figure 32:
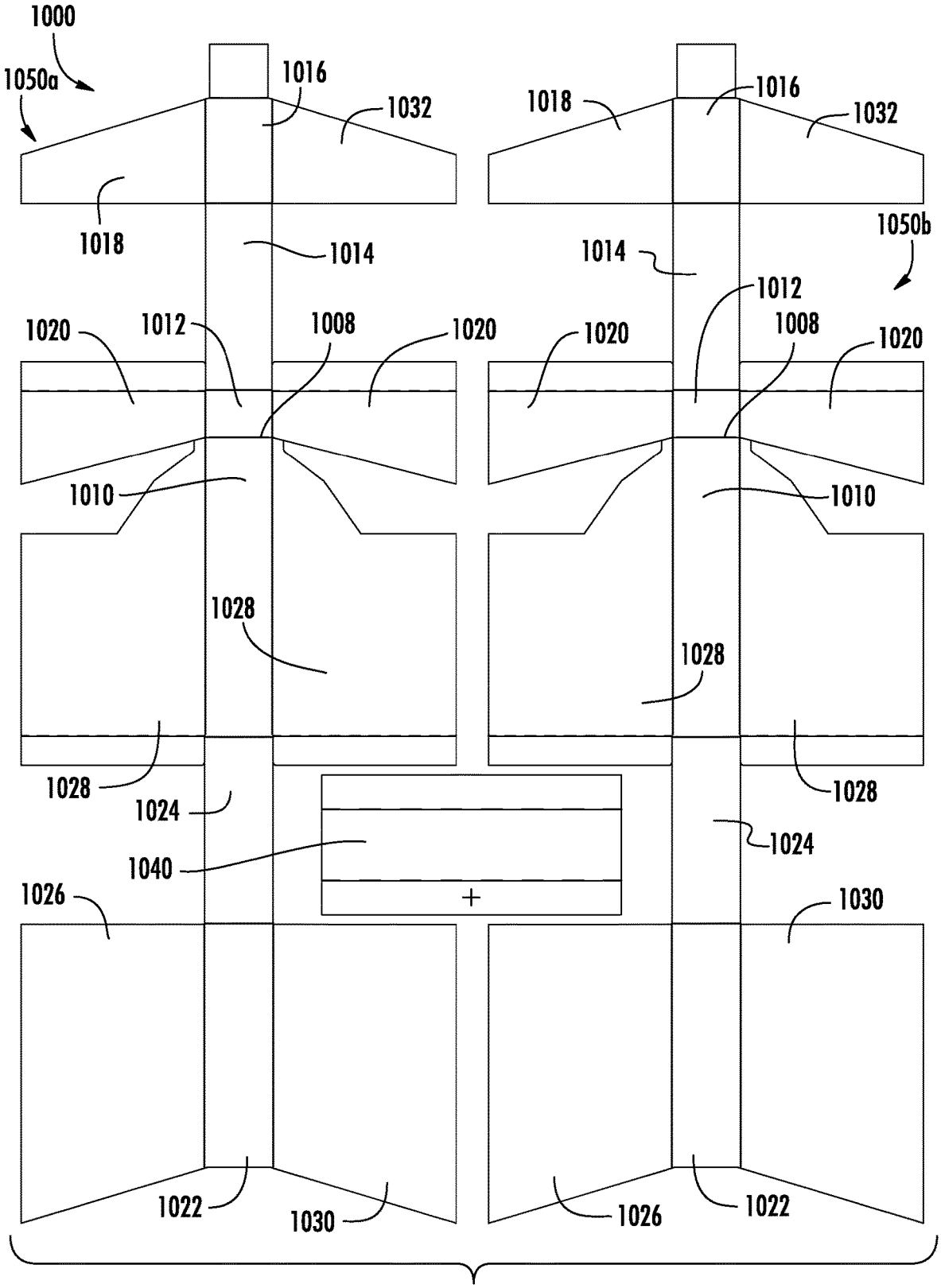
FIG. 32 is a top plan view of a blank used for the package of FIG. 29.
Figure 33:
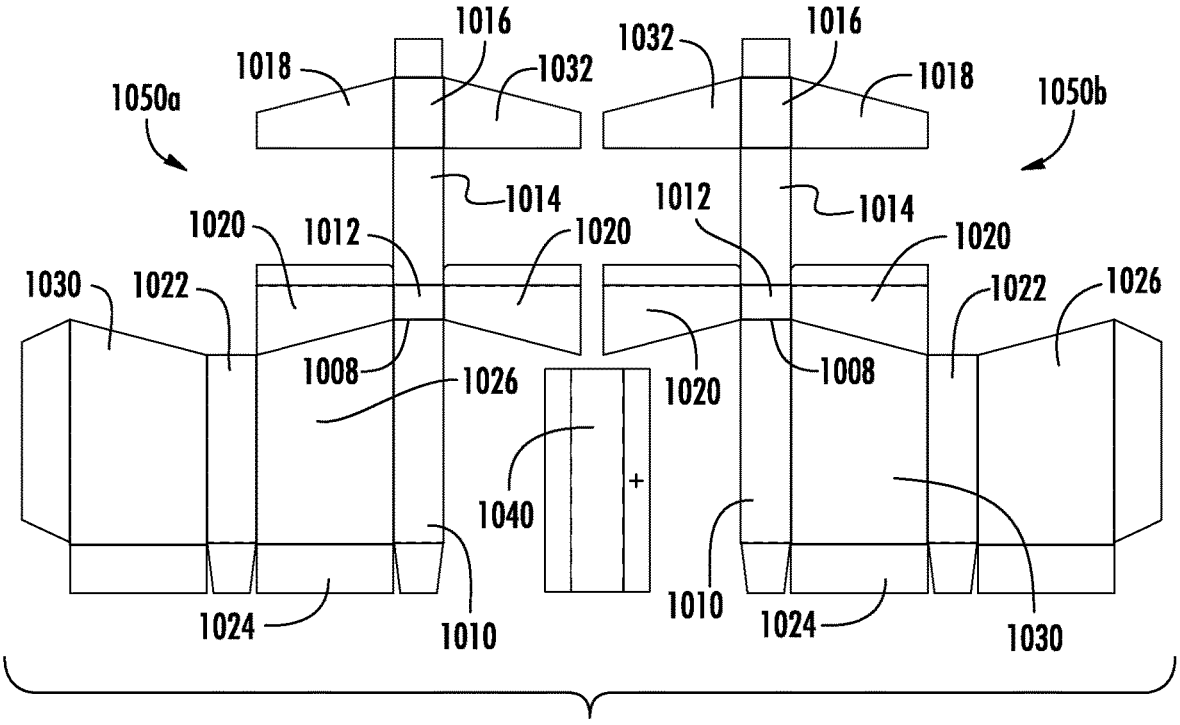
FIG. 33 is a top plan view of another blank used for the package of FIG. 29.

Each of the box sections 1050*a-b* includes a lid 1004 and a base 1006. The lid 1004 includes a lid top wall 1014, a lid rear wall 1012, and a lid front wall 1016. The lid front wall 1016 includes first lid side tabs 1018 and 1032 coupled on opposite sides thereto, and the lid rear wall 1012 includes second lid side tabs 1020 coupled thereto. When the lid 1004 is in folded form, the lid side tabs 1018, 1020, and 1032 are coupled to at least partially form the side walls of the lid 1004, as is similarly described herein in relation to other embodiments. The base 1006 includes a base front wall 1022, a base bottom wall 1024, and the base rear wall 1010. The base front wall 1022 includes first base side tabs 1026 and 1030 coupled on opposite sides thereto, and the base rear wall 1010 includes second base side tabs 1028 coupled thereto. When the base 1006 is in folded form, the base side tabs 1026, 1028, and 1030 are coupled to form the side walls of the base 1006, as is similarly described herein in relation to other embodiments. A hinge portion 1008 is formed between the base rear wall 1010 and the lid rear wall 1012. The lid 1004 is pivotable about the hinge portion 1008 between open and closed positions. In an exemplary embodiment, the lid 1004 may be pivoted to an open position when the box sections 1050*a-b* are in a closed position (as shown in FIG. 30), or in an open position (as shown in FIG. 31).

The walls of the box sections 1050*a-b* may be utilized to display information to a user of the package 1000, including prospective purchasers. When the box sections 1050*a-b* are in the closed position of FIG. 29, the information display area includes the exposed (e.g., visible) outer surfaces of the box sections 1050*a-b*, including outer surfaces of the side walls (e.g., the first base side tabs 1026, the first lid side tabs 1018), the front walls (e.g., the base front walls 1022, the lid front walls 1016), and the rear walls (e.g., the base rear walls 1010, and the lid rear walls 1012). These surfaces may be visible when the package 1000 is sealed (e.g., prior to purchase). The available display area in the closed position may be similar to the area that is available on another package of similar size.

In the open position, additional display surfaces of the box 1002 are revealed. The additional display surfaces include outer surfaces provided on inner walls of the box sections 1050*a-b* (e.g., the first base side tabs 1030, the first lid side tabs 1032). These additional display surfaces may not be visible until the package 1000 is opened (e.g., the seal of the package 1000 is broken), enabling the box sections 1050*a-b* to be pivoted to the open position. These additional display surfaces may thus be utilized to provide targeted information to an end user of the product, including information regarding offers, rewards, or other available products. In an exemplary embodiment, the display surfaces of the first base side tabs 1030 and the first lid side tabs 1032 may be combined to form a single unified display area that is larger than any display area that is visible in the closed position. For instance, the first base side tabs 1030 may be utilized to display an image or message that extends onto the first base side tabs 1030 of both of the boxes 1002. In one embodiment, the box sections 1050*a-b* are configured to pivot away from each other so that the surfaces of the first base side tabs 1030 are parallel and flush with each other, forming a substantially flat, unified display area.

Figure 29:
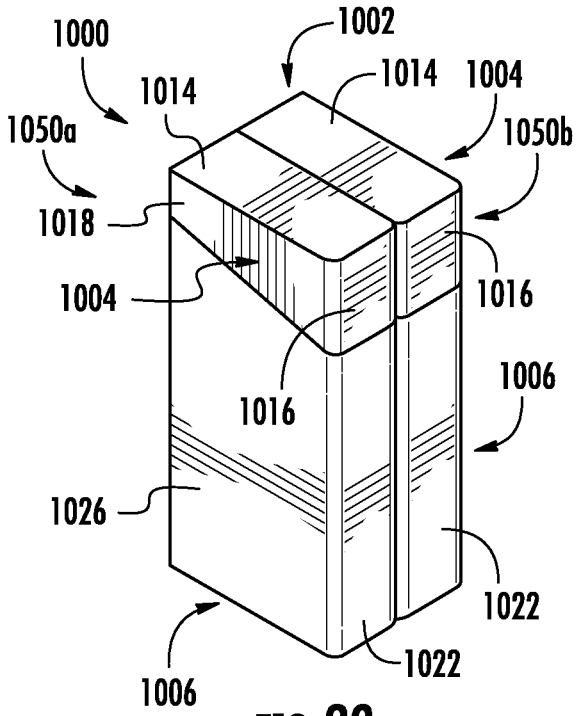
FIG. 29 is a perspective view of a package having a bi-fold configuration and a pair of lids, the package being shown in a closed, or compact, position, according to an exemplary embodiment.

When the box sections 1050*a-b* are in the closed position shown in FIG. 29, inner walls of the box sections 1050*a-b* (e.g., first base side tabs 1030, first lid side tabs 1032) may engage with each other. For instance, a temporary (e.g., removable, re-useable, etc.) adhesive or other fastener may be used to removably couple the first base side tabs 1030 and/or the first lid side tabs 1032 to each other. In these embodiments, the box sections 1050*a-b* (e.g., the first base side tabs 1030, the first lid side tabs 1032) may be detached from each other to pivot the box sections 1050*a-b* to the open position. In some embodiments, the inner walls of the box sections 1050*a-b* may be re-engaged (e.g., re-attached, re-coupled, etc.) to each other by pivoting the box sections 1050*a-b* to the closed position.

Figure 34:
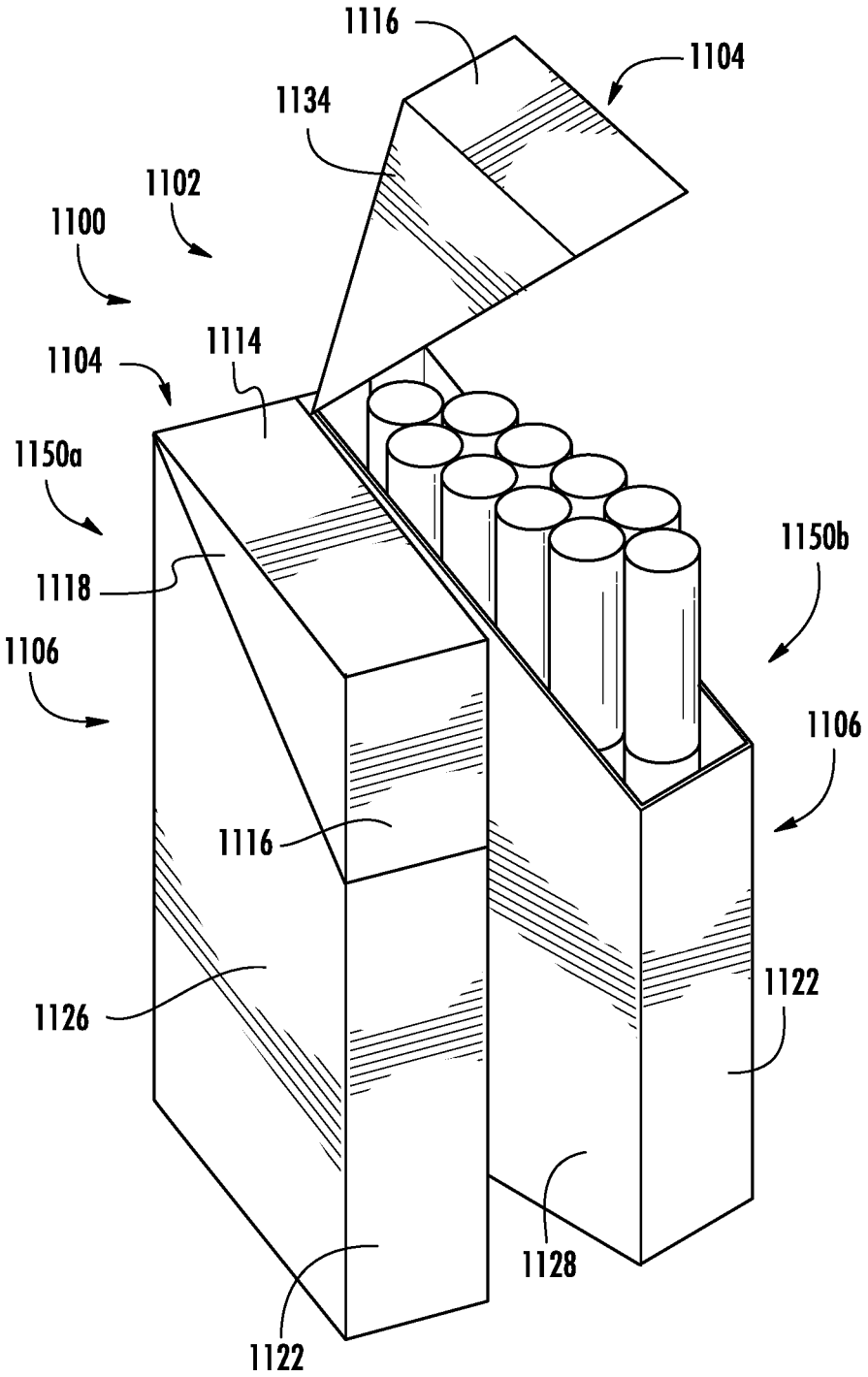
FIG. 34 is a perspective view of another package having a bi-fold configuration and a pair of lids, with one of the lids being shown in an open position and a base of the package being shown in a partially extended, or open, position, according to an exemplary embodiment.
Figure 35:
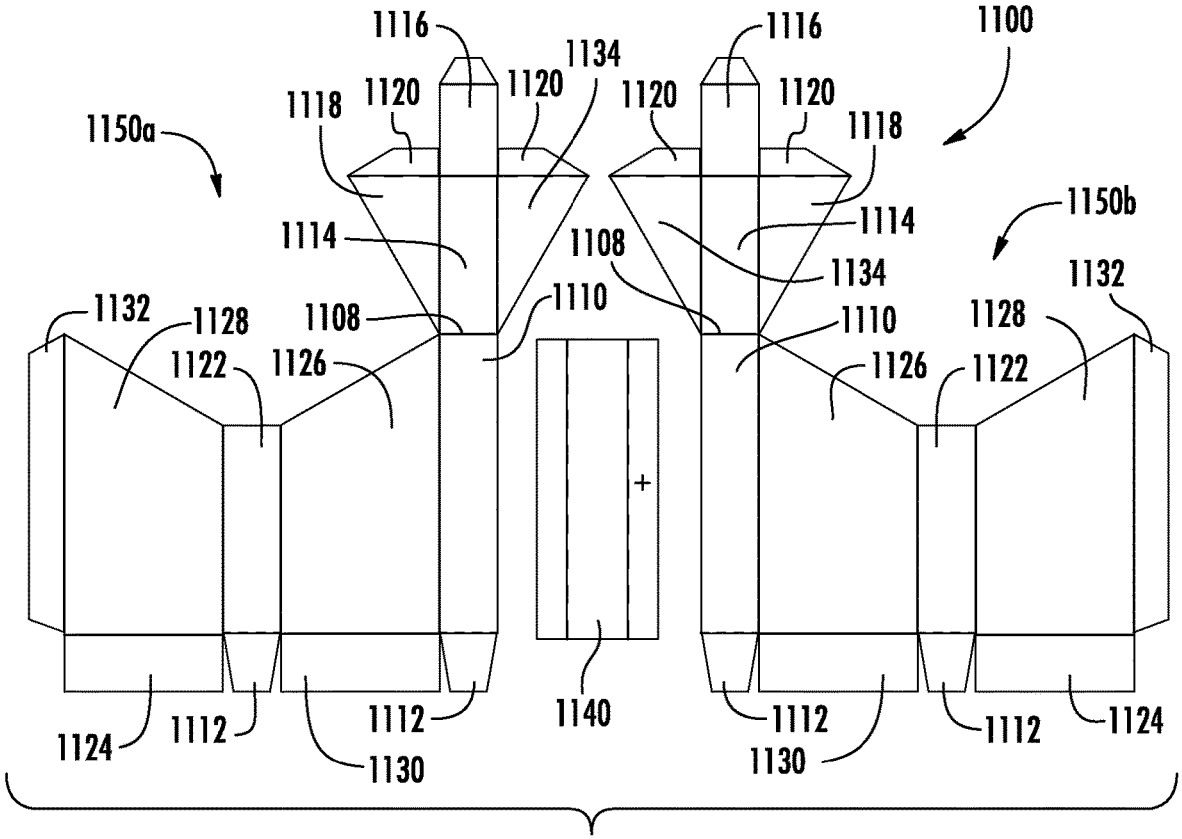
FIG. 35 is a top plan view of a blank used for the package of FIG. 34.

FIGS. 34-35 show an additional embodiment of a box 1102 of a cigarette package 1100. The box 1102 and its features may be similar to the other boxes described herein, and any disclosure herein may be applied similarly to the box 1102. In particular, the box 1102 may be similar to the box 1002. Like box 1002, the box 1102 includes two box sections 1150*a* and 1150*b* that are coupled together by a connecting portion 1140 at a rear wall of each of the box sections 1150*a-b* (e.g., a base rear wall 1110). The box sections 1150*a-b* are configured to move relative to each other via the connecting portion 1140 between a closed and an open position.

Each of the box sections 1150*a-b* includes a lid 1104 and a base 1106. The lid 1104 includes a lid top wall 1114 a lid front wall 1116, and lid side walls 1118 and 1134. The lid side walls 1118 and 1134 each include lid front tabs 1120 coupled thereto. When the lid 1104 is in folded form, an outer surface of the lid front tabs 1120 may be coupled to an inner surface of the lid front wall 1116 to form the lid 1104. The base 1106 includes a base front wall 1122, a base bottom wall 1124, a base rear wall 1110, and base side walls 1126 and 1128. A base rear tab 1112 is coupled to the base side wall 1128. When the base 1106 is in folded form, an outer surface of the base rear tab 1112 may be coupled to an inner surface of the base rear wall 1110 to form the base 1106.

Unlike the lid 1004 of package 1000, the lid 1104 does not include a lid rear wall. Instead, the lid top wall 1114 is directly coupled to the base rear wall 1110. The base rear wall 1110 extends to the lid top wall 1114, rather than ending at a lid rear wall (as is shown in package 1000). Thus, the height of the base rear wall 1110 relative to the base front wall 1122 (e.g., the difference in height between the two walls) may be greater than that of the similar features of the package 1000. Likewise, the angle of a top portion of the base side walls 1126 and 1128, as well as a bottom portion of the lid side walls 1118 and 1134, may be greater than that of similar features of package 1000. A hinge portion 1108 is formed between the base rear wall 1110 and the lid top wall 1114. The lid 1104 is pivotable about the hinge portion 1108 between open and closed positions. In an exemplary embodiment, the lid 1104 may be pivoted to an open position when the box sections 1150*a-b* are in a closed or open position.

Except for the configuration of the lid 1104, the box 1102 may be substantially similar to the box 1002. Like the box 1002, the walls of the box 1102 may be utilized to display information to a user of the package 1100. When the box sections 1050*a-b* are in the closed position, the information display area includes the exposed (e.g., visible) outer surfaces of the box sections 1150*a-b*, including outer surfaces of the side walls (e.g., the base side walls 1126, the lid side walls 1118), the front walls (e.g., the base front walls 1122, the lid front walls 1116), and the rear walls (e.g., the base rear walls 1110). In the open position, additional display surfaces of the box 1102 are revealed, including outer surfaces provided on inner walls of the box sections 1150*a-b* (e.g., the first base side walls 1128, the lid side walls 1134). When the box sections 1150*a-b* are in the closed position, inner walls of the box sections 1150*a-b* (e.g., first base side walls 1128, lid side walls 1134) may engage with each other. The box sections 1150*a-b* may be detached from each other to pivot the box sections 1150*a-b* to the open position. In some embodiments, the inner walls of the box sections 1150*a-b* may be re-engaged to each other by pivoting the box sections 1150*a-b* to the closed position.

Figure 36:
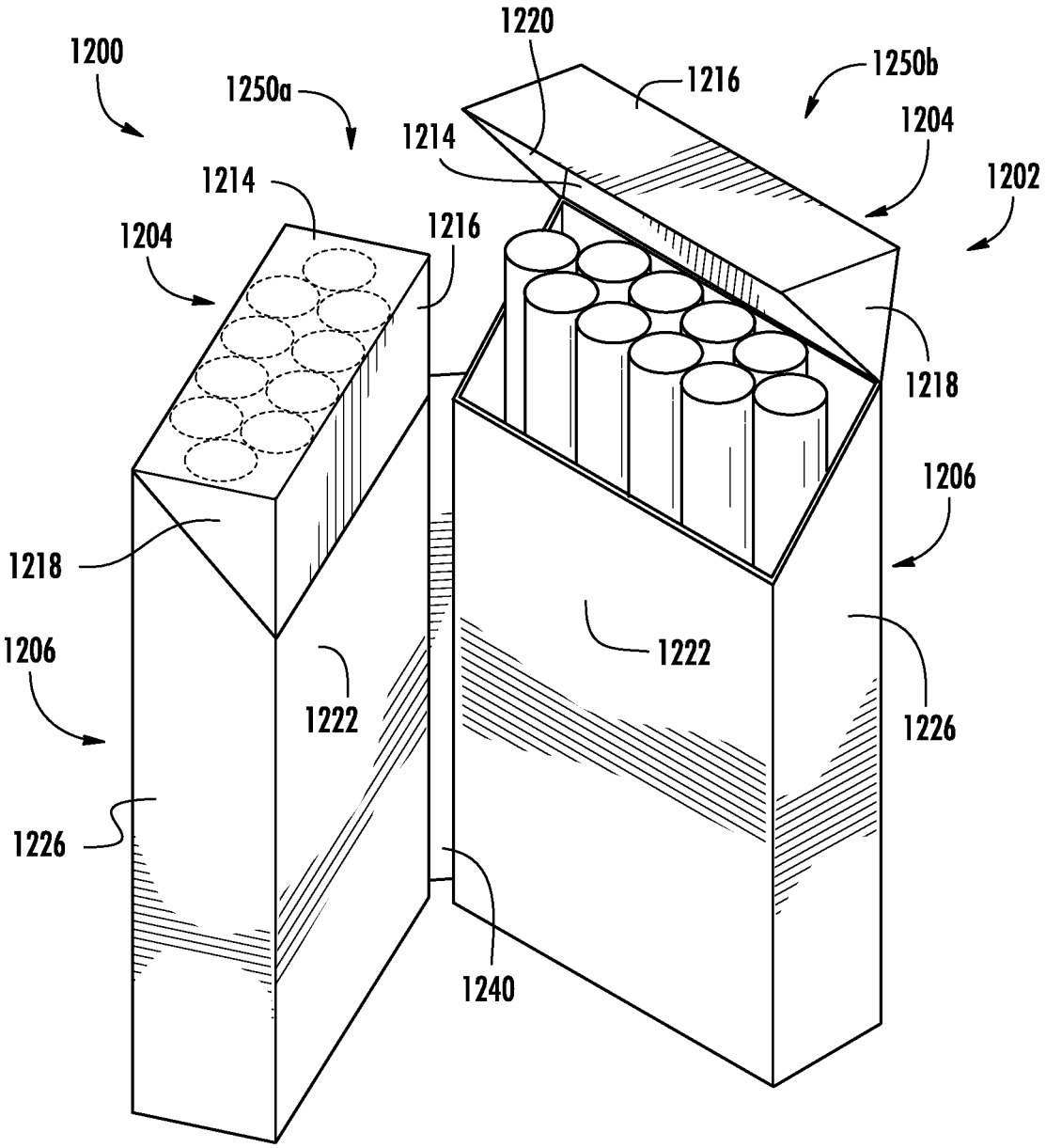
FIG. 36 is a perspective view of another package having a bi-fold configuration and a pair of lids, with one of the lids being shown in an open position and a base of the package being shown in a partially extended, or open, position, according to an exemplary embodiment.
Figure 37:
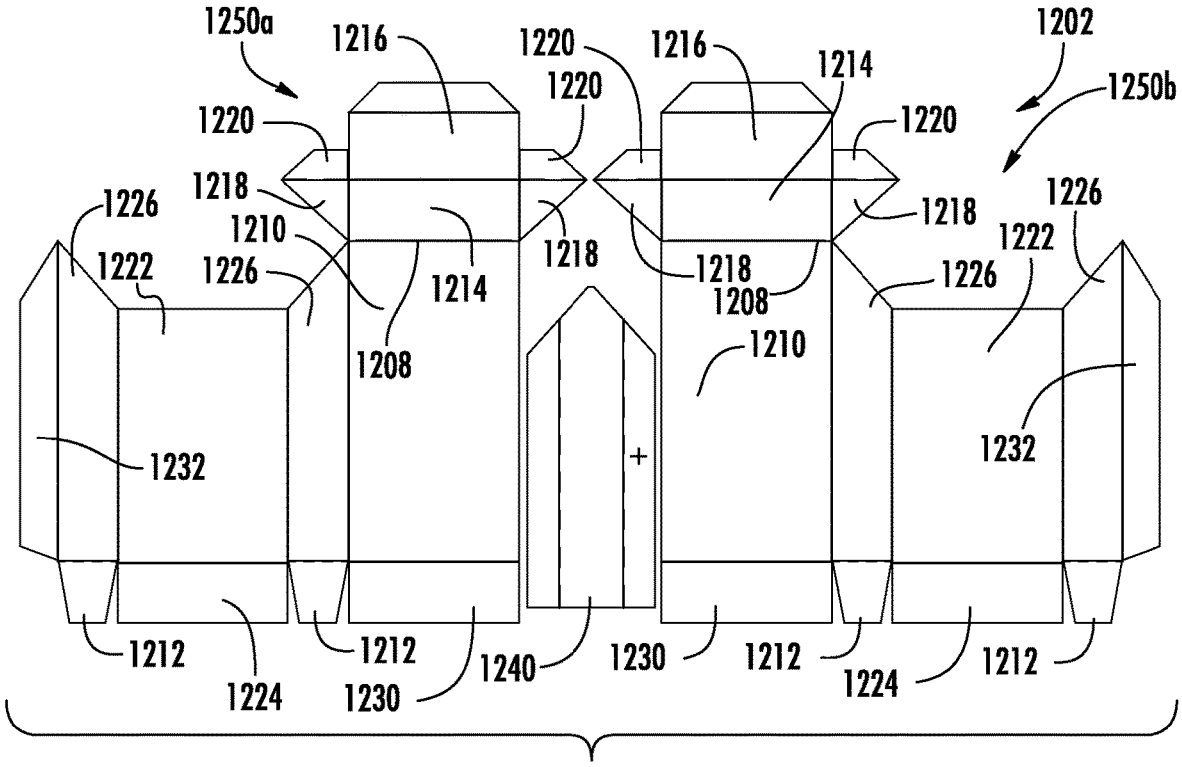
FIG. 37 is a top plan view of a blank used for the package of FIG. 36.

FIGS. 36-37 show an additional embodiment of a box 1202 of a cigarette package 1200. The box 1202 and its features may be similar to the other boxes described herein, and any disclosure herein may be applied similarly to the box 1202. In particular, the box 1202 may be similar to the boxes 1002 and 1102. The box 1202 includes two box sections 1250*a* and 1250*b* that are coupled together by a connecting portion 1240 at a side wall of each of the box sections 1250*a-b* (e.g., a base side wall 1226). Similar to the box sections 1050*a-b* and 1150*a-b*, the box sections 1250*a-b* are configured to move relative to each other via the connecting portion 1240 between a box closed (e.g., compact) position and a box open (e.g., extended) position.

Each of the box sections 1250*a-b* includes a lid 1204 and a base 1206. The lid 1204 includes a lid top wall 1214, a lid front wall 1216, and lid side walls 1218. The lid side walls 1218 each include lid front tabs 1220 coupled thereto. When the lid 1204 is in folded form, an outer surface of the lid front tabs 1220 may be coupled to an inner surface of the lid front wall 1216 to form the lid 1204. The base 1206 includes a base front wall 1222, a base bottom wall 1224, a base rear wall 1210, and base side walls 1226. A base rear tab 1212 is coupled to one of the base side walls 1226. When the base 1206 is in folded form, an outer surface of the base rear tab 1212 may be coupled to an inner surface of the base rear wall 1210 to form the base 1206.

Similar to the lid 1104, the lid 1204 does not include a rear wall. Thus, a hinge portion 1208 is formed between the base rear wall 1210 and the lid top wall 1214. The lid 1204 is pivotable about the hinge portion 1208 between open and closed positions.

Unlike the connecting portions 1040 and 1140, the connecting portion 1240 connects the box sections 1250*a-b* at a side wall of each of the box sections 1250*a-b* (e.g., a base side wall 1226). Thus, the information display area (i.e., the exposed outer surfaces) of the box 1202 when the box sections 1250*a-b* are in the open or closed position may be different than the display area of the boxes 1002-1102 in similar positions. When the box sections 1250*a-b* are in the closed position, the information display area includes outer surfaces of the side walls (e.g., base side walls 1226, lid side walls 1218), the top walls (e.g., lid top walls 1214), and the rear walls (e.g., the base rear walls 1210) of the box sections 1250*a-b*. These surfaces may be visible when the package 1200 is sealed (e.g., prior to purchase). When the box sections 1250*a-b* are in an open position, additional display surfaces of the box 1202 are revealed. The additional display surfaces include outer surfaces provided on front (e.g., inner) walls of the box sections 1250*a-b* (e.g., the base front walls 1222, the lid front walls 1216). These additional display surfaces may not be visible until the package 1200 is opened (e.g., the seal of the package 1200 is broken), enabling the box sections 1250*a-b* to be pivoted to the open position.

When the box sections 1250*a-b* are in the closed position, the base front walls 1222 and the lid front walls 1216 of each of the respective box sections 1250*a-b* may engage with each other. For instance, a temporary (e.g., removable, re-useable, etc.) adhesive or other fastener may be used to removably couple the base front walls 1222 and/or the lid front walls 1216 to each other. In these embodiments, the box sections 1250*a-b* (e.g., the base front walls 1222, the lid front walls 1216) may be detached from each other to pivot the box sections 1250*a-b* to the open position. In some embodiments, the front walls of the box sections 1250*a-b* may be re-engaged to each other by pivoting the box sections 1250*a-b* to the closed position. In an exemplary embodiment, the lid 1204 is pivotable to a lid open position only when the box sections 1250*a-b* are in an open position. For instance, the configuration of the box sections 1250*a-b* (e.g., the front walls of the lid 1204 being engaged or otherwise interfacing) may prevent the lid 1204 from being pivoted about the hinge portion 1208 when the box sections 1250*a-b* are in the closed position. Thus, a user of the package 1200 may be required to view the additional display surfaces (i.e., the base front walls 1222, the lid front walls 1216) in order to access the product.

Figure 38:
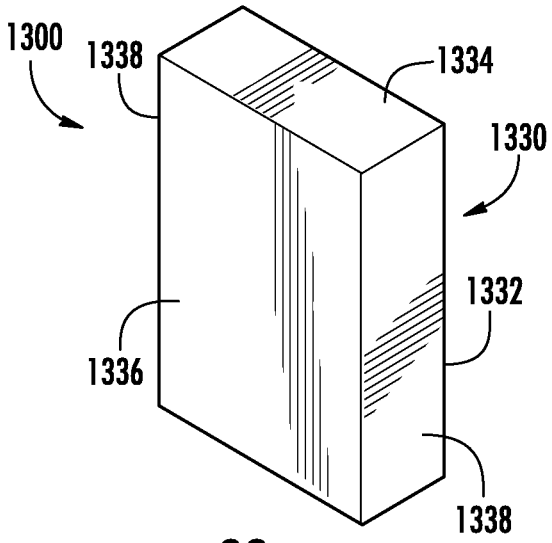
FIG. 38 is a perspective view of a package having an outer case, according to an exemplary embodiment.
Figure 39:
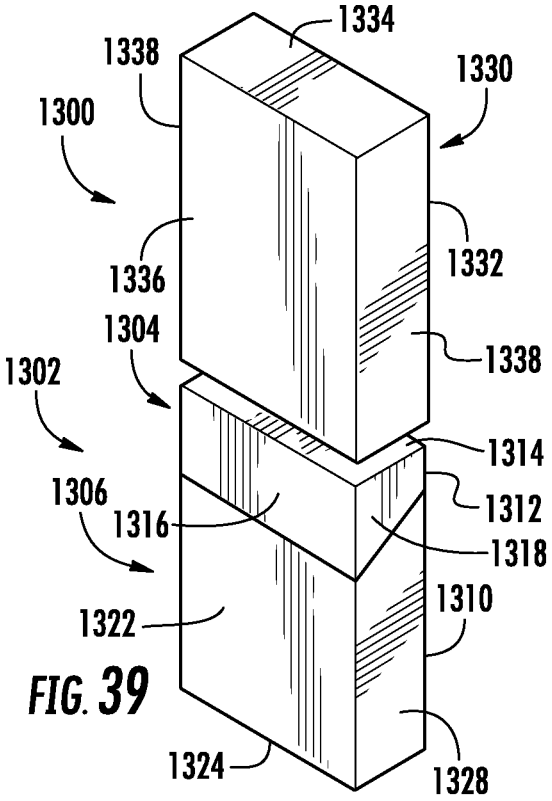
FIG. 39 is an exploded perspective view of the package of FIG. 38.

FIGS. 38-39 show an additional embodiment of a cigarette package 1300. The cigarette package 1300 includes a box 1302 and a cover 1330 (e.g., outer case). The box 1302 may be similar to the box 102 shown in FIG. 1. The box 1302 includes a lid 1304 and a base 1306. The lid 1304 includes a lid top wall 1314, a lid rear wall 1312, and a lid front wall 1316. The lid 1304 also includes lid side tabs 1318 coupled to the lid front wall 1316 to form side walls of the lid 1304. The base 1306 includes a base front wall 1322, a base bottom wall 1324, and a base rear wall 1310. The base 1306 also includes base side tabs 1328 forming side walls of the base 1306. A hinge portion may be formed between the base rear wall 1310 and the lid rear wall 1312, and the lid 1304 may be configured to pivot about an axis formed by the hinge portion between open and closed positions.

The cover 1330 is configured to receive the box 1302. As shown in FIG. 38, the cover 1330 is sized and shaped to fit entirely over the box 1302, covering any surfaces of the box 1302. The cover 1330 includes a cover rear wall 1332, a cover top wall 1334, a cover front wall 1336, and cover side walls 1338. An opening is provided at a bottom portion of the cover 1330 and is configured to receive a top portion of the box 1302. The walls of the cover 1330 may be sized according to corresponding walls of the box 1302. For instance, the walls of the cover 1330 may be similar in shape to, but slightly larger than, the walls of the box 1302 in order to receive the box 1302 entirely. The inner surfaces of any of the walls 1332-1338 may engage corresponding outer surfaces of the walls of the box 1302 when the box 1302 is received. As an example, a temporary adhesive may be used to temporarily couple the cover 1330 and the box 1302. The box 1302 may also be held within the cover 1330 by a plastic seal or other covering intended to seal the product within the package 1300.

The cover 1330 provides additional exterior surfaces for the package 1300. Each of the exterior (i.e., outer) surfaces of walls 1332-1338 may be utilized to display information related to the package 1300, including advertising and product identifying information. Information that is displayed on the cover 1330 may be visible when the package 1300 is sealed, including when the package 1300 is displayed for sale. When the cover 1330 is removed, such as by a buyer of the package 1300, the outer surfaces of the box 1302 are revealed (as shown in FIG. 39). The outer surfaces of the box 1302 may also be used to display information. The information may be similar to the information displayed on the cover 1330, or the information may be tailored to appeal to an expected viewer of the box 1302. For instance, the information provided on the box 1302 may be intended for an end user of the product. The display area that is provided by the package 1300, including the box 1302 and the cover 1330, may be approximately double the display area that is provided by the box 1302 alone.

Figure 40:
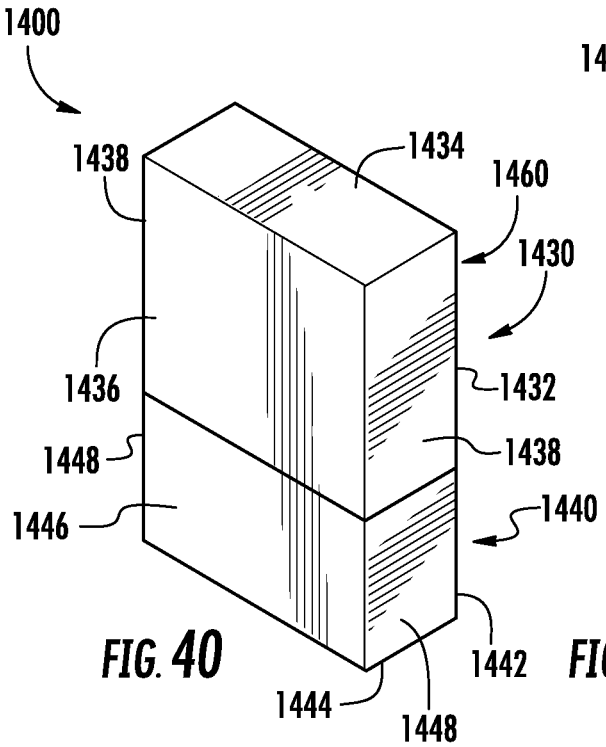
FIG. 40 is a perspective view of a package having a two-piece outer case, according to an exemplary embodiment.
Figure 41:
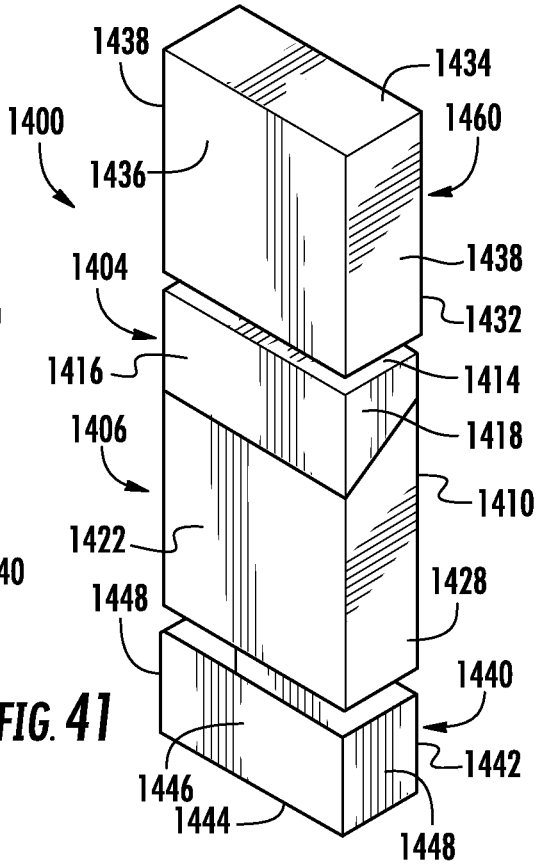
FIG. 41 is an exploded perspective view of the package of FIG. 40.
Figure 42:
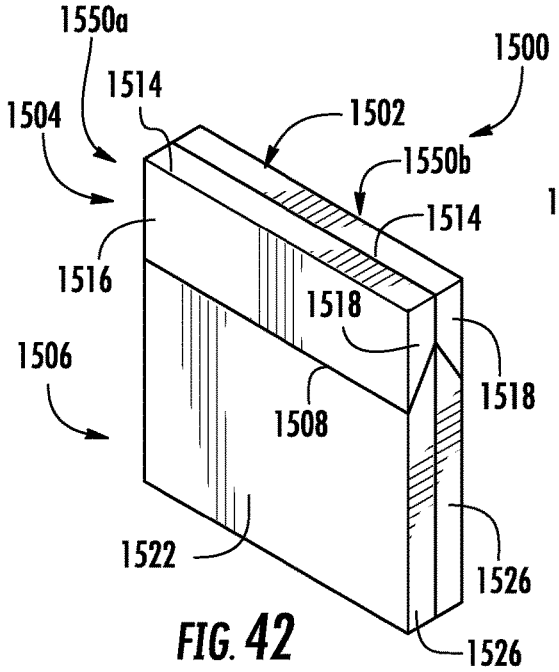
FIG. 42 is a perspective view of another package having a bi-fold configuration and a pair of lids, the package being shown in a closed, or compact, position, according to an exemplary embodiment.
Figure 43:
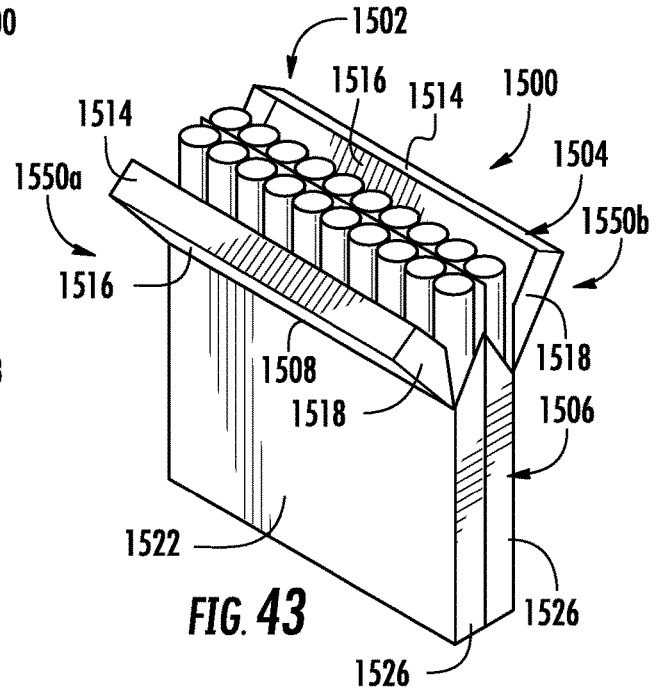
FIG. 43 is another perspective view of the package of FIG. 42, with both of the lids being shown in an open position.

FIGS. 40-41 show an additional embodiment of a cigarette package 1400. The package 1400 is similar to the package 1300 shown in FIGS. 38 and 39. The cigarette package 1400 includes a box 1402 and a cover 1430. The box 1402 is substantially similar to the box 1302. Disclosure herein relating to the box 1302 may be applied similarly to the box 1402, including any disclosure of similarly numbered features.

The cover 1430 is similar to the cover 1330, except that the cover 1430 is split into two sections. A first (e.g., top) section 1460 of the cover 1430 includes a first cover rear wall 1432, a first cover top wall 1434, a first cover front wall 1436, and first cover side walls 1438. An opening is provided at a bottom portion of the first section 1460 to receive a top portion of the box 1402. A second (e.g., bottom) section 1440 of the cover 1430 includes a second cover rear wall 1442, a second cover bottom wall 1444, a second cover front wall 1446, and second cover side walls 1448. An opening is provided at a top portion of the second section 1440 to receive a bottom portion of the box 1402. When the sections 1440 and 1460 are fitted over the box 1402 (as shown in FIG. 40), a bottom portion of the walls 1432, 1436, 1438 are configured to engage a top portion of the walls 1442, 1446, 1448. The cover 1430 provides additional display surfaces for the package 1400, as is described above in relation to the cover 1330. Adjacent outer surfaces of the sections 1440 and 1460 may be utilized in combination to provide display areas substantially similar to those of the package 1300. The outer surfaces of the cover 1430 may be visible when the package 1400 is sealed, while the outer surfaces of the box 1402 may be visible when the package 1400 is opened (e.g., by a purchaser of the package 1400).

FIGS. 42-45 show an additional embodiment of a box 1502 of a cigarette package 1500. The box 1502 and its features may be similar to the other boxes described herein, and any disclosure herein may be applied similarly to the box 1502. In particular, the box 1502 may be similar to the boxes 1002-1202 shown in FIGS. 29-37. The box 1502 includes two box sections 1550*a* and 1550*b*. A hinge portion 1540 is formed between side walls (e.g., base side walls 1526) of the two box sections 1550*a-b*. The box sections 1550*a-b* are pivotable about the hinge portion 1540 and relative to each other between a closed (e.g., compact) position (shown in FIGS. 42-43) and an open (e.g., extended) position (shown by way of example in FIG. 44).

Each of the box sections 1550*a-b* includes a lid 1504 and a base 1506. The lid 1504 includes a lid top wall 1514, a lid front wall 1516, and lid side walls 1518. The lid side walls 1518 each include lid top tabs 1520 coupled thereto. When the lid 1504 is in folded form, an outer surface of the lid front tabs 1520 may be coupled to an inner surface of the lid top wall 1514 to form the lid 1504. The base 1506 includes a base front wall 1522, a base bottom wall 1524, a base rear wall 1510, and base side walls 1526. Base bottom tabs 1512 are coupled to the base side walls 1526. When the base 1506 is in folded form, an outer surface of the base bottom tabs 1512 may be coupled to an inner surface of the base bottom walls 1524 to form the base 1506. Similar to the lids 1104 and 1204, the lid 1504 does not include a rear wall. Instead, a hinge portion 1508 is formed between the base front wall 1522 and the lid front wall 1516. The lid 1504 is pivotable about the hinge portion 1508 between an open position (shown by way of example in FIGS. 43 and 44) and a closed position (shown in FIG. 42).

Figure 44:
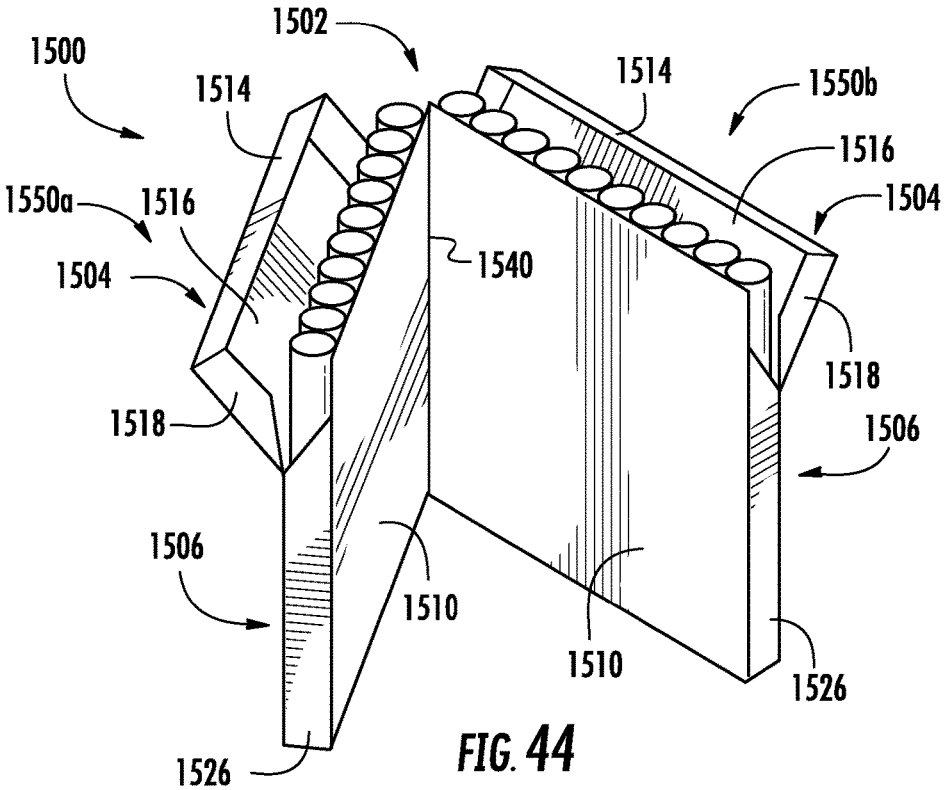
FIG. 44 is another perspective view of the package of FIG. 42, with both of the lids being shown in an open position and the package being shown in an extended, or open, position.
Figure 45:
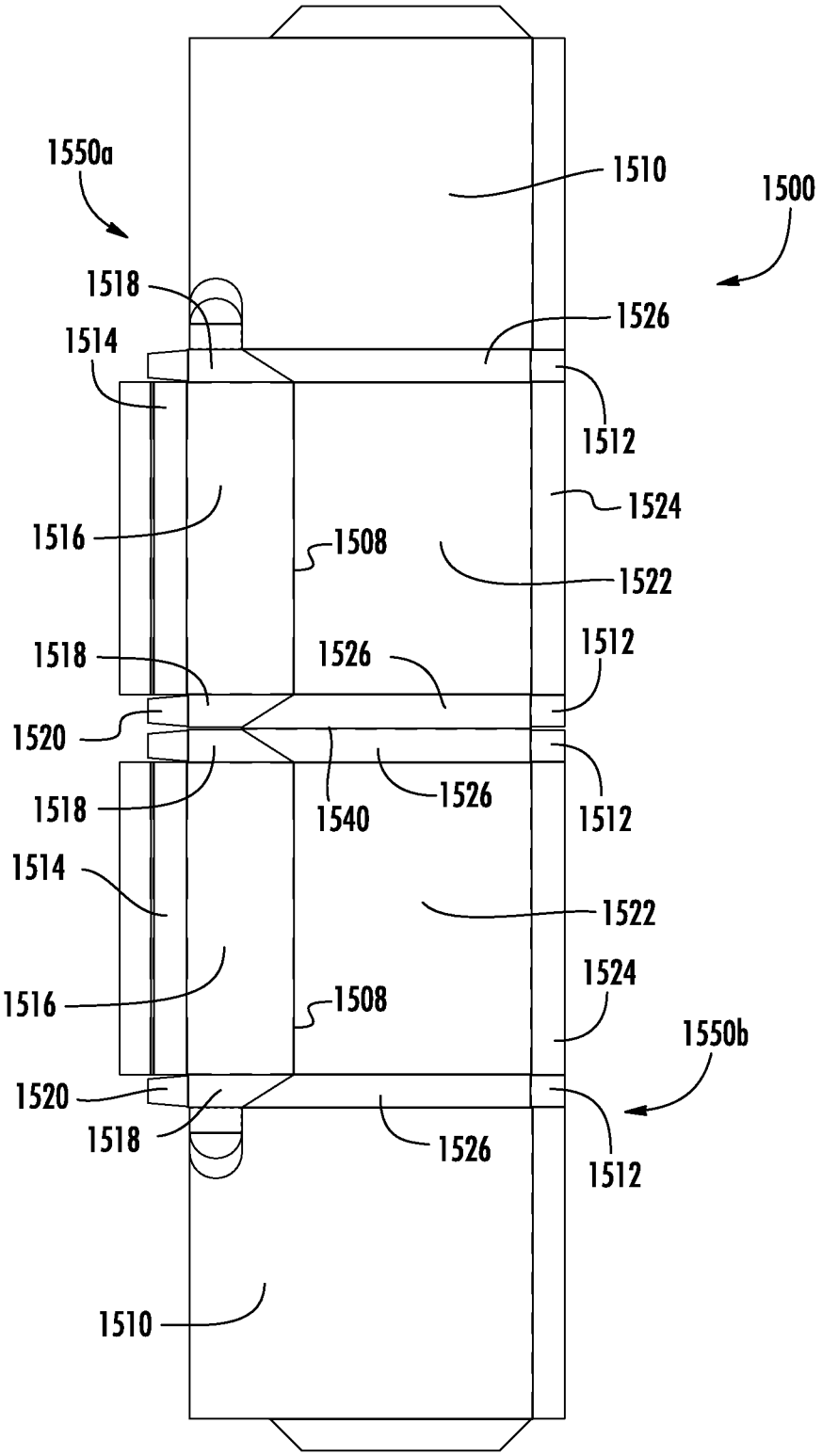
FIG. 45 is a top plan view of a blank used for the package of FIG. 42.

When the box sections 1550*a-b* are in the closed position, the information display area includes outer surfaces of the side walls (e.g., base side walls 1526, lid side walls 1518), the top walls (e.g., lid top walls 1514), and the front walls (e.g., the base front walls 1522, the lid front walls 1516) of the box sections 1550*a-b*. These surfaces may be visible when the package 1500 is sealed (e.g., prior to purchase). When the box sections 1550*a-b* are pivoted away from each other to an open position (as shown in FIG. 44), additional display surfaces of the box 1502 are revealed. The additional display surfaces include outer surfaces provided on rear (e.g., inner) walls of the box sections 1550*a-b* (e.g., the base rear walls 1510). These additional display surfaces may not be visible until the package 1500 is opened (e.g., the seal of the package 1500 is broken), enabling the box sections 1550*a-b* to be pivoted to the open position.

When the box sections 1550*a-b* are in the closed position, the base rear walls 1510 of each of the respective box sections 1550*a-b* may engage with each other. For instance, a temporary (e.g., removable, re-useable, etc.) adhesive or other fastener may be used to removably couple the base rear walls 1510 to each other. In these embodiments, the box sections 1550*a-b* (e.g., the base rear walls 1510) may be detached from each other to pivot the box sections 1550*a-b* to the open position. In some embodiments, the front walls of the box sections 1550*a-b* may be re-engaged to each other by pivoting the box sections 1550*a-b* to the closed position. In an exemplary embodiment, the lid 1504 is pivotable to a lid open position when the box sections 1550*a-b* are in either of its open and closed positions.

Figure 46:
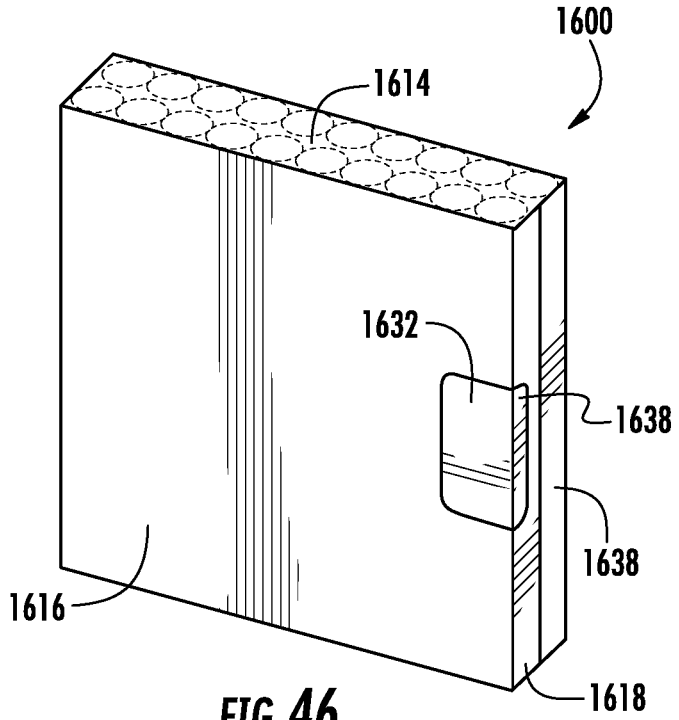
FIG. 46 is a perspective view of a package having a telescopic configuration and shown in a closed, or compact, position, according to an exemplary embodiment.
Figure 47:
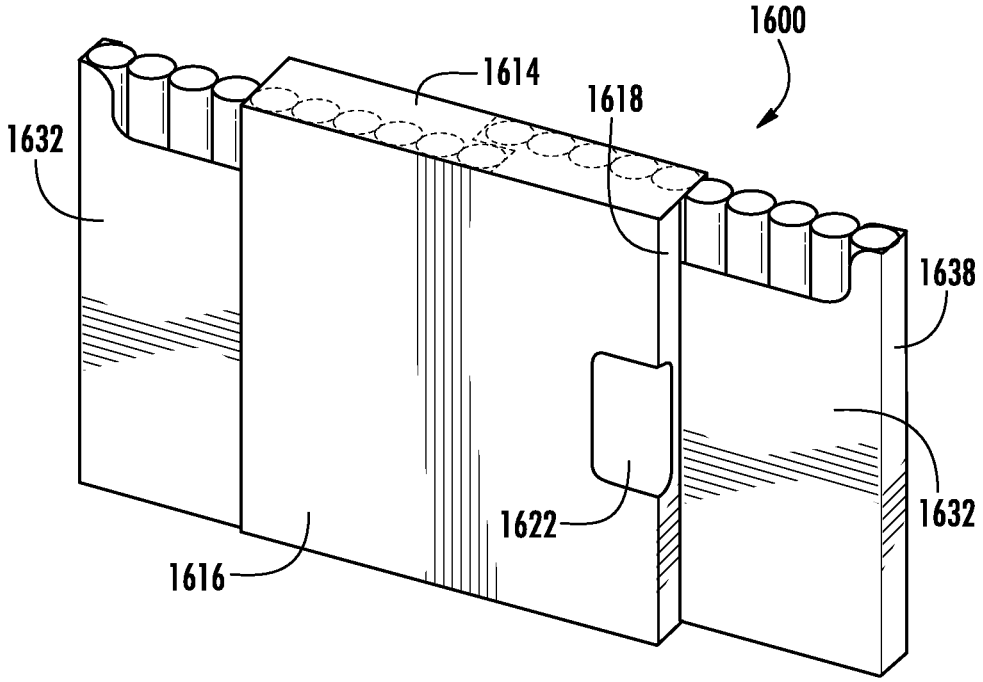
FIG. 47 is another perspective view of the package of FIG. 46, with the package being shown in an extended, or open, position.
Figure 48:
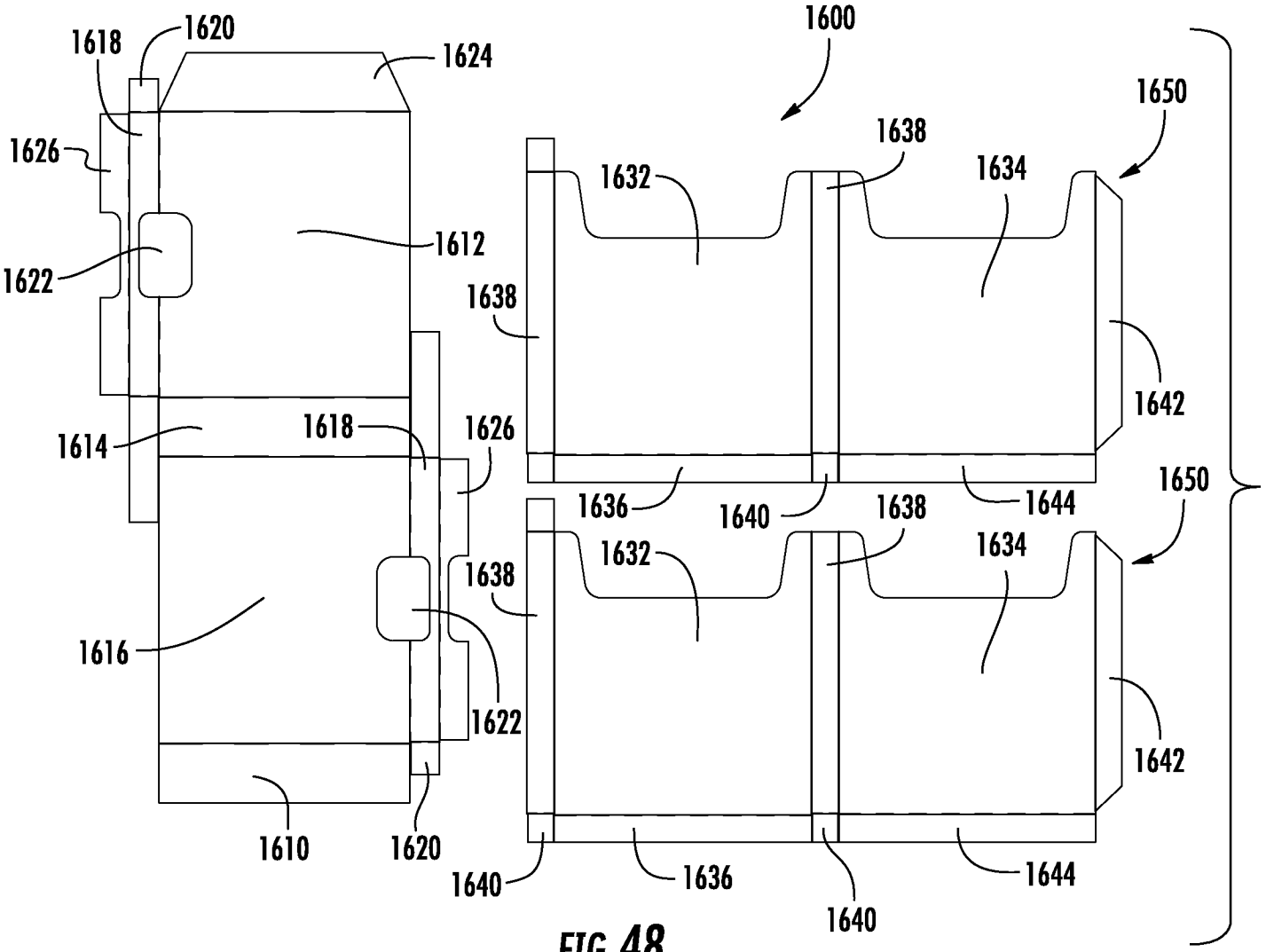
FIG. 48 is a top plan view of a blank used for the package of FIG. 46.

FIGS. 46-48 show an additional embodiment of a cigarette package 1600. The box 1602 and its features may be similar to the other boxes described herein, and any disclosure herein may be applied similarly to the box 1602. The box 1602 includes an outer case 1604 and two inserts 1650 configured to fit within the outer case 1604. In an exemplary embodiment, each of the inserts 1650 is utilized to store approximately half of the product that is provided by the package 1600. The inserts 1650 may be substantially symmetrical and identical to each other. The inserts 1650 are configured to move (e.g., slide, glide, etc.) in a telescopic manner relative to the outer case 1604 between a closed position (shown in FIG. 46) in which the inserts 1650 are positioned substantially within the outer case 1604, and an open position (shown by way of example in FIG. 47) in which the inserts 1650 at least partially extend from the outer case 1604.

The outer case 1604 includes a case top wall 1614, a case rear wall 1612, a case front wall 1616, a case bottom wall 1610, and case side walls 1618. The case side walls 1618 include case bottom tabs 1620 and case side tabs 1626 coupled thereto, and the case rear wall 1612 includes a case bottom tab 1624 coupled thereto. When the outer case 1604 is in folded form (as shown in FIGS. 46 and 47), the case bottom tabs 1620 and the case bottom tab 1624 may be coupled to the case bottom wall 1610 to form and/or stabilize a bottom wall of the box 1602.

Each of the inserts 1650 includes an insert front wall 1632, an insert rear wall 1634, and insert side walls 1638. The insert side walls 1638 each include insert bottom tabs 1640 coupled thereto. The insert front wall 1632 includes an insert bottom tab 1636 coupled thereto, and the insert rear wall 1634 includes a similar insert bottom tab 1644 coupled thereto. When the insert 1650 is in folded form (as shown in FIG. 47), the insert bottom tabs 1636, 1640, and 1644 are coupled to form the bottom wall of the insert 1650. The insert rear wall 1634 also includes an insert side tab 1642 coupled thereto. When the insert 1650 is in the folded form, the insert side tab 1642 may be coupled to the insert side wall 1638. The insert front wall 1632 and the insert rear wall 1634 each include a cutout at a top portion of the walls 1632 and 1634. The cutout is configured to provide access to the product stored within the insert 1650.

The outer case 1604 also includes openings 1622 (e.g., holes, cutout portions, access areas) formed on opposite sides (e.g., at the front and back) of the outer case 1604. A first of the openings 1622 is positioned between the case front wall 1616 and the adjacent case side wall 1618, spanning at least a portion of both the case front wall 1616 and the case side wall 1618. A second of the openings 1622 similarly is positioned between and within the case rear wall 1612 and the adjacent case side wall 1618. As shown in FIG. 46, when the inserts 1650 are in the closed position relative to the outer case 1604, a portion of the inserts 1650 (e.g., the insert front wall 1632, the insert side wall 1638) may be visible through the openings 1622 of the outer case 1604. The openings 1622 are configured to enable a user of the package 1600 to move the inserts 1650 to an open position (e.g., to access the product) by contacting the inserts 1650 through the openings 1622. The case side walls 1618 provide a stop for the inserts 1650 when the inserts 1650 are returned to the closed position relative to the outer case 1604.

When the inserts 1650 are in the closed position relative to the outer case 1604 (as shown in FIG. 46), the information display area for the box 1602 includes outer surfaces of the outer case 1604, including outer surfaces of the case top wall 1614, the case rear wall 1612, the case front wall 1616, the case bottom wall 1610, and the case side walls 1618. Outer surfaces of the insert side walls 1638 and a portion of the insert front wall 1632 may also be visible. These surfaces may be visible when the package 1600 is sealed (e.g., prior to purchase). When the inserts 1650 are moved to an open position (e.g., shown in FIG. 47), additional display surfaces of the box 1602 are revealed. The additional display surfaces include outer surfaces provided on the inserts 1650, including outer surfaces of the insert front wall 1632, the insert rear wall 1634, and the insert bottom wall (e.g., bottom tabs 1636 and/or 1644). These additional display surfaces may not be visible until the package 1600 is opened (e.g., the seal of the package 1600 is broken), enabling the inserts 1650 to be moved to an open position.

FIGS. 49-52 show an additional embodiment of a box 1702 of a cigarette package 1700. The box 1702 and its features may be similar to the other boxes described herein, and any disclosure herein may be applied similarly to the box 1702. In particular, the box 1702 may be similar to the box 1602. Similar to the box 1602, the box 1702 includes an outer case 1704 and inserts 1750 configured to fit within the outer case 1704. The box 1702 includes four inserts 1750. In an exemplary embodiment, each of the inserts 1750 is utilized to store approximately one quarter of the product that is provided by the package 1700. The inserts 1750 may be substantially similar to each other. The inserts 1750 have a pinwheel configuration relative to the outer case 1704. The inserts 1750 are configured to rotate relative to each other and the outer case 1704 between a closed position (shown in FIG. 49) in which the inserts 1750 are positioned substantially within the outer case 1704, and an open position (shown by way of example in FIGS. 50 and 51) in which the inserts 1750 are positioned at least partially outside of the outer case 1704. A pin 1760 is routed through the outer case 1704 and the inserts 1750 at a bottom portion. The pin 1760 forms an axis about which the inserts 1750 rotate.

Figure 49:
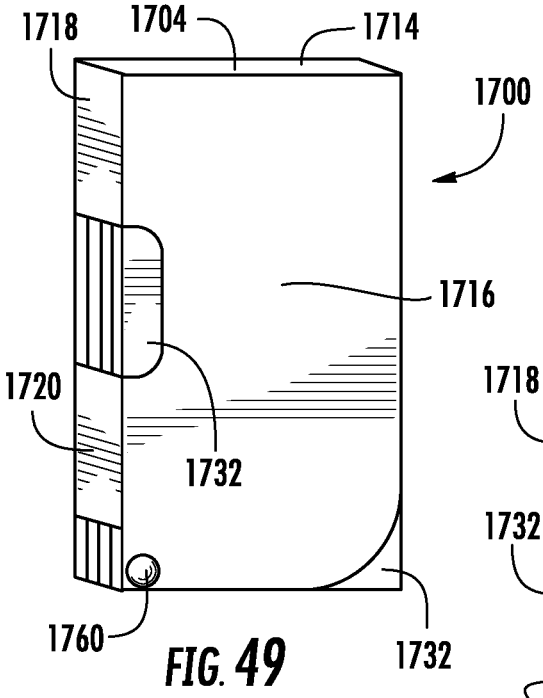
FIG. 49 is a perspective view of a package having a pinwheel configuration and shown in a closed, or compact, position, according to an exemplary embodiment.
Figure 50:
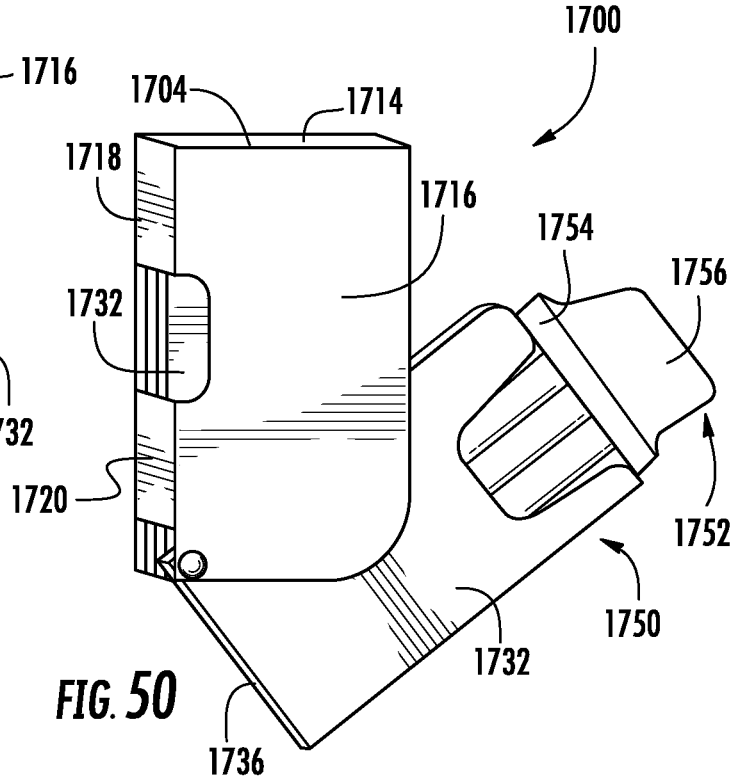
FIG. 50 is another perspective view of the package of FIG. 49, with the package being shown in an extended, or open, position.
Figure 51:
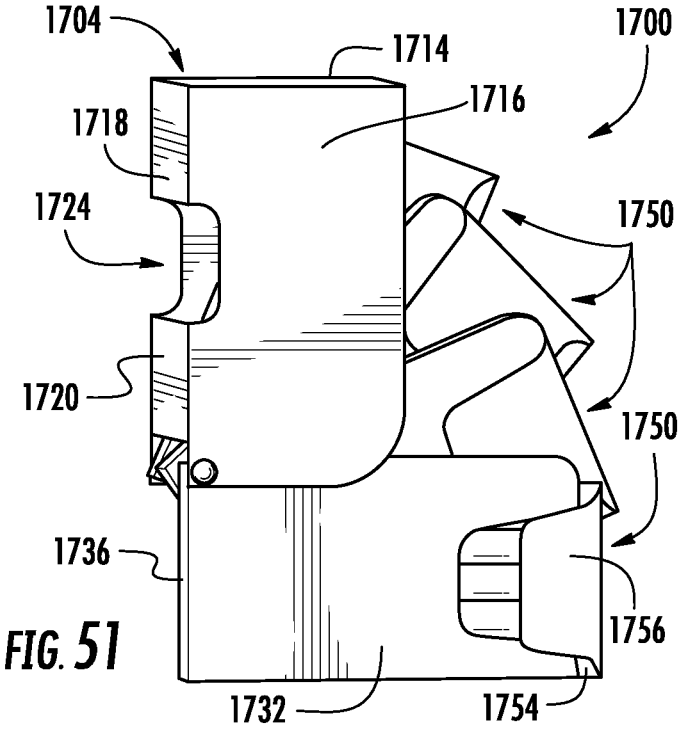
FIG. 51 is another perspective view of the package of FIG. 49, with the package being shown in another extended, or open, position.
Figure 52:
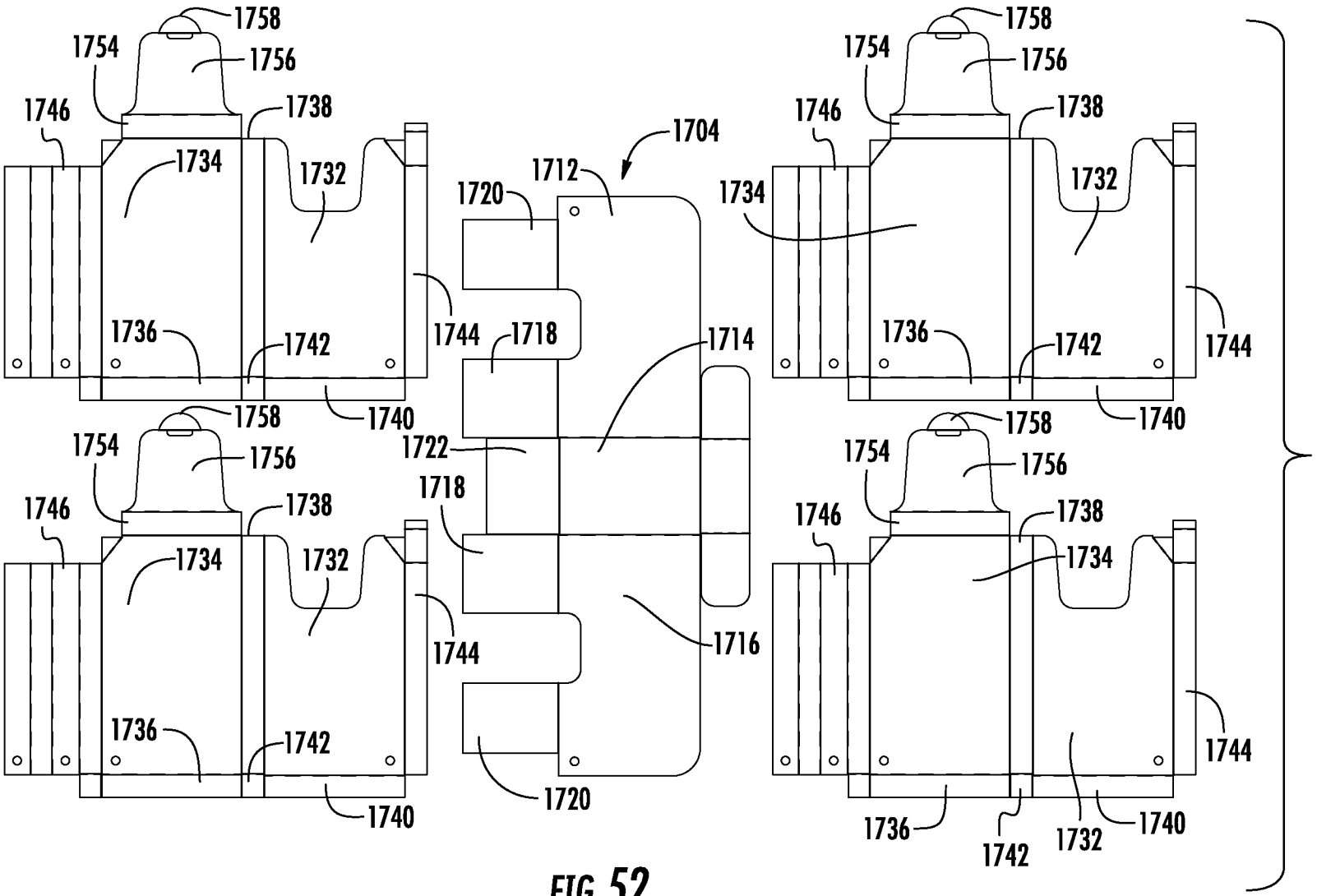
FIG. 52 is a top plan view of a blank used for the package of FIG. 49.

The outer case 1704 includes a case top wall 1714, a case rear wall 1712, and a case front wall 1716. The case front wall 1716 and the case rear wall 1712 each include a first case side tab 1718 and a second case side tab 1720 coupled thereto, and the case top wall 1714 includes a third case side tab 1722 coupled thereto. When the outer case 1704 is in folded form (as shown in FIGS. 49-51), the first case side tabs 1718 are coupled to each other and the third case side tab 1722 to form a top portion of a side wall of the outer case 1704. Likewise, the second case side tabs 1720 may be coupled to each other to form a bottom portion of the side wall. When the outer case 1704 is in folded form, the top portion and the bottom portion of the case side wall are separated by an opening 1724 formed in the outer case 1704. The bottom of the outer case 1704 and the side opposite the case side tabs 1718 and 1720 are open to allow the inserts 1750 to rotate away from the outer case 1704 to an open position.

Each of the inserts 1750 includes an insert front wall 1732, an insert rear wall 1734, an insert bottom wall 1736, a first insert side wall 1738, and a second insert side wall 1744. The first insert side wall 1738 includes an insert bottom tab 1742 coupled thereto. The insert front wall 1732 includes an insert bottom tab 1740 coupled thereto. When the insert 1750 is in folded form (as shown in FIGS. 50 and 51), the insert bottom tabs 1740 and 1742 are coupled to form the bottom wall of the insert 1750. The insert rear wall 1734 includes an insert flap 1746 (e.g., fold, tab, etc.) coupled thereto. When the insert 1750 is in folded form, the insert flap 1746 may be folded and coupled to the insert front wall 1732. The insert front wall 1732 includes a cutout at a top portion. The cutout is configured to provide access to the product stored within the inserts 1750. The insert 1750 also includes a lid 1752. The lid 1752 includes a lid top wall 1754 and a lid front wall 1756. The lid 1752 is configured to fit over the open top portion of the lid front wall 1756 to substantially cover the product within the insert 1750. The lid 1752 (e.g., the lid front wall 1756) may be configured to match a shape of the cutout portion of the insert front wall 1732 in order to substantially cover the product.

As shown in FIG. 49, when the inserts 1750 are in the closed position relative to the outer case 1704, a portion of the inserts 1750 (e.g., the insert front wall 1732, the insert side wall 1744) are visible through the opening 1724 of the outer case 1704. The opening 1724 may enable a user of the package 1700 to move the inserts 1750 to an open position (e.g., to access the product) by contacting the inserts 1750 through the opening 1724. The case side tabs 1718 and 1720 provide a stop for the inserts 1750 when the inserts 1750 are returned to the closed position relative to the outer case 1704.

When the inserts 1750 are in the closed position relative to the outer case 1704 (as shown in FIG. 49), the information display area for the box 1702 includes outer surfaces of the outer case 1704, including outer surfaces of the case top wall 1714, the case rear wall 1712, the case front wall 1716, and the case side wall (e.g., case side tabs 1718 and 1720). Outer surfaces of at least a portion of the insert side wall 1744 and the insert front wall 1732 may also be visible when the inserts 1750 are in the closed position. These surfaces may be visible when the package 1700 is sealed (e.g., prior to purchase). When the inserts 1750 are moved to an open position (e.g., shown in FIG. 51), additional display surfaces of the box 1702 are revealed. The additional display surfaces include surfaces of the insert front wall 1732, the insert rear wall 1734, the insert bottom wall 1736, the insert side walls 1738 and 1744, the lid top wall 1754, and the lid front wall 1756. These additional display surfaces may not be visible until the package 1700 is opened (e.g., the seal of the package 1700 is broken), enabling the inserts 1750 to be moved to an open position. Thus, the user of the package 1700 may be required to view the additional display surfaces in order to access the product.

Figure 53:
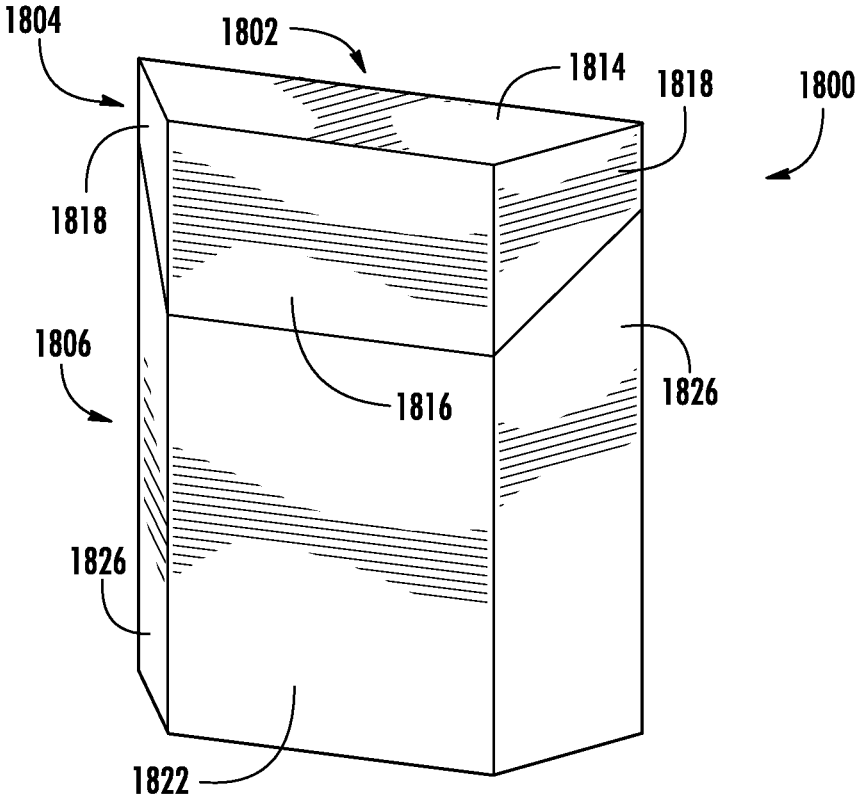
FIG. 53 is a perspective view of another package having an angled body, according to another exemplary embodiment.
Figure 54:
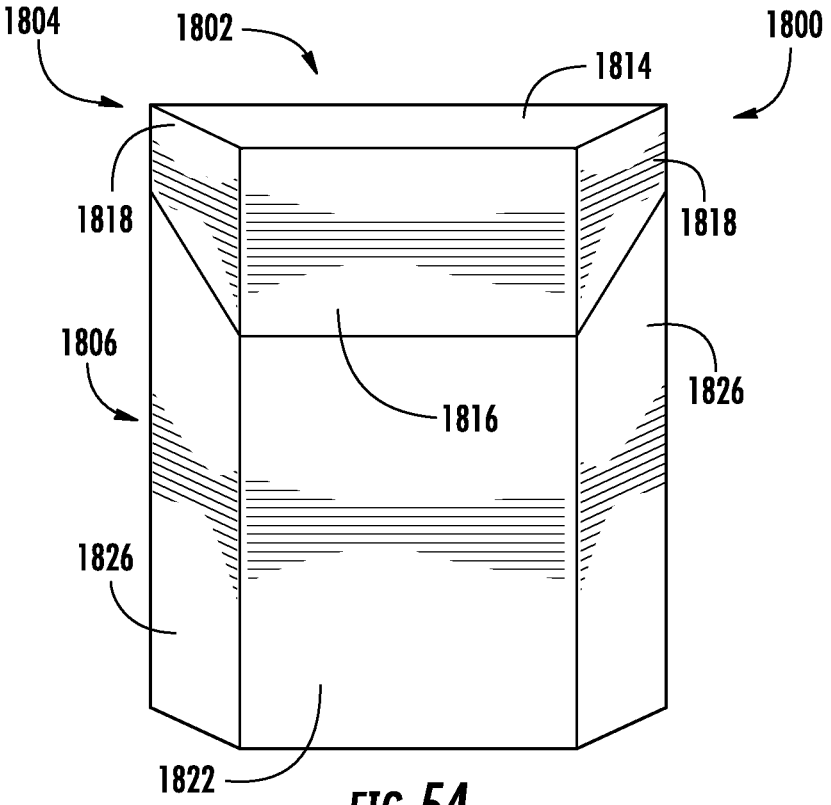
FIG. 54 is another perspective view of the package of FIG. 53.
Figure 55:
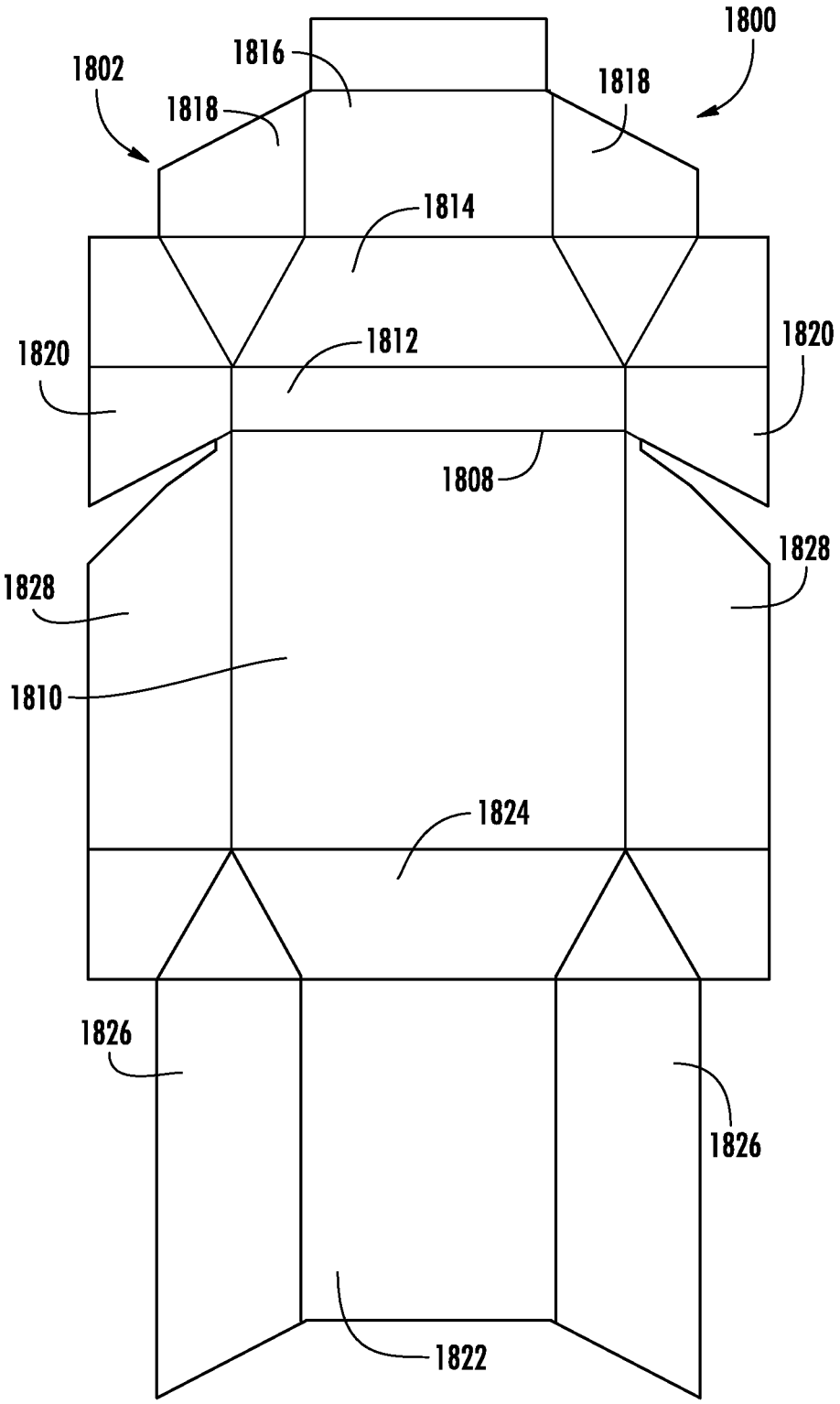
FIG. 55 is a top plan view of a blank used for the package of FIG. 53.
Figure 56:
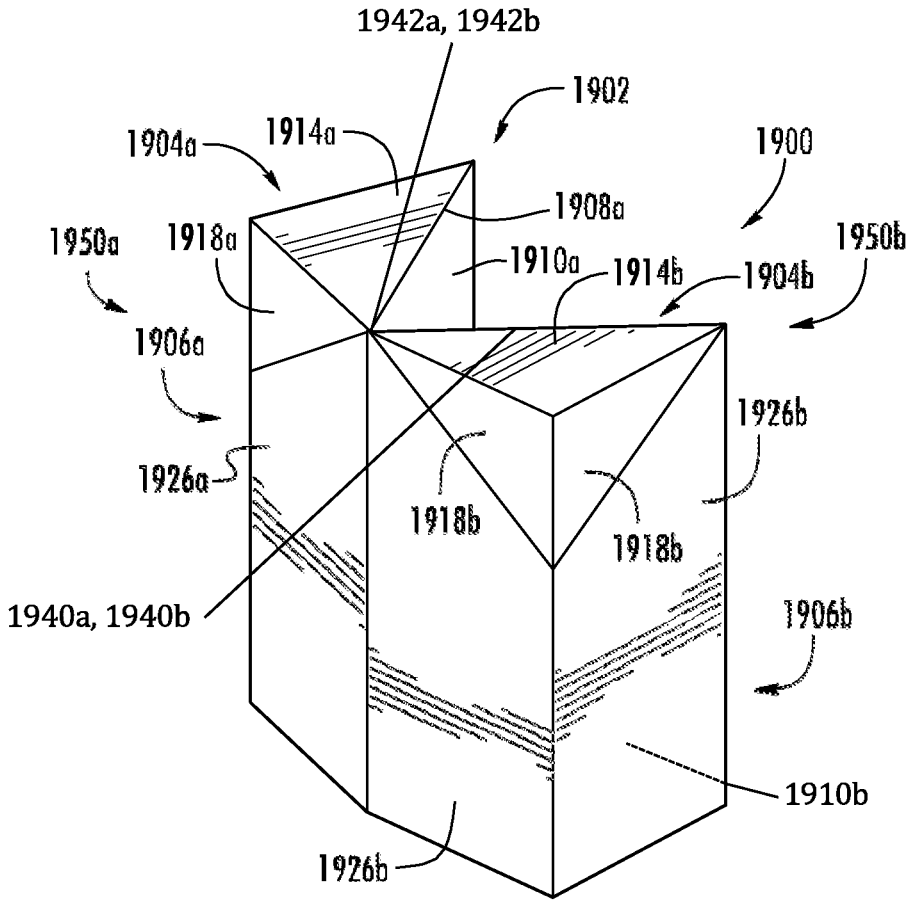
FIG. 56 is a perspective view of a package having a two-way living hinge configuration and a pair of lids, according to an exemplary embodiment.

FIGS. 53-55 show an additional embodiment of a box 1802 of a cigarette package 1800. The box 1802 and its features may be similar to the other boxes described herein, and any disclosure relating to the other boxes herein may be applied similarly to the box 1802. The box 1802 includes a lid 1804 and a base 1806. The base 1806 includes a base front wall 1822, a base bottom wall 1824, and a base rear wall 1810. The base front wall 1822 includes first base side tabs 1826 coupled thereto, and the base rear wall 1810 includes second base side tabs 1828 coupled thereto. The lid 1804 includes a lid top wall 1814, a lid rear wall 1812, and a lid front wall 1816. The lid front wall 1816 includes first lid side tabs 1818 coupled thereto, and the lid rear wall 1812 includes second lid side tabs 1820 coupled thereto. A hinge portion 1808 is formed between the lid rear wall 1812 and the base rear wall 1810. The lid 1804 is pivotable rearward relative to the base 1806 about an axis generally defined by the hinge portion 1808. Thereby, the box 1802 may be opened or closed.

As shown in FIGS. 53 and 54, the box 1802 has a trapezoidal prism shape when in folded form. In an exemplary embodiment, the base rear wall 1810 of the box 1802 is wider than the base front wall 1822. In this embodiment, the base bottom wall 1824 and the lid top wall 1814 are wider at a rear edge than at a front edge in a manner corresponding to the differing widths of the base rear wall 1810 and the base front wall 1822. The base bottom wall 1824 and the lid top wall 1814 are similar in shape in this embodiment, including having rear, front, and side edges that are similar in shape and size. In an exemplary embodiment, outer surfaces of the lid top wall 1814 and the base bottom wall 1824 form similar isosceles trapezoids. According to other exemplary embodiments, the various walls comprising the base 1806 and the lid 1804 may have any suitable size, and the relative sizes disclosed herein are not intended to be limiting.

When the lid 1804 is in folded form (shown in FIGS. 53 and 54), the first lid side tabs 1818 of the lid front wall 1816 are coupled to the second lid side tabs 1820 to form the side walls of the lid 1804. The side walls of the lid 1804 are configured to extend between the rear edge and the front edge of the lid top wall 1814. The side walls of the lid 1804 form an obtuse angle with the lid front wall 1816, such that the outer surfaces of the lid side walls (e.g., first lid side tabs 1818) are at least partially visible from a front view of the box 1802 (e.g., as shown in FIG. 54). Likewise, the first base side tabs 1826 of the base front wall 1822 are coupled to the second base side tabs 1828 to form the side walls of the base 1806. The side walls of the base 1806 are configured to extend between the rear edge and the front edge of the base bottom wall 1824. The side walls of the base 1806 form an obtuse angle with the base front wall 1822. Thus, the outer surfaces of the base side walls (e.g., the second base side tabs 1828) are at least partially visible from a front view of the box 1802.

Similar to the box 502, the box 1802 is configured to provide a greater display area that is visible from a front perspective relative to the box 1802. As shown in FIG. 54, the side walls of the box 1802 (e.g., first lid side tabs 1818, second base side tabs 1828) are angled such that their outer surfaces are at least partially visible from a front perspective (i.e., when facing the base front wall 1822). When the package 1800 is displayed for sale in a store, for instance, the front of the package 1800 may be the only area that is visible. Thus, in such a scenario, the side walls of the box 1802 provide additional display surfaces that are visible from a front-facing perspective relative to the box 1802. The additional display surfaces may be utilized to attract or inform a potential purchaser of the product (i.e., the package 1800). For instance, the side walls of the box 1802 may be utilized to provide information intended to identify the product (e.g., branding), or to advertise the product. In various embodiments, the outer surfaces of the first lid side tabs 1818 and the second base side tabs 1828 may be utilized in any combination with the base front wall 1822 and the lid front wall 1816 to display information. For instance, a single image or message may be displayed that spans the outer surfaces of two or more of the first lid side tabs 1818, the second base side tabs 1828, the base front wall 1822, and the lid front wall 1816.

Figure 57:
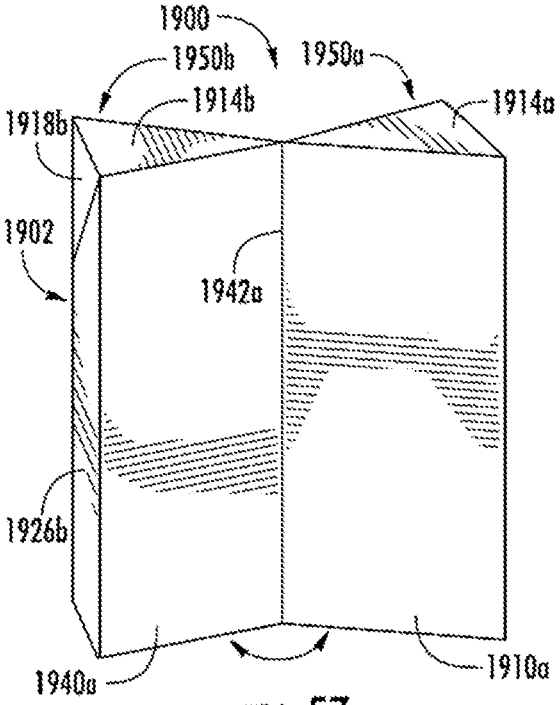
FIG. 57 is another perspective view of the package of FIG. 55, with the package being shown in a first extended, or open, position.
Figure 58:
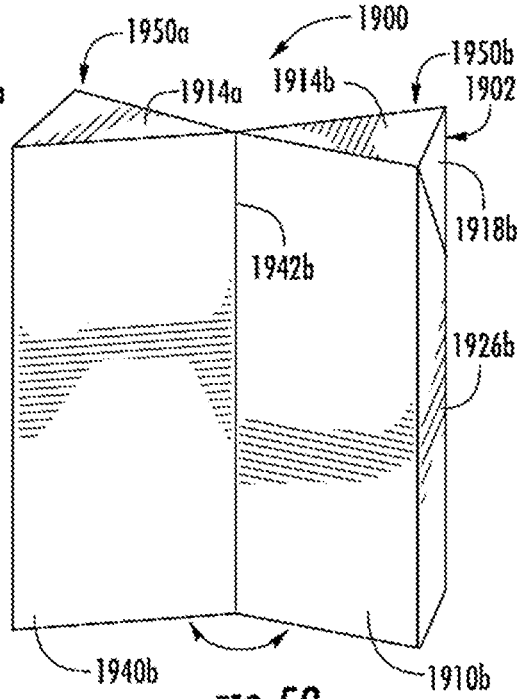
FIG. 58 is another perspective view of the package of FIG. 55, with the package being shown in a second extended, or open, position.
Figure 59:
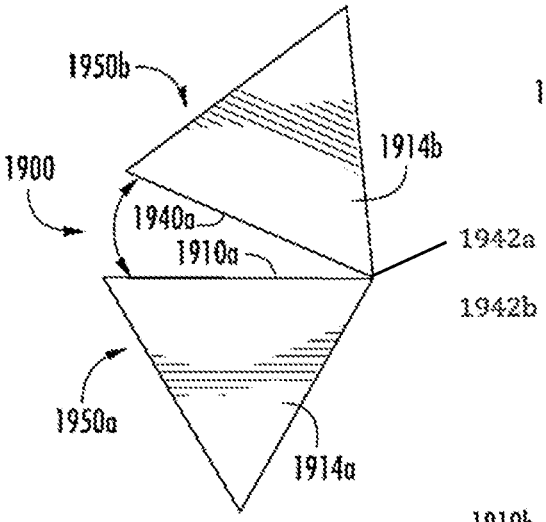
FIG. 59 is a top plan view of the package of FIG. 55, with the package being shown in the first extended position.
Figure 60:
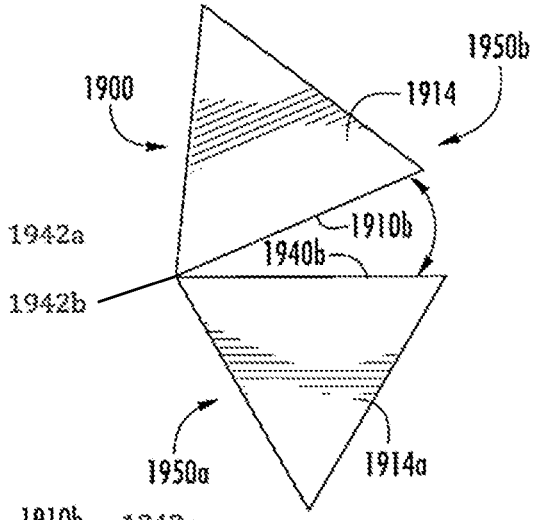
FIG. 60 is another top plan view of the package of FIG. 55, with the package being shown in the second extended position.
Figure 61:
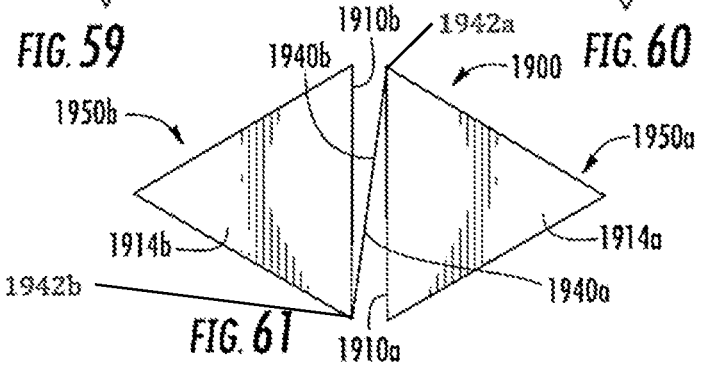
FIG. 61 is another top plan view of the package of FIG. 55, with the package being shown between the first and second extended positions.

FIGS. 56-62 show an additional embodiment of a box 1902 of a cigarette package 1900. The box 1902 and its features may be similar to the other boxes described herein, and any disclosure herein may be applied similarly to the box 1902. In particular, the box 1902 may be similar to the box 1502. The box 1902 includes two box sections 1950*a* and 1950*b*. The box sections 1950*a* and 1950*b* include connecting panels 1940*a* and 1940*b*, respectively, that are configured to connect to the other of the connecting panels 1940*a* and 1940*b* (e.g., as shown in FIG. 61). The box sections 1950*a* and 1950*b* are pivotable relative to each other between a box closed (e.g., compact) position in which the rear walls of the box sections 1950*a* and 1950*b* and the connecting panels 1940*a* and 1940*b* interface (e.g., engage) with each other, and various box open (e.g., extended) positions (shown by way of example in FIGS. 56-58) in which the box sections 1950*a* and 1950*b* are pivoted away from each other about their respective hinge portions 1942*a* (first open or extended position as shown in FIGS. 57 and 59) and 1942*b* (second open or extended position as shown in FIGS. 58 and 60). As can be seen in FIG. 61, the two connecting panels 1940*a*, 1940*b* form a two-way living hinge having two separate pivot axes (i.e., hinge portions 1942*a*, 1942*b*).

Figure 62:
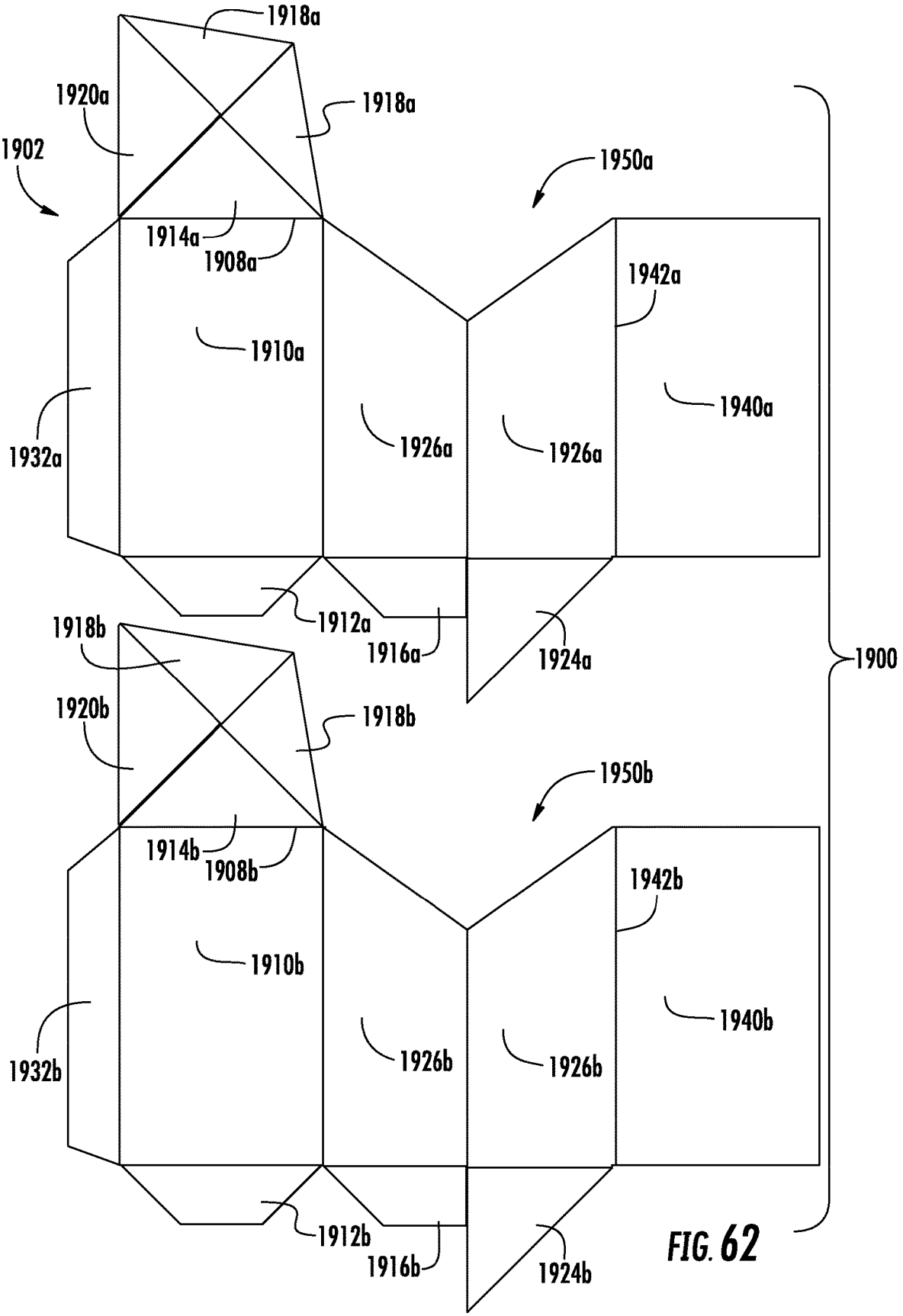
FIG. 62 is a top plan view of a blank used for the package of FIG. 55.
Figure 63:
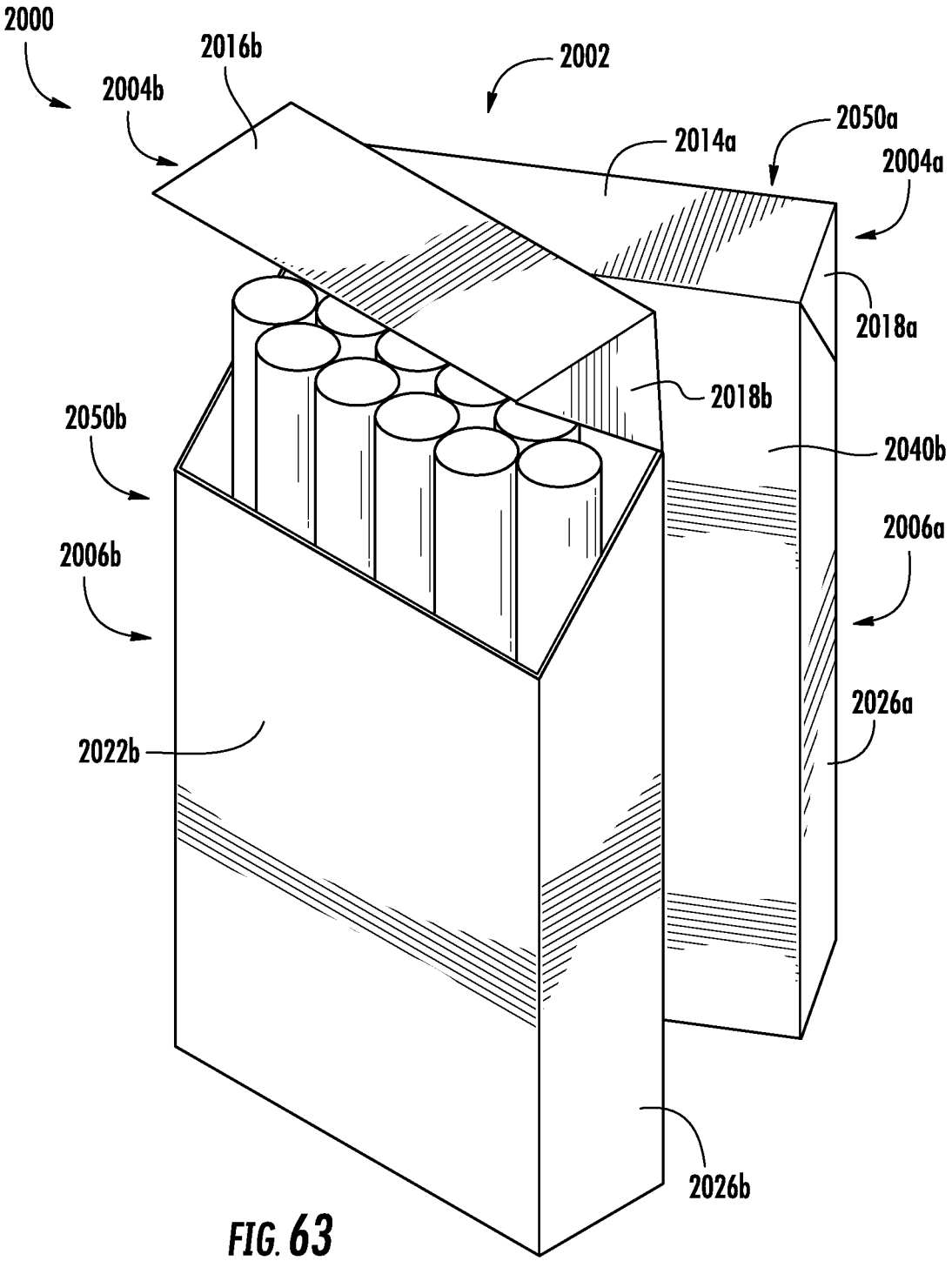
FIG. 63 is a perspective view of another package having a two-way living hinge configuration and a pair of lids, according to an exemplary embodiment.

The box sections 1950*a* and 1950*b* are substantially similar to each other, and include similar features that are differentiated in FIGS. 56-62 by an (a) or (b) designation. FIG. 62 depicts the blanks that form the respective box sections 1950*a*, 1950*b* when folded. The blanks are substantially identical in their flat configurations. By way of example, the features of box section 1950*a* will be described below. However, any description herein relating to features of the box section 1950*a* may be applied similarly to the box section 1950*b*, and vice versa. The box section 1950*a* includes a lid 1904*a* and a base 1906*a*. The lid 1904*a* includes a lid top wall 1914*a* and lid side walls 1918*a*. One of the lid side walls 1918*a* includes a lid top tab 1920*a* coupled thereto. When the lid 1904*a* is in folded form, a surface of the lid top tab 1920*a* may be coupled to an inner surface of the lid top wall 1914*a* to form the lid 1904*a*. The base 1906*a* includes a base bottom wall 1924*a*, a base rear wall 1910*a*, and base side walls 1926*a*. Base bottom tabs 1912*a* and 1916*a* are coupled to the base side walls 1926*a*. When the base 1906*a* is in folded form, the base bottom tabs 1912*a* and 1916*a* may be coupled to an inner surface of the base bottom wall 1924*a* to form the base 1906*a*. Similar to the lid 1504 (and others described herein), the lid 1904*a* does not include a rear wall. Instead, a hinge portion 1908*a* is formed between the base rear wall 1910*a* and the lid top wall 1914*a*. The lid 1904*a* is pivotable in a rearward direction about an axis formed by the hinge portion 1908*a* between a lid open position in which the product is accessible, and a lid closed position (shown in FIGS. 56-58) in which the product is contained.

The box sections 1950*a-b* are pivotable between the box closed position and the two box open positions shown in FIGS. 57 and 58 using the two-way living hinge formed by the connecting panels 1940*a* and 1940*b*. As shown in FIG. 61, corresponding surfaces of the connecting portions 1940*a* and 1940*b* are coupled (e.g., glued in an overlapping manner) together to form the two-way living hinge. The box 1902 includes the first hinge portion 1942*a* connecting the base side wall 1926*a* and the connecting panel 1940*a*. The box section 1950*a* is configured to pivot about the first hinge portion 1942*a* relative to the connecting panel 1940*a* to move the box section 1950*a* between the box closed position and a first box open position (shown in FIGS. 57 and 59). The box 1902 also includes the second hinge portion 1942*b* connecting the base side wall 1926*b* and the connecting panel 1940*b*. The box section 1950*b* is configured to pivot about the hinge portion 1942*b* relative to the connecting panel 1940*b* to move the box section 1950*b* between the box closed position and a second box open position (shown in FIGS. 58 and 60).

When the box sections 1950*a* and 1950*b* are in the box closed position (FIG. 61 depicts the box sections in a partially extended position relative to one another, but would be in a substantially closed position when the rear walls 1910*a*, 1910*b* are moved towards one another), the information display area includes outer surfaces of the side walls (e.g., base side walls 1926*a-b*, lid side walls 1918*a-b*) and the top walls (e.g., lid top walls 1914*a-b*) of the box sections 1950*a-b*. These surfaces may be visible when the package 1900 is sealed (e.g., prior to purchase). When the box sections 1950*a-b* are pivoted away from each other to one of the box open positions (as shown by way of example in FIGS. 56-60), additional display surfaces of the box 1902 are revealed. The additional display surfaces include outer surfaces provided on rear (e.g., inner) walls of the box sections 1950*a-b*, including outer surfaces of the base rear walls 1910*a-b* and/or display surfaces provided by the connecting panels 1940*a-b*. In the first box open position (shown in FIGS. 57 and 59), surfaces of the base rear wall 1910*a* and the connecting panel 1940*a* are revealed as display surfaces. In the second box open position (shown in FIGS. 58 and 60), surfaces of the base rear wall 1910*b* and the connecting panel 1940*b* are revealed as display surfaces. The box sections 1950*a-b* may also be fully extended away from each other (according to FIG. 61) to reveal surfaces of both of the connecting panels 1940*a-b* and the base rear walls 1910*a-b* as display surfaces. These additional display surfaces may not be visible until the package 1900 is opened (e.g., the seal of the package 1900 is broken), enabling the box sections 1950*a-b* to be pivoted to a box open position.

Similar to the box 1802, the box 1902 also provides a greater front display area (i.e., an area that is visible from a front perspective relative to the box 1902). According to the illustrated embodiment, the lids 1904*a-b* do not include a front wall. Instead, the lid side walls 1918*a-b* of each of the box sections 1950*a-b* are coupled directly to each other. The bases 1906*a-b* have a similar configuration, with the two base side walls 1926*a-b* of each of the box sections 1950*a-b* coupled directly to each other at a front portion of the base 1906*a-b*. Thus, the side walls of the box 1902 (e.g., lid side walls 1918*a-b*, base side walls 1926*a-b*) are angled such that their outer surfaces are at least partially visible from a front perspective view (e.g., from the view shown in FIG. 56). In various embodiments, the outer surfaces of the lid side walls 1918*a-b* and the base side walls 1926*a-b* may be utilized in any combination to display information related to the package 1900. For instance, a single image or message may be displayed that spans the outer surfaces of two or more of the lid side walls 1918*a-b* and the base side walls 1926*a-b*.

FIGS. 63-69 show an additional embodiment of a box 2002 of a cigarette package 2000. The box 2002 and its features may be similar to the other boxes described herein, and any disclosure herein may be applied similarly to the box 2002. In particular, the box 2002 is similar to the boxes 1202 and 1902. The box 2002 includes two box sections 2050*a* and 2050*b*. The box sections 2050*a* and 2050*b* include connecting panels 2040*a* and 2040*b*, respectively, that are each configured to connect to the other of the connecting panels 2040*a* and 2040*b*. The box sections 2050*a* and 2050*b* are pivotable relative to each other between a box closed (e.g., compact) position in which the rear walls of the box sections 2050*a* and 2050*b* and the connecting panels 2040*a-b* interface with (e.g., engage) each other, and various box open (e.g., extended) positions (shown by way of example in FIGS. 63-67) in which the box sections 2050*a-b* are pivoted away from each other.

The individual box sections 2050*a-b* are similar to the box sections 1250*a-b*, having a similar shape and configuration, although the box sections 2050*a-b* are oriented differently relative to each other than the box sections 1250*a-b* (as detailed below). The box sections 2050*a* and 2050*b* are substantially similar to each other, and include similar features that are differentiated in FIGS. 63-69 by an (a) or (b) designation. By way of example, the features of box section 2050*a* will be described below. However, any description herein relating to features of the box section 2050*a* may be applied similarly to the box section 2050*b*, and vice versa. The box section 2050*a* includes a lid 2004*a* and a base 2006*a*. The lid 2004*a* includes a lid top wall 2014*a*, a lid front wall 2016*a*, and lid side walls 2018*a*. The lid top wall 2014*a* includes lid top tabs 2020*a* coupled thereto. When the lid 2004*a* is in folded form, an outer surface of the lid top tabs 2020*a* may be coupled to an inner surface of the lid side walls 2018*a* to form the lid 2004*a*.

The base 2006*a* of the box section 2050*a* includes a base front wall 2022*a*, a base bottom wall 2024*a*, a base rear wall 2010*a*, a first base side wall 2026*a*, and a second base side wall 2028*a*. First base bottom tabs 2012*a* are coupled to each of the base side walls 2026*a* and 2028*a*. A second base bottom tab 2030*a* is coupled to the base rear wall 2010*a*. A base side tab 2032*a* is coupled to the base rear wall 2010*a*. When the base 2006*a* is in folded form, the first base bottom tabs 2012*a* and the second base bottom tab 2030*a* are coupled to an inner surface of the base bottom wall 2024*a* to form the bottom wall of the box section 2050*a*. Similarly, an outer surface of the base side tab 2032*a* may be coupled to an inner surface of the base side wall 2026*a* to form the side walls of the box section 2050*a*. Similar to the lids 1904*a-b* (and others described herein), the lid 2004*a* does not include a rear wall. Instead, a hinge portion 2008*a* is formed between the base rear wall 2010*a* and the lid top wall 2014*a*. The lid 2004*a* is pivotable in a rearward direction about an axis formed by the hinge portion 2008*a* between an open lid position in which the product is accessible, and a closed lid position in which the product is contained.

Figure 64:
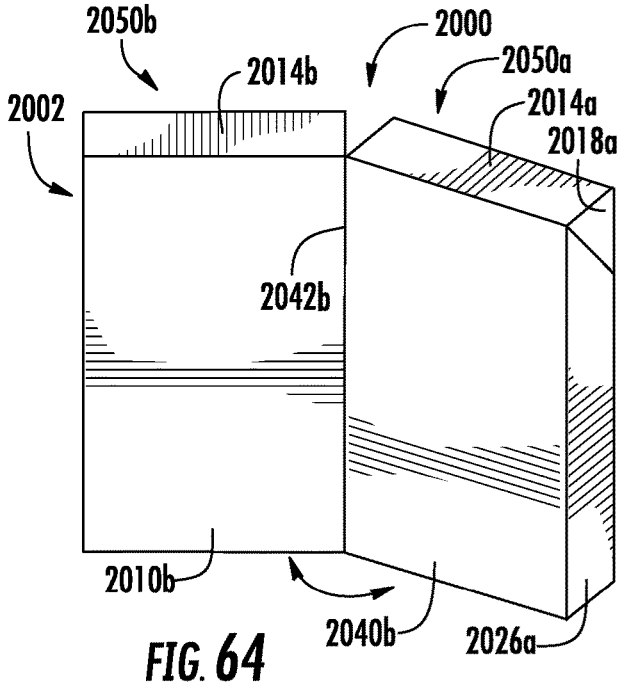
FIG. 64 is another perspective view of the package of FIG. 63, with the package being shown in a first extended, or open, position.
Figure 65:
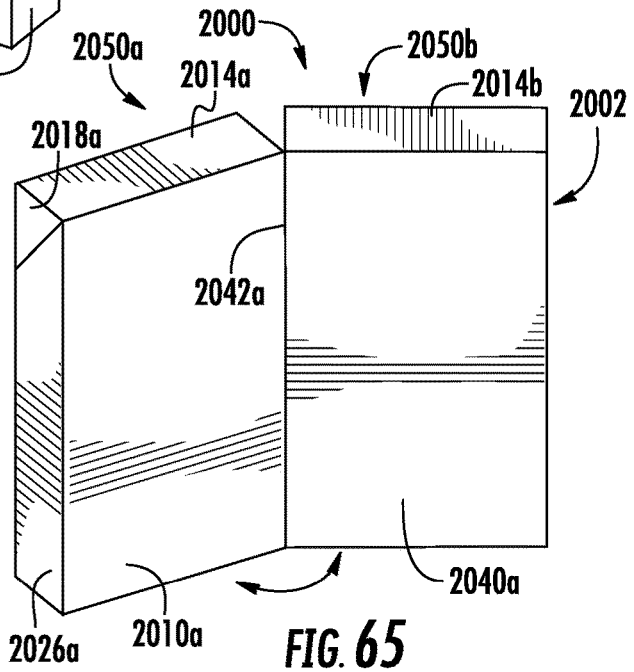
FIG. 65 is another perspective view of the package of FIG. 63, with the package being shown in a second extended, or open, position.
Figure 66:
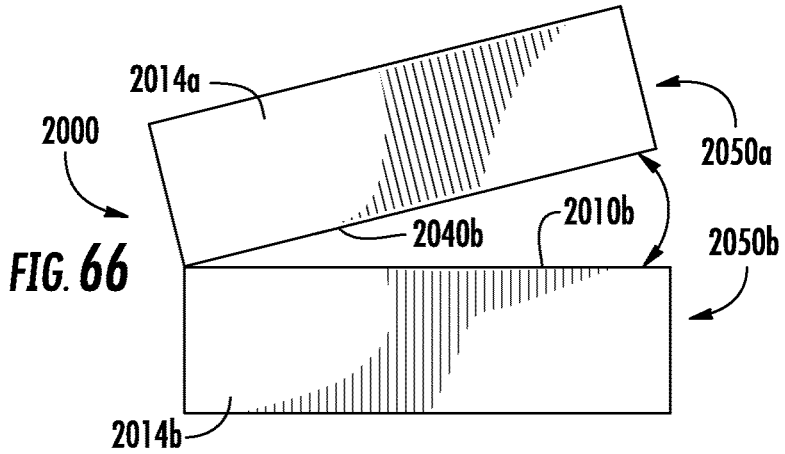
FIG. 66 is a top plan view of the package of FIG. 63, with the package being shown in the first extended position.
Figure 67:
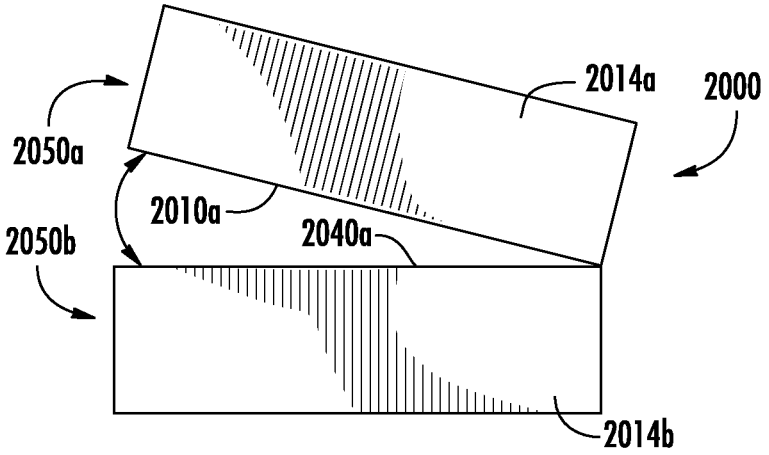
FIG. 67 is another top plan view of the package of FIG. 63, with the package being shown in the second extended position.
Figure 68:
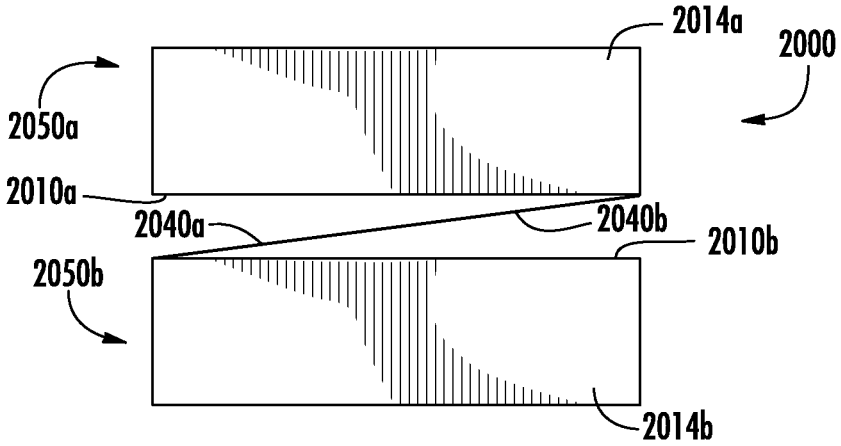
FIG. 68 is another top plan view of the package of FIG. 63, with the package being shown between the first and second extended positions.
Figure 69:
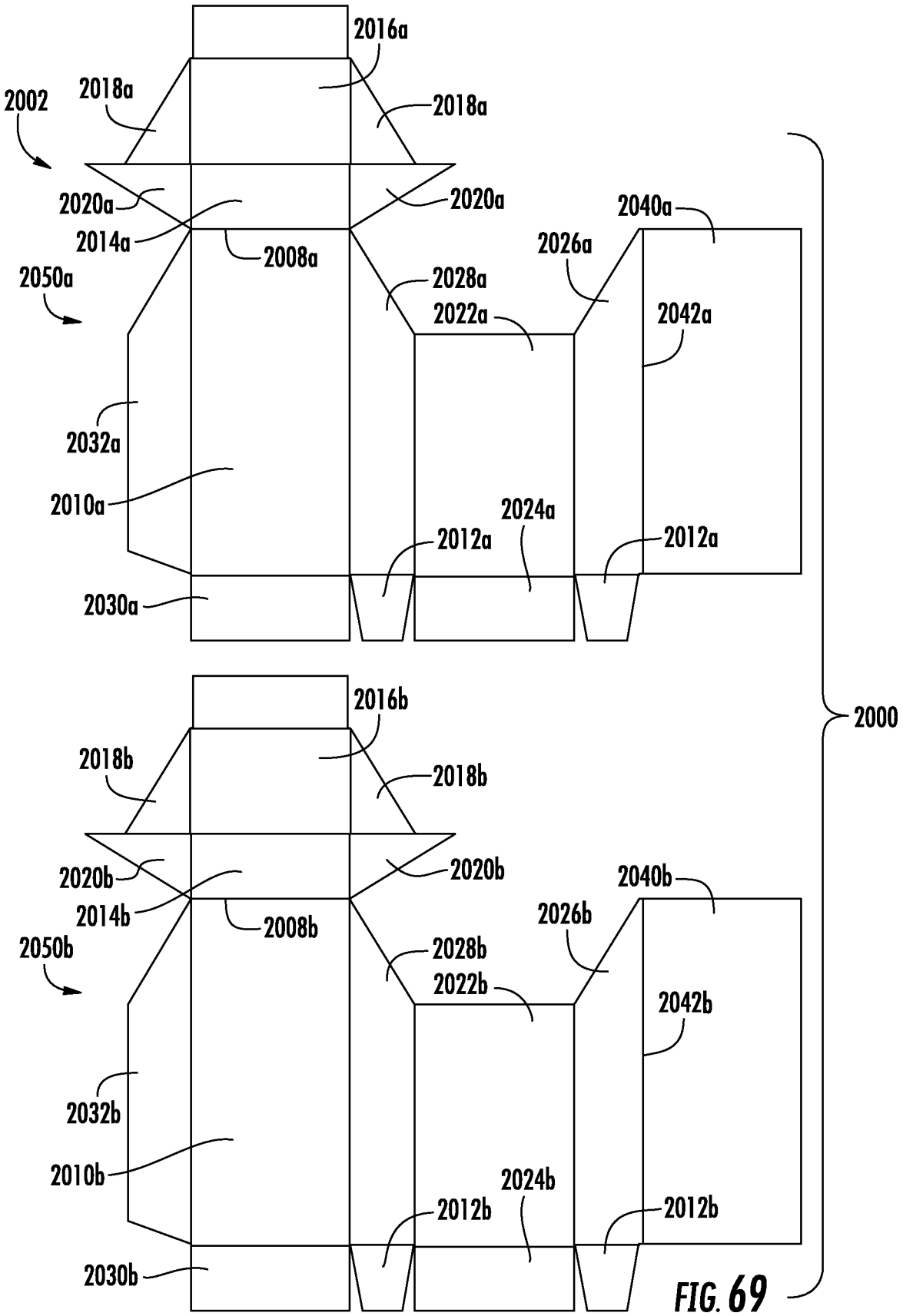
FIG. 69 is a top plan view of a blank used for the package of FIG. 63.
Figure 70:
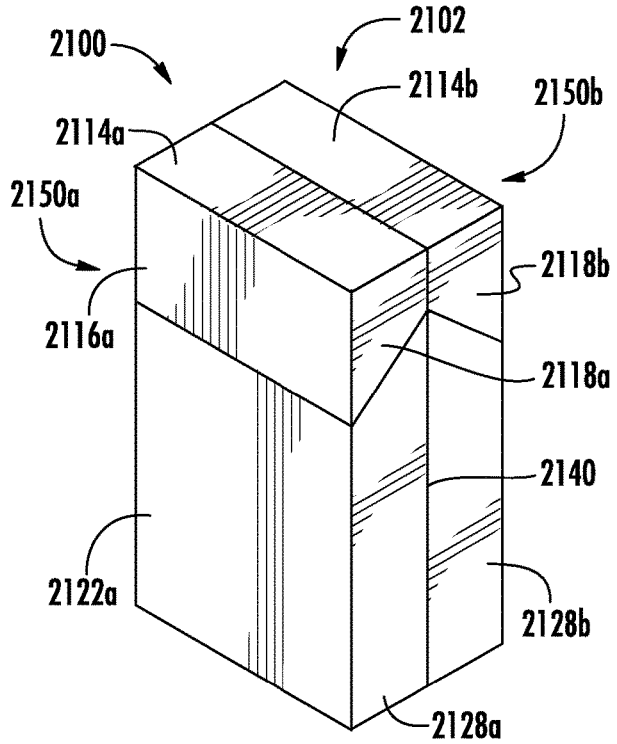
FIG. 70 is a perspective view of another package having a bi-fold configuration and a pair of lids, the package being shown in a closed, or compact, position, according to an exemplary embodiment.

The box sections 2050*a-b* are pivotable between the box closed position and the two box open positions shown in FIGS. 64 and 65 using a two-way living hinge formed by the connecting panels 2040*a* and 2040*b*. As shown in FIG. 68, corresponding surfaces of the connecting panels 2040*a* and 2040*b* are coupled (e.g., glued) together to form the two-way living hinge. The box 2002 includes a first hinge portion 2042*a* connecting the base side wall 2026*a* and the connecting panel 2040*a*. The box section 2050*a* is configured to pivot about the first hinge portion 2042*a* relative to the connecting panel 2040*a* to move the box section 2050*a* between the box closed position and a first box open position (shown in FIGS. 65 and 67). The box 2002 also includes a second hinge portion 2042*b* connecting the base side wall 2026*b* and the connecting panel 2040*b*. The box section 2050*b* is configured to pivot about the hinge portion 2042*b* relative to the connecting panel 2040*b* so as to move the box section 2050*b* between the box closed position and a second box open position (shown in FIGS. 64 and 66).

When the box sections 2050*a-b* are in the box closed position, the information display area includes outer surfaces of the side walls (e.g., base side walls 2026*a-b* and 2028*a-b*, lid side walls 2018*a-b*), the front walls (e.g., base front walls 2022*a-b*, lid front walls 2016*a-b*), and the top walls (e.g., lid top walls 2014*a-b*) of the box sections 2050*a-b*. These surfaces may be visible when the package 2000 is sealed (e.g., prior to purchase). When the box sections 2050*a-b* are pivoted away from each other to one of the box open positions (as shown by way of example in FIGS. 64 and 65), additional display surfaces of the box 2002 are revealed. The additional display surfaces include outer surfaces provided on rear (e.g., inner) walls of the box sections 2050*a-b*, including outer surfaces of the connecting panels 2040*a-b*. In the first box open position (shown in FIGS. 65 and 67), surfaces of the base rear wall 2010*a* and the connecting panel 2040*a* are revealed as display surfaces. In the second box open position (shown in FIGS. 64 and 66), surfaces of the base rear wall 2010*b* and the connecting panel 2040*b* are revealed as display surfaces. The box sections 2050*a-b* may also be fully extended away from each other (according to FIG. 67) to reveal surfaces of both of the connecting panels 2040*a-b* and the base rear walls 2010*a-b* as display surfaces. These additional display surfaces may not be visible until the package 2000 is opened (e.g., the seal of the package 2000 is broken), enabling the box sections 2050*a-b* to be pivoted to the box open positions. In various embodiments, the display surfaces may be utilized in any combination to display information related to the package 2000. For instance, a single image or message may be displayed that spans the rear walls (e.g., base rear walls 2010*a-b*, connecting panels 2040*a-b*).

FIGS. 70-74 show an additional embodiment of a box 2102 of a cigarette package 2100. The box 2102 and its features may be similar to the other boxes described herein, and any disclosure herein may be applied similarly to the box 2102. The box 2102 includes two box sections 2150*a* and 2150*b*. A hinge portion 2140 is formed between side walls (e.g., base side walls 2128) of the two box sections 2150*a-b*. The box sections 2150*a-b* are pivotable about the hinge portion 2140 and relative to each other between a closed (e.g., compact) position (shown in FIG. 70) and various open (e.g., extended) positions (shown by way of example in FIGS. 71-73). The box sections 2150*a-b* may pivot relative to each other in a manner similar to the box sections 1550*a-b*.

The box sections 2150*a* and 2150*b* are substantially similar to each other, and include similar features. Any description herein relating to features of the box section 2150*a* may be applied similarly to the box section 2150*b*, and vice versa. The box sections 2150*a* and 2150*b* each include a lid 2104 and a base 2106. The lid 2104 includes a lid top wall 2114, a lid rear wall 2112, a lid front wall 2116, and lid side walls 2118. The lid rear wall 2112 includes lid side tabs 2120 coupled thereto. When the lid 2104 is in folded form, an outer surface of the lid side tabs 2120 may be coupled to an inner surface of the lid side walls 2118 to form the lid 2104. The base 2106 includes a base front wall 2122, a base bottom wall 2124, and a base rear wall 2110. The base front wall 2122 includes a first base side wall 2126 and a second base side wall 2128 coupled thereto, and the base rear wall 2110 is coupled to the first base side wall 2126, a base side tab 2132, and a base bottom tab 2130. When the base 2106 is in folded form, an outer surface of the base side tab 2132 may be coupled to an inner surface of the second base side wall 2128, and an outer surface of the base bottom tab 2130 may be coupled to an inner surface of the base bottom wall 2124, to form the base 2106. A hinge portion 2108 is formed between the base rear wall 2110 and the lid rear wall 2112. The lid 2104 is pivotable about the hinge portion 2108 between an open lid position (shown by way of example in FIG. 73) and closed lid positions (shown by way of example in FIGS. 70-72).

Figure 71:
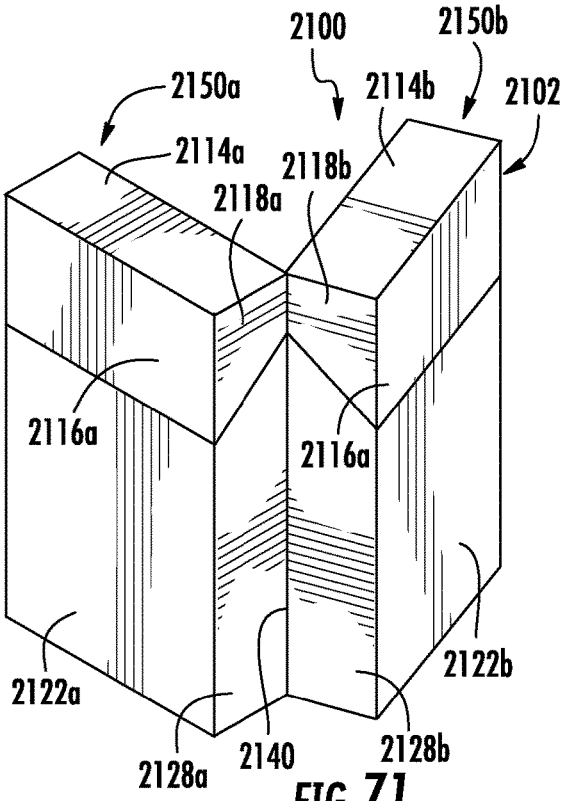
FIG. 71 is another perspective view of the package of FIG. 70, with the package being shown in a partially extended, or open, position.
Figure 72:
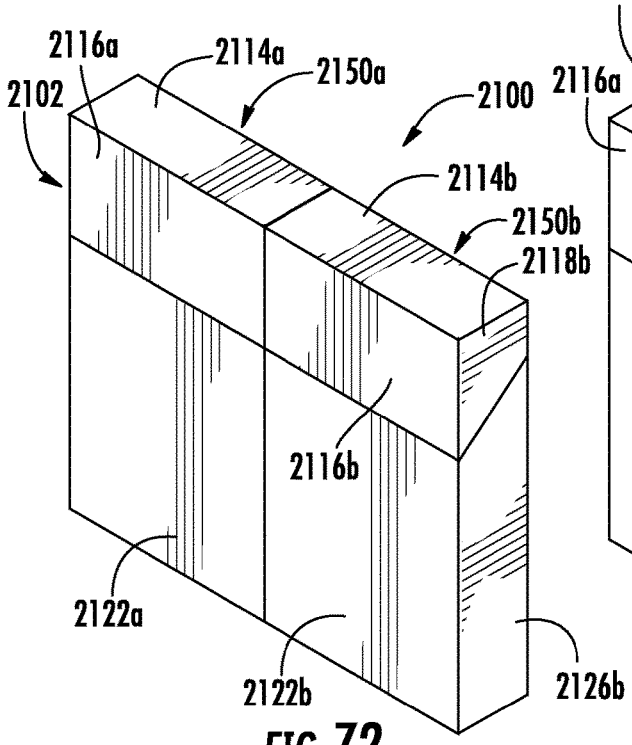
FIG. 72 is another perspective view of the package of FIG. 70, with the package being shown in a fully extended position.
Figure 73:
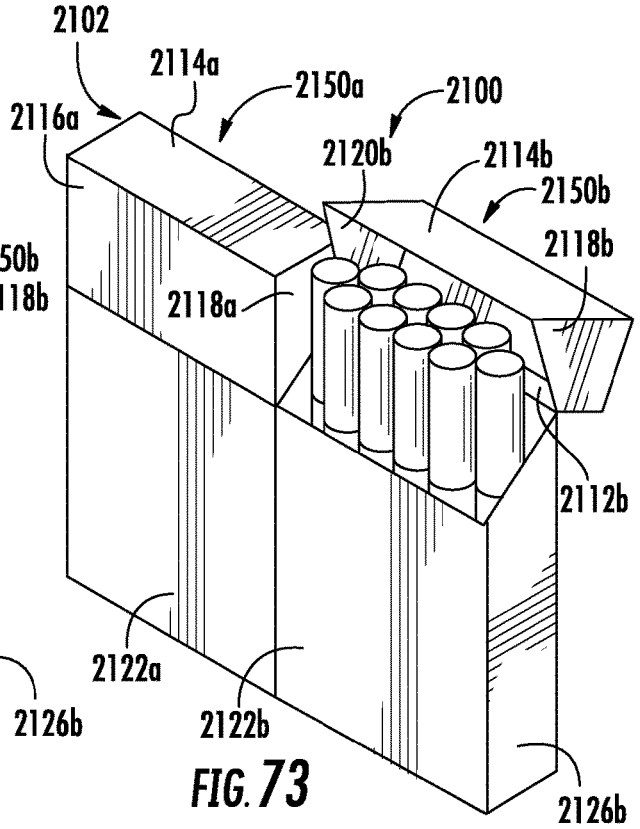
FIG. 73 is another perspective view of the package of FIG. 70 in the fully extended position, with one of the lids being shown in an open position.
Figure 74:
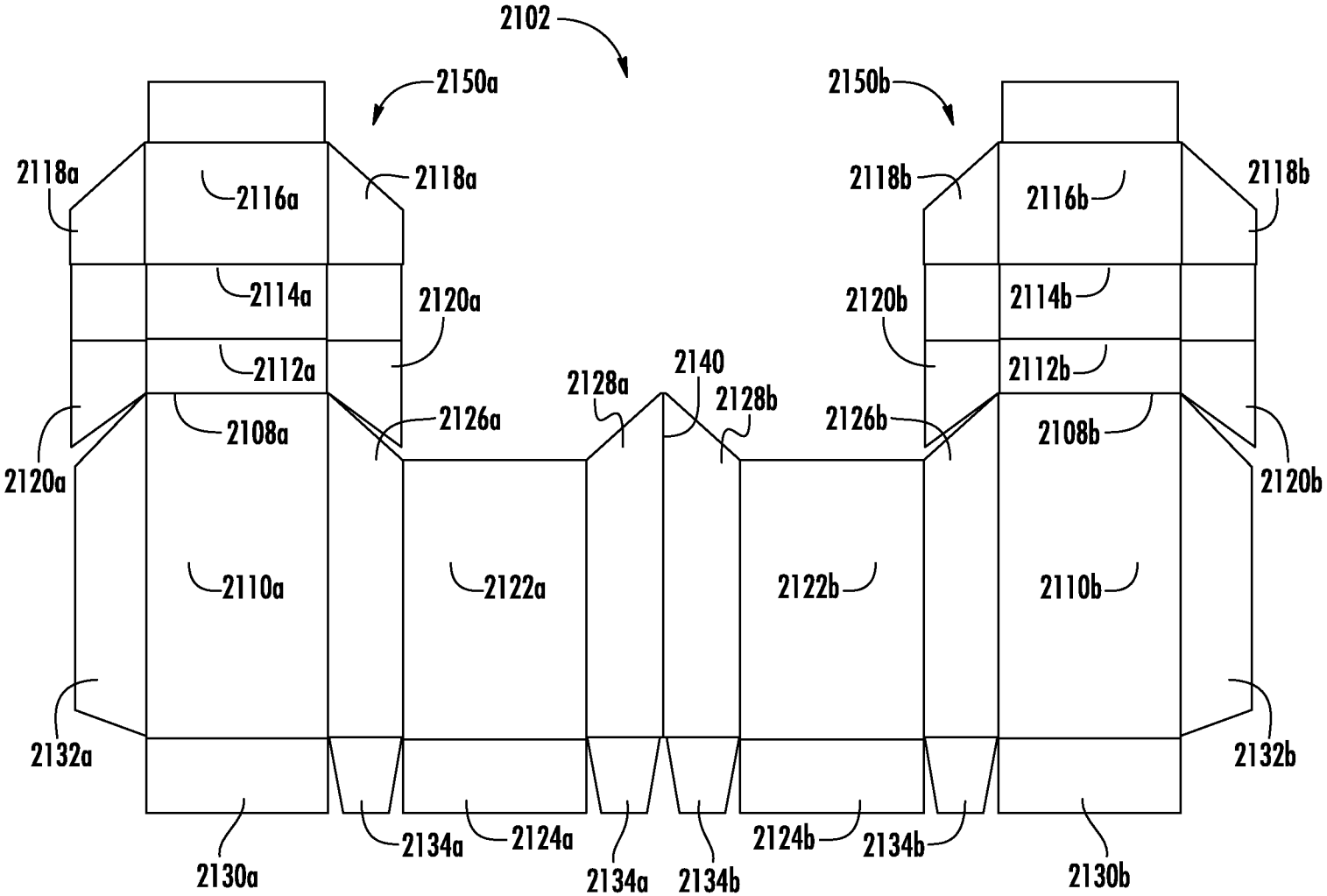
FIG. 74 is a top plan view of a blank used for the package of FIG. 70.
Figure 75:
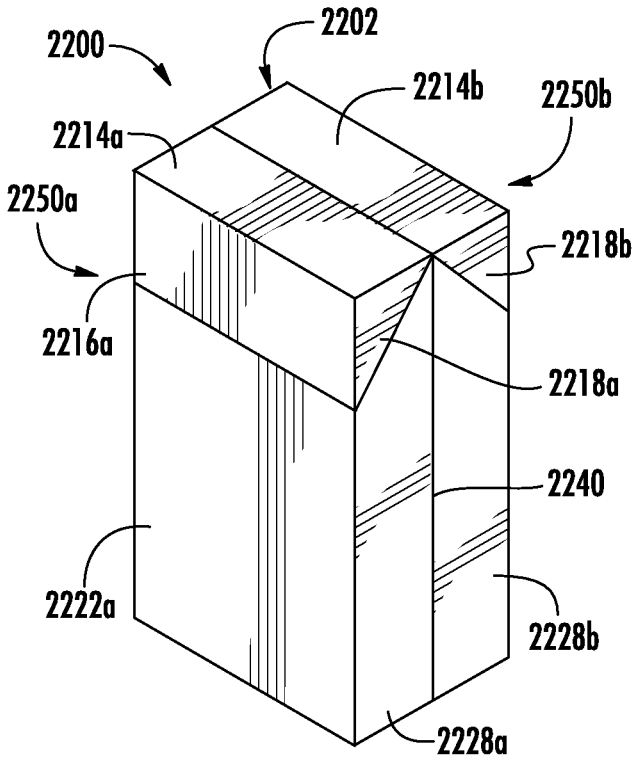
FIG. 75 is a perspective view of another package having a bi-fold configuration and a pair of lids, the package being shown in a closed, or compact, position, according to an exemplary embodiment.
Figure 76:
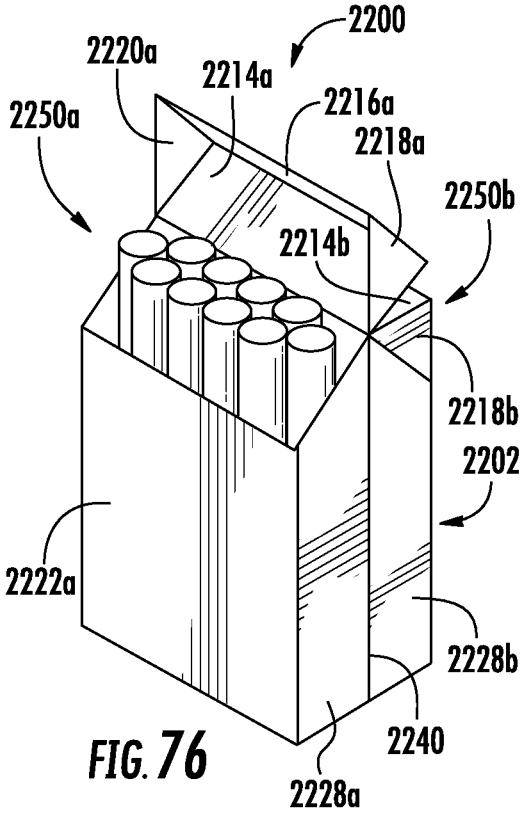
FIG. 76 is another perspective view of the package of FIG. 75 in the closed position, with one of the lids being shown in an open position.

When the box sections 2150*a-b* are in the closed position (shown in FIG. 70), the information display area includes outer surfaces of the side walls (e.g., base side walls 2126 and 2128, lid side walls 2118), the top walls (e.g., lid top walls 2114), and the front walls (e.g., base front walls 2122, lid front walls 2116) of the box sections 2150*a-b*. These surfaces may be visible when the package 2100 is sealed (e.g., prior to purchase). When the box sections 2150*a-b* are pivoted away from each other to an open position (as shown in FIGS. 71 and 72), additional display surfaces of the box 2102 are revealed. The additional display surfaces include outer surfaces provided on rear (e.g., inner) walls of the box sections 2150*a-b* (e.g., base rear walls 2110, lid rear walls 2112). These additional display surfaces may not be visible until the package 2100 is opened (e.g., the seal of the package 2100 is broken), enabling the box sections 2150*a-b* to be pivoted to the open position.

When the box sections 2150*a-b* are in the closed position, the base rear walls 2110 and the lid rear walls 2112 of the box sections 2150*a-b* may engage with each other. For instance, a temporary (e.g., removable, re-useable, etc.) adhesive or other fastener may be used to removably couple the base rear walls 2110 and/or the lid rear walls 2112 to each other. In these embodiments, the box sections 2150*a-b* (e.g., the base rear walls 2110, the lid rear walls 2112) may be detached from each other to pivot the box sections 2150*a-b* to the open position. In some embodiments, the rear walls of the box sections 2150*a-b* may be re-engaged to each other by pivoting the box sections 2150*a-b* to the closed position. In an exemplary embodiment, the lids 2104 are pivotable to a lid open position when the box sections 2150*a-b* are in the open and closed positions.

FIGS. 75-79 show an additional embodiment of a box 2202 of a cigarette package 2200. The box 2202 and its features may be similar to the other boxes described herein, and any disclosure herein may be applied similarly to the box 2202. In particular, the box 2202 may pivot similarly to the box 2102, but have box sections that are similar to those of the box 2002. The box 2202 includes two box sections 2250*a* and 2250*b*. A hinge portion 2240 is formed between side walls (e.g., base side walls 2228) of the two box sections 2250*a-b*. The box sections 2250*a-b* are pivotable about the hinge portion 2240 and relative to each other between a closed (e.g., compact) position (shown in FIG. 75) and various open (e.g., extended) positions (shown by way of example in FIGS. 76-78).

The box sections 2250*a* and 2250*b* are substantially similar to each other, and include similar features that are differentiated in FIGS. 75-79 by an (a) or (b) designation. Any description herein relating to features of the box section 2250*a* may be applied similarly to the box section 2250*b*, and vice versa. The box sections 2250*a-b* are also similar to the box sections 2150*a-b*, although the box sections 2250*a-b* do not include a lid rear wall. The box sections 2250*a* and 2250*b* each include a lid 2204 and a base 2206. The lid 2204 includes a lid top wall 2214, a lid front wall 2216, and lid side walls 2218. The lid front wall 2216 includes lid side tabs 2220 coupled thereto. When the lid 2204 is in folded form, an outer surface of the lid side tabs 2220 may be coupled to an inner surface of the lid side walls 2218 to form the lid 2204. The base 2206 includes a base front wall 2222, a base bottom wall 2224, and a base rear wall 2210. The base front wall 2222 includes a first base side wall 2226 and a second base side wall 2228 coupled thereto, and the base rear wall 2210 is coupled to the first base side wall 2226, a base side tab 2232, and a base bottom tab 2230. When the base 2206 is in folded form, an outer surface of the base side tab 2232 may be coupled to an inner surface of the second base side wall 2228, and an outer surface of the base bottom tab 2230 may be coupled to an inner surface of the base bottom wall 2224, to form the base 2206.

Like the lids 1104, the lid top walls 2214 of the box sections 2250*a-b* are directly coupled to the base rear walls

2410. A hinge portion 2208 is formed between the base rear wall 2210 and the lid top wall 2214. The lid 2204 is pivotable about the hinge portion 2208 between an open lid position (shown by way of example in FIG. 76) and a closed lid position (shown by way of example in FIG. 75). The base rear wall 2210 extends to the lid top wall 2214, rather than ending at a lid rear wall (as is shown in box 2102). Thus, the height of the base rear wall 2210, for example, relative to the base front wall 2222 (e.g., the difference in height between the two walls) may be greater than that of similar features of the box 2102. Likewise, the angle of a top portion of base side walls 2226 and 2228, as well as a bottom portion of lid side walls 2218, may be greater relative to the lid top walls 2214 than that of similar features of the box 2102.

Figure 77:
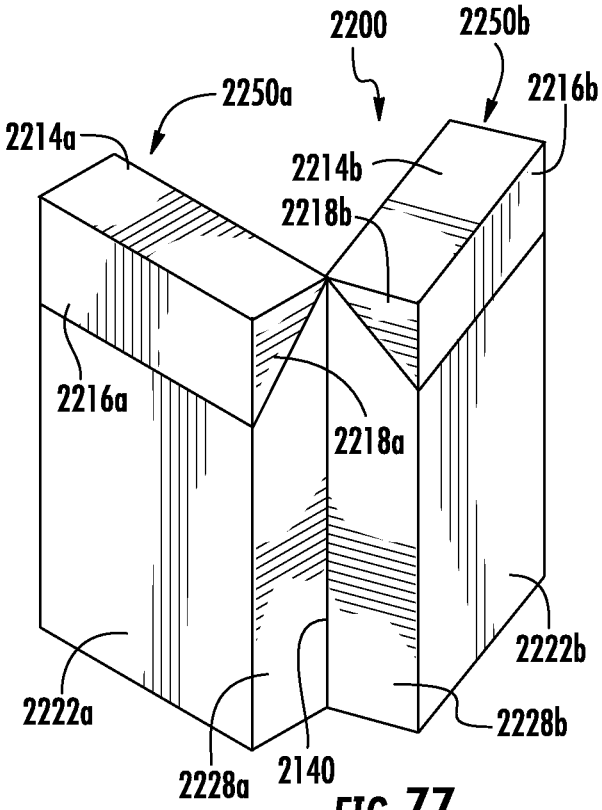
FIG. 77 is another perspective view of the package of FIG. 75, with the package being shown in a partially extended, or open, position.
Figure 78:
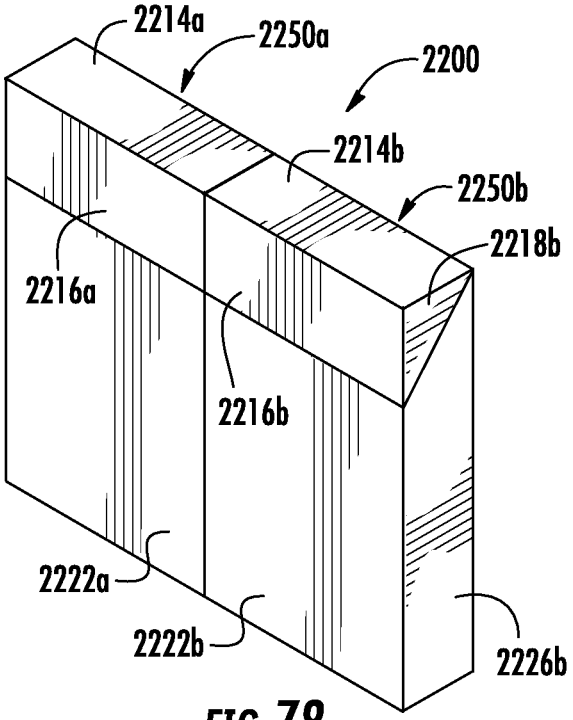
FIG. 78 is another perspective view of the package of FIG. 75 in a fully extended, or open, position.
Figure 79:
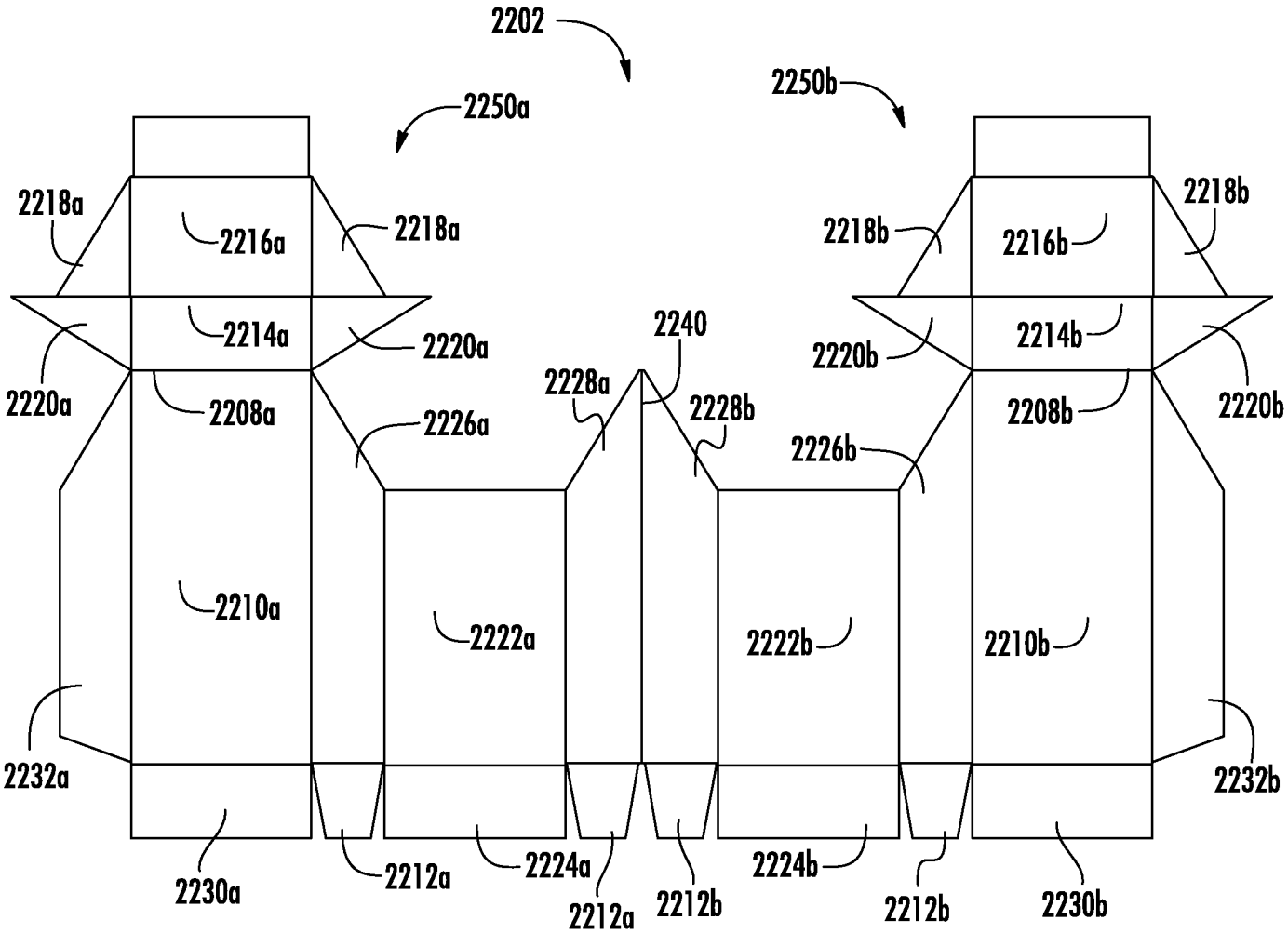
FIG. 79 is a top plan view of a blank used for the package of FIG. 75.
Figure 80:
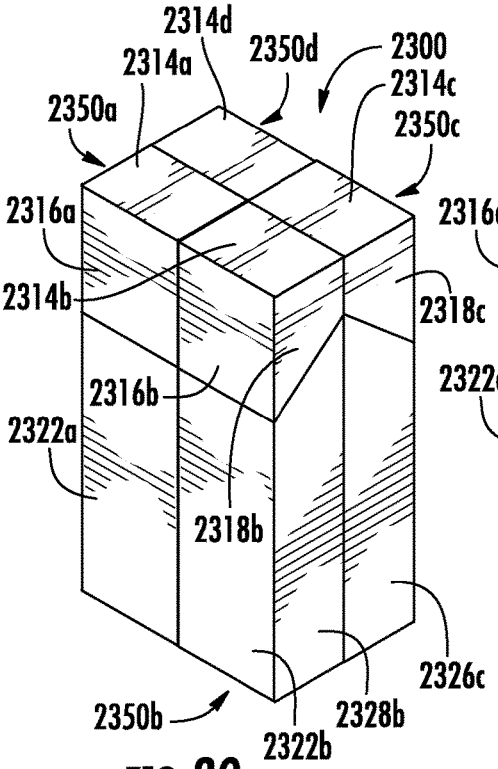
FIG. 80 is a perspective view of a package having a quad-fold configuration and four lids, the package being shown in a closed, or compact, position, according to an exemplary embodiment.

When the box sections 2250*a-b* are in the box closed position (shown in FIG. 75), the information display area includes outer surfaces of the side walls (e.g., base side walls 2226 and 2228, lid side walls 2218), the top walls (e.g., lid top walls 2214), and the front walls (e.g., base front walls 2222, lid front walls 2216) of the box sections 2250*a-b*. These surfaces may be visible when the package 2200 is sealed (e.g., prior to purchase). When the box sections 2250*a-b* are pivoted away from each other to an open position (as shown in FIGS. 77 and 78), additional display surfaces of the box 2202 are revealed. The additional display surfaces include outer surfaces provided on rear (e.g., inner) walls of the box sections 2250*a-b* (e.g., base rear walls 2210). These additional display surfaces may not be visible until the package 2200 is opened (e.g., the seal of the package 2200 is broken), enabling the box sections 2250*a-b* to be pivoted to the open position.

FIGS. 80-84 show an additional embodiment of a box 2302 of a cigarette package 2300. The box 2302 and its features may be similar to the other boxes described herein, and any disclosure herein may be applied similarly to the box 2302. The box 2302 has a quad-fold configuration, including four box sections 2350*a*, 2350*b*, 2350*c*, and 2350*d*. The box sections 2350*a-d* are pivotally coupled to each other by a connecting portion 2340 that is coupled to rear walls (e.g., base rear walls 2310*a-d*) of the box sections 2350*a-d*. The connecting portion 2340 includes four panels 2342, each of which are coupled to one of the base rear walls 2310*a-d*. The panels 2342 may be similar in size and shape to the base rear walls 2310*a-d*, such that the panels 2342 entirely cover the base rear walls 2310*a-d* when attached. The connecting portion 2340 also includes three hinge portions 2344 connecting each of the panels 2342. The panels 2342 are pivotable about the hinge portions 2344 and relative to each other. When the connecting portion 2340 is coupled to the box sections 2350*a-d*, the hinge portions 2344 are positioned between each of the base rear walls 2310*a-d*. In this configuration, the box sections 2350*a-b* are pivotable about the hinge portions 2344 (with the coupled panels 2342) and relative to each other between a box closed (e.g., compact) position (shown in FIG. 80) and various box open (e.g., extended) positions (shown by way of example in FIGS. 81-83).

The box sections 2350*a-d* are substantially similar to each other, and include similar features that are differentiated in FIGS. 80-84 by (a)-(d) designations. The box sections 2350*a-d* may also be similar to the box sections 2150*a-b*, although the box sections 2350*a-d* are each intended to store one-fourth (¼) of the product stored within the package 2300, rather than one-half. By way of example, the features of the box section 2350*a* will be described. However, any description herein relating to features of one of the box sections 2350*a-d* may be applied similarly to any of the other box sections 2350*a-d*. Similar to the box sections 2150*a-b*, the box section 2350*a* includes a lid 2304*a* and a base 2306*a*. The lid 2304*a* includes a lid top wall 2314*a*, a lid rear wall 2312*a*, a lid front wall 2316*a*, and lid side walls 2318*a*. The lid top wall 2314*a* includes lid side tabs 2320*a* coupled thereto. When the lid 2304*a* is in folded form, an outer surface of the lid side tabs 2320*a* may be coupled to an inner surface of the lid side walls 2118*a* to form the lid 2304*a*. The base 2306*a* includes a base front wall 2322*a*, a base bottom wall 2324*a*, and a base rear wall 2310*a*. The base front wall 2322*a* includes a first base side wall 2326*a* and a second base side wall 2328*a* coupled thereto, and the base rear wall 2310*a* is coupled to the first base side wall 2326*a*, a base side tab 2332*a*, and a base bottom tab 2330*a*. When the base 2306*a* is in folded form, an outer surface of the base side tab 2332*a* may be coupled to an inner surface of the second base side wall 2328*a*, and an outer surface of the base bottom tab 2330*a* may be coupled to an inner surface of the base bottom wall 2324*a*, forming the base 2106*a*. A hinge portion 2308*a* is formed between the base rear wall 2310*a* and the lid rear wall 2312*a*. The lid 2304*a* is pivotable about the hinge portion 2308*a* between an open lid position (shown by way of example with regard to box section 2350*d* in FIG. 83) and closed lid positions (shown by way of example with regard to the box sections 2350*a-c* in FIG. 83).

Figure 81:
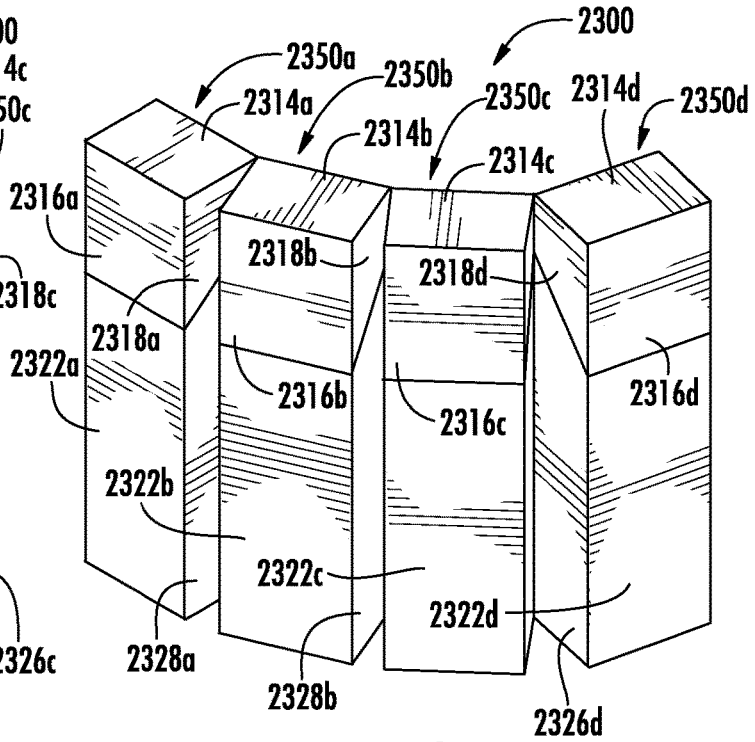
FIG. 81 is another perspective view of the package of FIG. 80, the package being shown in a partially extended, or open, position.
Figure 82:
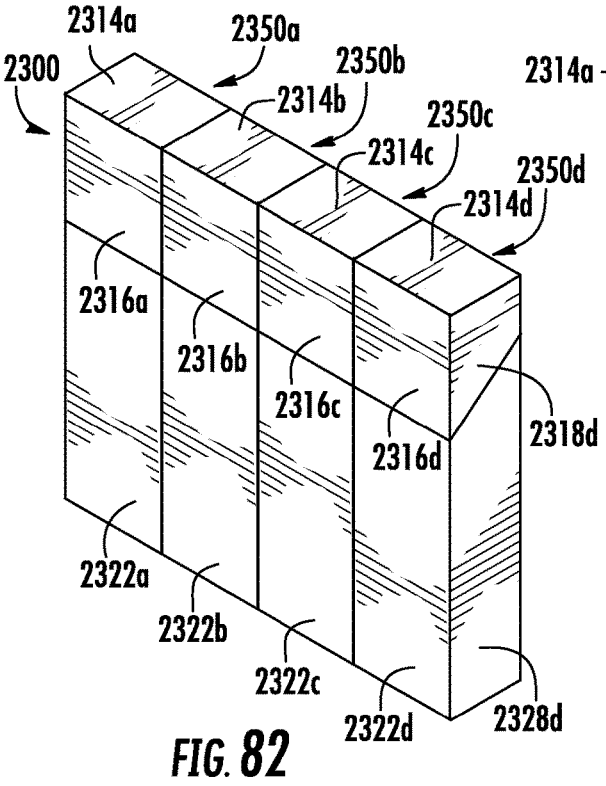
FIG. 82 is another perspective view of the package of FIG. 80, the package being shown in a fully extended, or open, position.
Figure 83:
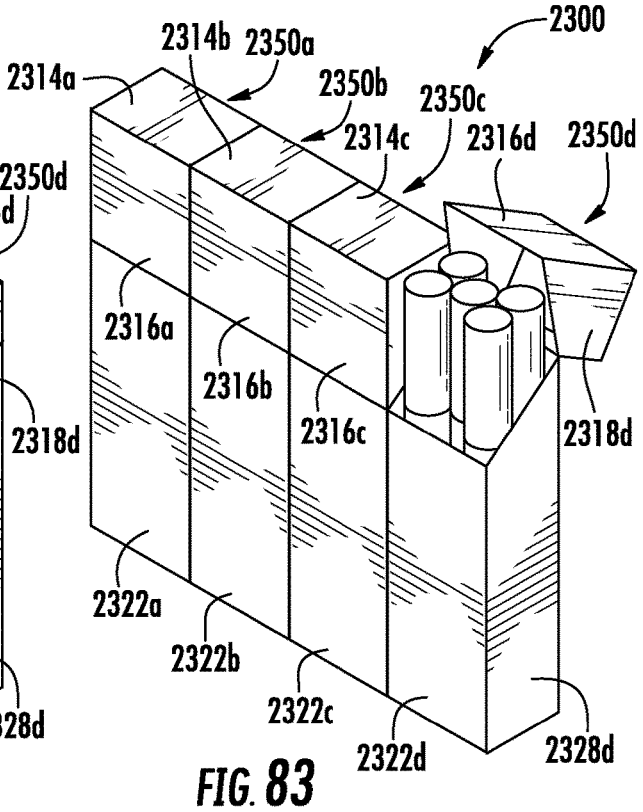
FIG. 83 is another perspective view of the package of FIG. 80 in the fully extended position, one of the lids being shown in an open position.
Figure 84:
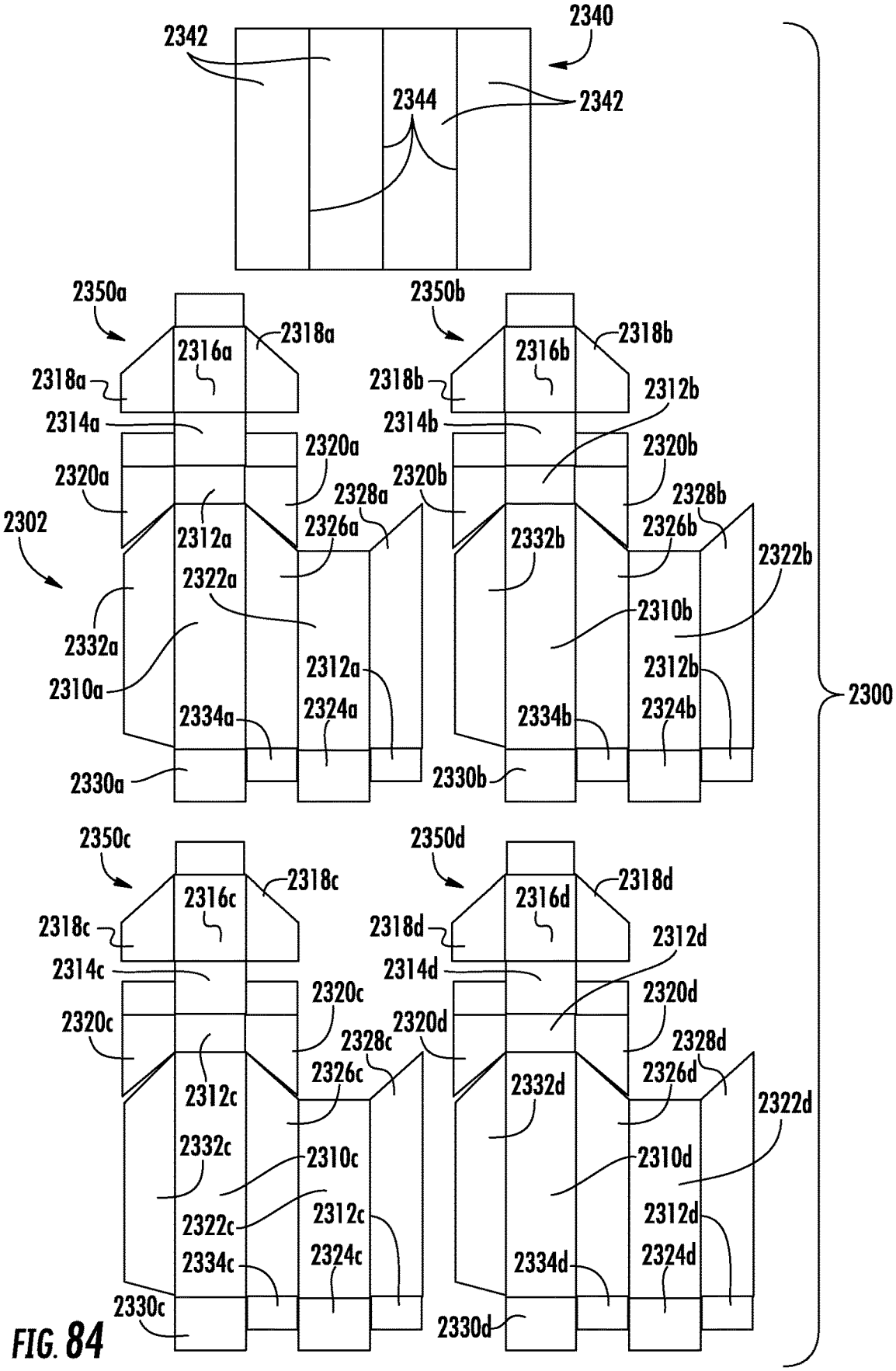
FIG. 84 is a top plan view of a blank used for the package of FIG. 80.
Figure 85:
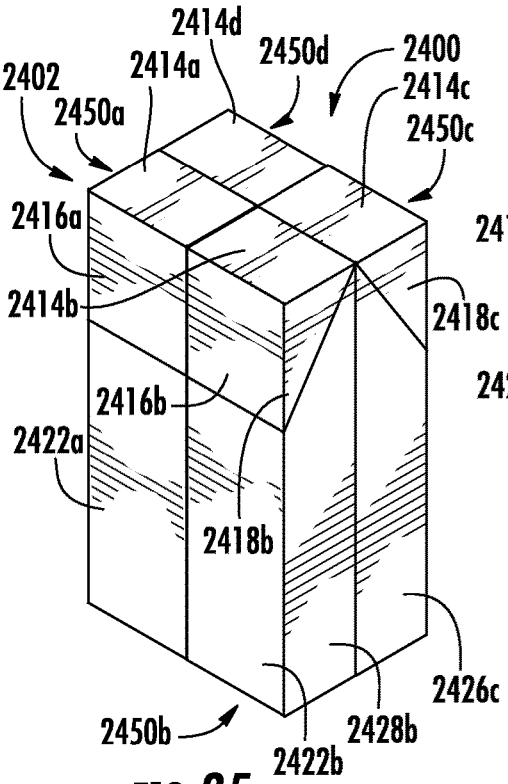
FIG. 85 is a perspective view of another package having a quad-fold configuration and four lids, the package being shown in a closed, or compact, position, according to an exemplary embodiment.

When the box sections 2350*a-d* are in the box closed position (shown in FIG. 80), the information display area includes outer surfaces of the side walls (e.g., base side walls 2326*a-d* and 2328*a-d*, lid side walls 2318*a-d*), the top walls (e.g., lid top walls 2314*a-d*), and the front walls (e.g., base front walls 2322*a-d*, lid front walls 2316*a-d*) of the box sections 2150*a-d*. These surfaces may be visible when the package 2300 is sealed (e.g., prior to purchase). When the box sections 2350*a-d* are pivoted away from each other to an open position (as shown in FIGS. 81 and 82), additional display surfaces of the box 2302 are revealed. The additional display surfaces include outer surfaces provided on rear (e.g., inner) walls of the box sections 2350*a-d* (e.g., base rear walls 2310*a-d*, lid rear walls 2312*a-d*). The additional display surfaces may also include surfaces of the connecting portion 2340 (e.g., surfaces of the panels 2342). These additional display surfaces may not be visible until the package 2300 is opened (e.g., the seal of the package 2300 is broken), enabling the box sections 2350*a-d* to be pivoted to a box open position.

When the box sections 2350*a-d* are in the closed position, the rear walls of the box section 2350*a* (e.g., base rear wall 2310*a*, lid rear wall 2312*a*) may engage with like rear walls of the box section 2350*d* (e.g., base rear wall 2310*d*, lid rear wall 2312*d*). Similarly, rear walls of the box section 2350*b* (e.g., base rear wall 2310*b*, lid rear wall 2312*b*) may engage with like rear walls of the box section 2350*c* (e.g., base rear wall 2310*c*, lid rear wall 2312*c*). For instance, a temporary (e.g., removable, re-useable, etc.) adhesive or other fastener may be used to removably couple the base rear walls 2310*a-d* and/or the lid rear walls 2312*a-d* to the corresponding rear walls. In these embodiments, the box sections 2350*a-d* (e.g., the base rear walls 2310*a-d*, the lid rear walls 2312*a-d*) may be detached from each other to pivot the box sections 2350*a-d* to a box open position. In some embodiments, the rear walls of the box sections 2350*a-d* may be re-engaged to each other by pivoting the box sections 2350*a-d* to the box closed position shown in FIG. 80. In an exemplary embodiment, the lids 2304*a-d* are pivotable to a lid open position when the box sections 2350*a-d* are in any of the box open and closed positions.

FIGS. 85-89 show an additional embodiment of a box 2402 of a cigarette package 2400. The box 2402 and its features may be similar to the other boxes described herein, and any disclosure herein may be applied similarly to the box 2402. In particular, the box 2402 is substantially similar to the box 2302, with features of the box 2402 being identified in the FIGURES using reference numbers that correspond to those of like features of the box 2302. Similar to the box 2302, the box 2402 has a quad-fold configuration, including four box sections 2450*a*, 2450*b*, 2450*c*, and 2450*d*. The box 2402 includes a connecting portion 2440 that is coupled to rear walls (e.g., base rear walls 2410*a-d*) of the box sections 2450*a-d*, pivotally coupling each of the box sections 2450*a-d*. The connecting portion 2440 includes four panels 2442, with each of the panels 2442 being connected to a separate of the box sections 2450*a-d*. The connecting portion 2440 also includes three hinge portions 2444 about which the box sections 2450*a-d* are configured to pivot relative to each other with the connected panels 2442.

The box sections 2350*a-d* are substantially similar to each other, and include similar features that are differentiated in FIGS. 80-84 by (a)-(d) designations. Each of the box sections 2450*a-d* includes a lid 2404*a-d* pivotally coupled to a base 2406*a-d*. Each of the lids 2404*a-d* includes a lid top wall 2414*a-d*, a lid front wall 2416*a-d*, and lid side walls 2418*a-d*, but does not include a lid rear wall. The lid top wall 2414*a-d* includes lid side tabs 2420*a-d* coupled thereto. When the lid 2404*a-d* is in folded form, an outer surface of the lid side tabs 2420*a-d* may be coupled to an inner surface of the lid side walls 2418*a-d* to form the lid 2404*a-d*. Each of the bases 2406*a-d* includes a base front wall 2422*a-d*, a base bottom wall 2424*a-d*, and a base rear wall 2410*a-d*. The base front walls 2422*a-d* each include a first base side wall 2426*a-d* and a second base side wall 2428*a-d* coupled thereto, and the base rear wall 2410*a-d* is coupled to the first base side wall 2426*a-d*, a base side tab 2432*a-d*, and a base bottom tab 2430*a-d*. When the base 2406*a-d* is in folded form, an outer surface of the base side tab 2432*a-d* may be coupled to an inner surface of the second base side wall 2428*a-d*, and an outer surface of the base bottom tab 2430*a-d* may be coupled to an inner surface of the base bottom wall 2424*a-d*, forming the base 2406*a-d*.

The box sections 2450*a-d* are substantially similar to the box sections 2350*a-d*, although the box sections 2450*a-d* do not include lid rear walls. Instead, like the lids 1104*a-b*, the lid top walls 2414*a-d* are directly coupled to the base rear walls 2410*a-d*. The base rear walls 2410*a-d* extend to the lid top walls 2414*a-d*, rather than ending at a lid rear wall (as is shown in box 2302). Thus, the height of the base rear wall 2410*a*, for example, relative to the base front wall 2422*a* (e.g., the difference in height between the two walls) may be greater than that of similar features of the box 2302. Likewise, the angle of a top portion of base side walls 2426*a-d* and 2428*a-d*, as well as a bottom portion of lid side walls 2418*a-d*, may be greater relative to the lid top walls 2414*a-d* than that of similar features of the box 2302. Each of the box sections 2450*a-d* includes a hinge portion 2408*a-d* that is formed between the base rear wall 2410*a-d* and the lid top wall 2414*a-d*. The lid 2404*a-d* is pivotable about the hinge portion 2408*a-d* between an open lid position (shown by way of example with regard to box section 2450*b* in FIG. 87) and closed lid positions (shown by way of example with regard to box section 2350*a* in FIG. 87).

Figure 86:
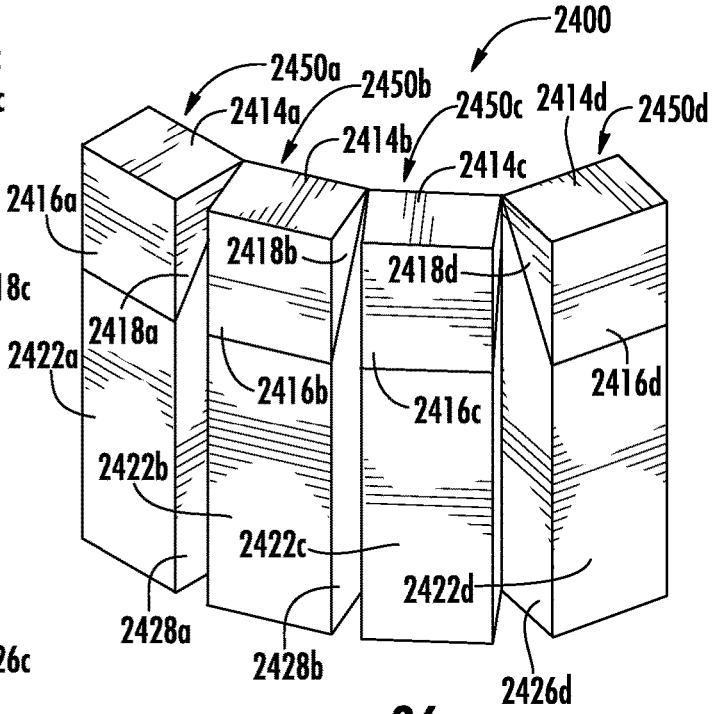
FIG. 86 is another perspective view of the package of FIG. 85 in the compact position, one of the lids being shown in an open position.
Figure 87:
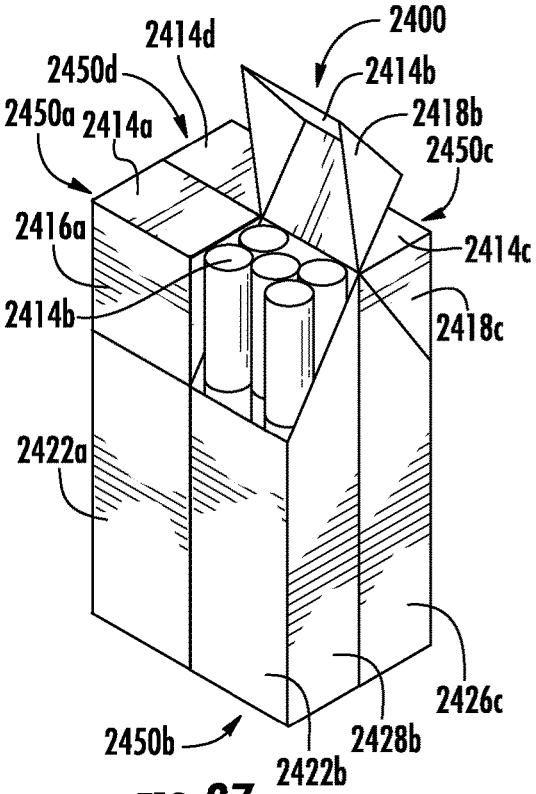
FIG. 87 is another perspective view of the package of FIG. 85, the package being shown in a partially extended, or open, position.
Figure 88:
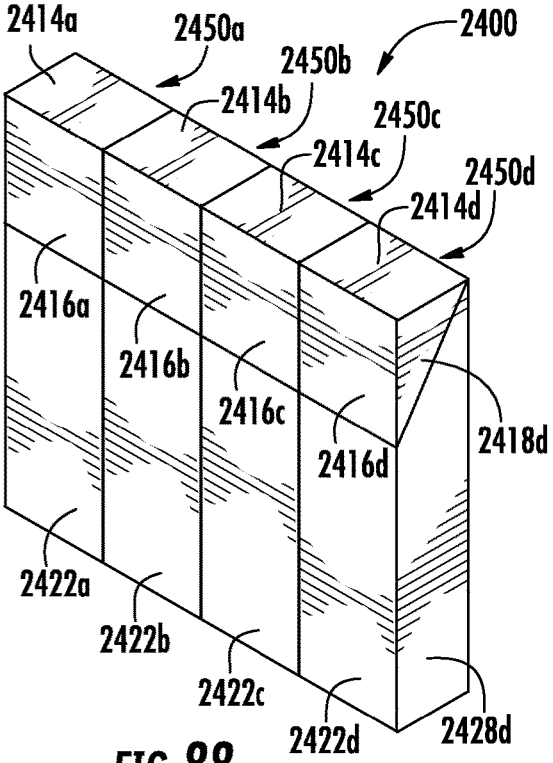
FIG. 88 is another perspective view of the package of FIG. 85, the package being shown in a fully extended position.
Figure 89:
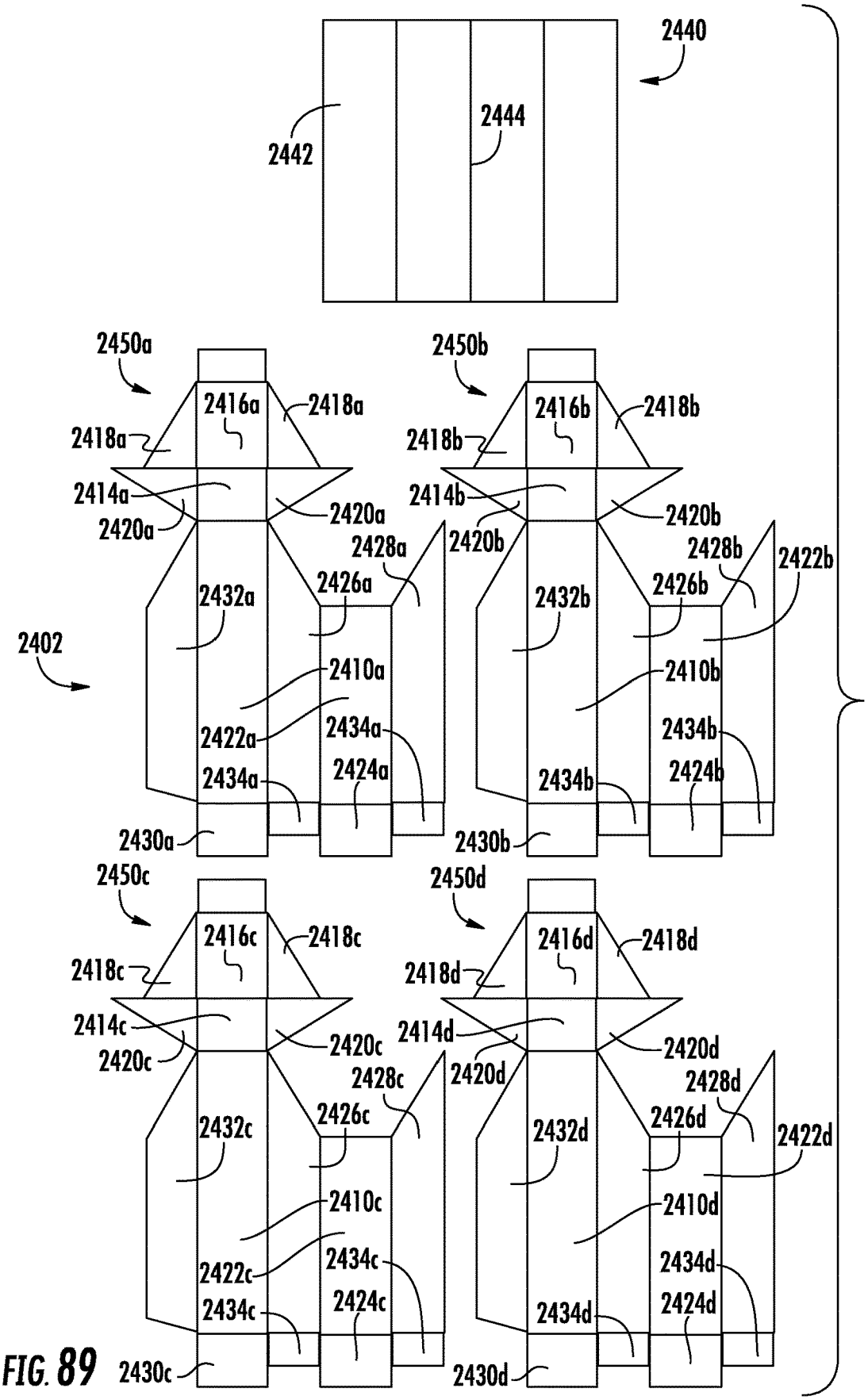
FIG. 89 is a top plan view of a blank used for the package of FIG. 85.

When the box sections 2450*a-d* are in the box closed position (shown in FIG. 85), the information display area includes outer surfaces of the side walls (e.g., base side walls 2426*a-d* and 2428*a-d*, lid side walls 2418*a-d*), the top walls (e.g., lid top walls 2414*a-d*), and the front walls (e.g., base front walls 2422*a-d*, lid front walls 2416*a-d*) of the box sections 2450*a-d*. These surfaces may be visible when the package 2400 is sealed (e.g., prior to purchase). When the box sections 2450*a-d* are pivoted away from each other to an open position (as shown in FIGS. 86 and 88), additional display surfaces of the box 2402 are revealed. The additional display surfaces may include outer surfaces provided on rear (e.g., inner) walls of the box sections 2450*a-d* (e.g., base rear walls 2410*a-d*). The additional display surfaces may also include outer surfaces of the connecting portion 2440 (e.g., surfaces of the panels 2442). These additional display surfaces may not be visible until the package 2400 is opened (e.g., the seal of the package 2400 is broken), enabling the box sections 2450*a-d* to be pivoted to a box open position.

FIGS. 90-94 show another embodiment of a box 2502 of a cigarette package 2500. The box 2502 and its features may be similar to the other boxes described herein, and any disclosure herein may be applied similarly to the box 2502. In particular, the box 2502 includes features that are similar to those of boxes 602, 702, 802, and 1502. The box 2502 includes a lid 2504 and a base 2506. The lid 2504 includes a lid top wall 2514, a lid rear wall 2512, a lid front wall 2516, and lid side walls 2518. The lid rear wall 2512 includes lid side tabs 2520 coupled thereto. A hinge portion 2508 is formed between the lid rear wall 2512 and a rear wall of the base 2506 (e.g., second base rear wall 2554). The lid 2504 is pivotable in a rearward direction relative to the base 2506 about an axis generally defined by the hinge portion 2508. Thereby, the lid 2504 may be moved between an open position (shown by way of example in FIGS. 91-93) and a closed position (shown in FIG. 90).

The base 2506 includes a first base segment 2530 and a second base segment 2550. Each of the base segments 2530 and 2550 is configured to store half of the product (e.g., ten cigarettes) that is stored within the package 2500. The first base segment 2530 includes a first base front wall 2522, a first base rear wall 2510, a first base bottom wall 2534, and first base side walls 2526 and 2528. The first base rear wall 2510 includes a first base side tab 2532 and a first base bottom tab 2524 coupled thereto. The second base segment 2550 includes a second base front wall 2552, a second base rear wall 2554, a second base bottom wall 2562, and second base side walls 2556 and 2558. The second base rear wall 2554 includes a second base side tab 2564 and a second base bottom tab 2560 coupled thereto.

The first base segment 2530 is coupled to the second base segment 2550 by a connecting portion 2540. The connecting portion 2540 includes panels 2536, 2538, 2542, 2544, and 2546 that are pivotally coupled to each other by hinge portions 2548. According to the orientation of FIG. 94, the panels 2536-2546 have a substantially similar height, but may vary in width. In the illustrated embodiment, the panels 2536 and 2546 are coupled to the outer surface of the second base rear wall 2554, and the panel 2542 is coupled to the outer surface of the first base front wall 2522. By the pivotal movement of the panels 2536, 2538, 2542, 2544, and 2546 about the hinge portions 2548, the first base segment 2550 is configured to move (e.g., extend, pivot) relative to the second base segment 2550 between a compact position (shown in FIGS. 90 and 91) and extended, or open, positions (shown by way of example in FIGS. 92 and 93).

Figure 90:
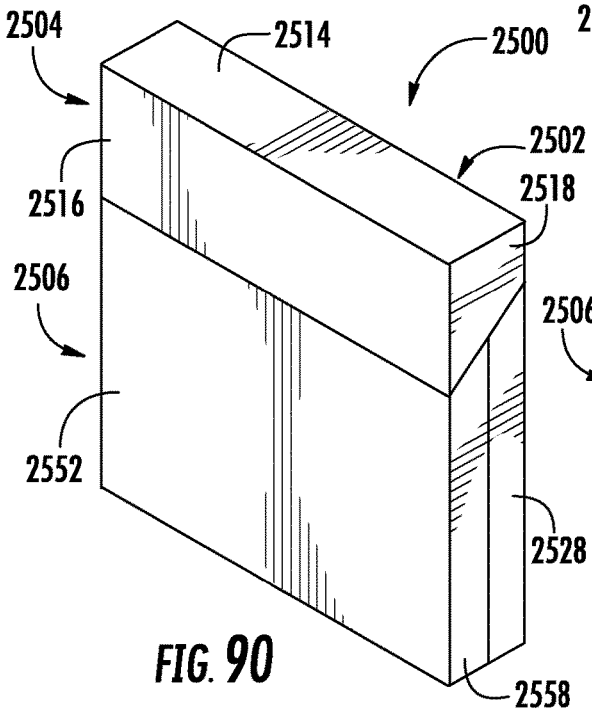
FIG. 90 is a perspective view of a package having two connected sections, the package being shown in a closed, or compact, position, according to an exemplary embodiment.
Figure 91:
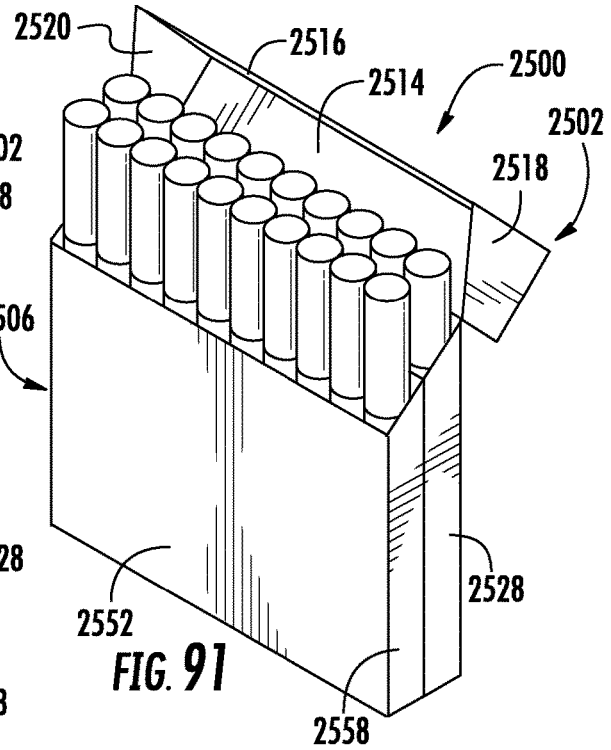
FIG. 91 is a perspective view of the package of FIG. 90, the lid shown in an open position.

In the compact position shown in FIGS. 90 and 91, the connecting portion 2540 is also compacted so that each of the panels 2536-2546 is substantially parallel with each other and pressed between the two base segments 2530 and 2550. In this configuration, the panels 2538 and 2542 interface with the first base front wall 2522 to, along with the second base segment 2550, substantially cover the outer surface of the first base front wall 2522. Likewise, the panels 2536, 2546, and 2544 interface with the second base rear wall 2554 to, along with the first base segment 2530, substantially cover the outer surface of the second base rear wall 2554. The panels 2536 and 2546 also interface with the panel 2538 in this configuration. The panel 2538 may also cover at least a portion of the second base rear wall 2554. The panels 2536-2546 are sized according to the dimensions of the first base segment 2530 and the second base segment 2550. In particular, the panels 2536-2546 are sized to have a length that is approximately equal to or less than the width of the second base rear wall 2554 and the first base front wall 2522, such that the panels 2536 and 2536 do not extend out from the side walls of the box 2502 when in the compact position. In an example embodiment, the connecting portion 2540 is sized so that the ends of the panels 2536-2546 are substantially flush with the side walls of the box 2502 on both ends. In the compact configuration of FIGS. 90 and 91, the information display area (i.e., the exposed surfaces) of the box 2502 includes the outer surfaces of the second base front wall 2552, the base side walls 2526, 2528, 2556, 2558, and the first base rear wall 2510, and all outer surfaces of the lid 2504. These surfaces may be visible when the package 2500 is sealed (e.g., prior to purchase). The connecting portion 2540 is not visible in the compact box position.

Figure 92:
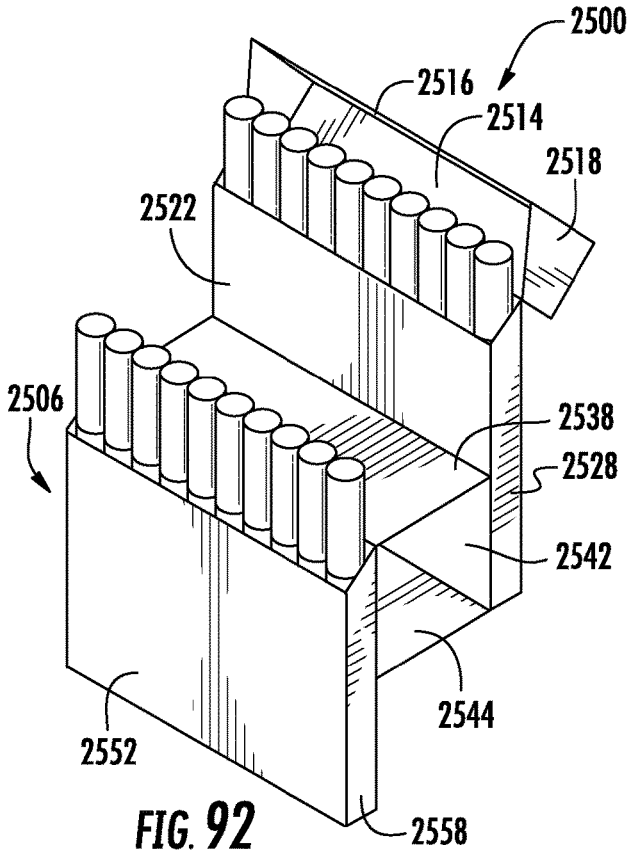
FIG. 92 is another perspective view of the package of FIG. 90, the base shown in a partially extended, or open, position.

The box 2502 may be moved to the first box open position shown in FIG. 92 by pivoting the first base segment 2530, via the connecting portion 2540, upward and away from the second base segment 2550. When the box 2502 is moved to the first box open position from the compact position, the information display area (i.e., the outer exposed surface area) of the box 2502 is increased. In this position, the information display area includes the surfaces that were visible in the compact position, as well as at least a portion (e.g., the upper portion) of the first base front wall 2522, at least a portion (e.g., the lower portion) of the second base rear wall 2554, outer surfaces of the panels 2538 and 2544, inner surfaces of the panels 2536, 2538, 2542, 2544, and 2546, and the outer surface of the first base bottom wall 2534. From a front view of the box 2502, any combination of the second base front wall 2552, at least a portion of the first base front wall 2522, and the lid front wall 2516 are visible simultaneously. From a rear view of the box 2502, the first base rear wall 2510 and at least a portion of the second base rear wall 2554 are visible simultaneously. Outer surfaces of the lid rear wall 2512, the lid top wall 2514, and the lid front wall 2516 may also be visible depending on the position of the lid 2504. From the front perspective of the box 2502 shown in FIG. 92, the second base front wall 2552, the base side walls 2528 and 2558, one of the lid side walls 2518, and at least a portion of the first base front wall 2522 and panels 2538, 2542, and 2544 are visible simultaneously. Outer surfaces of the lid top wall 2514 and the lid front wall 2516 may also be visible depending on the position of the lid 2504.

Figure 93:
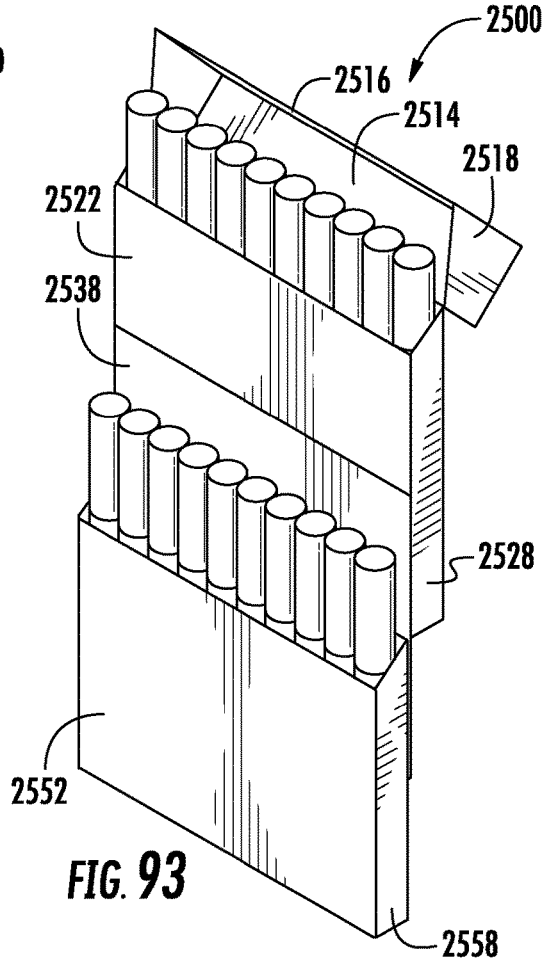
FIG. 93 is another perspective view of the package of FIG. 90, the base shown in a fully extended, or open, position.
Figure 94:
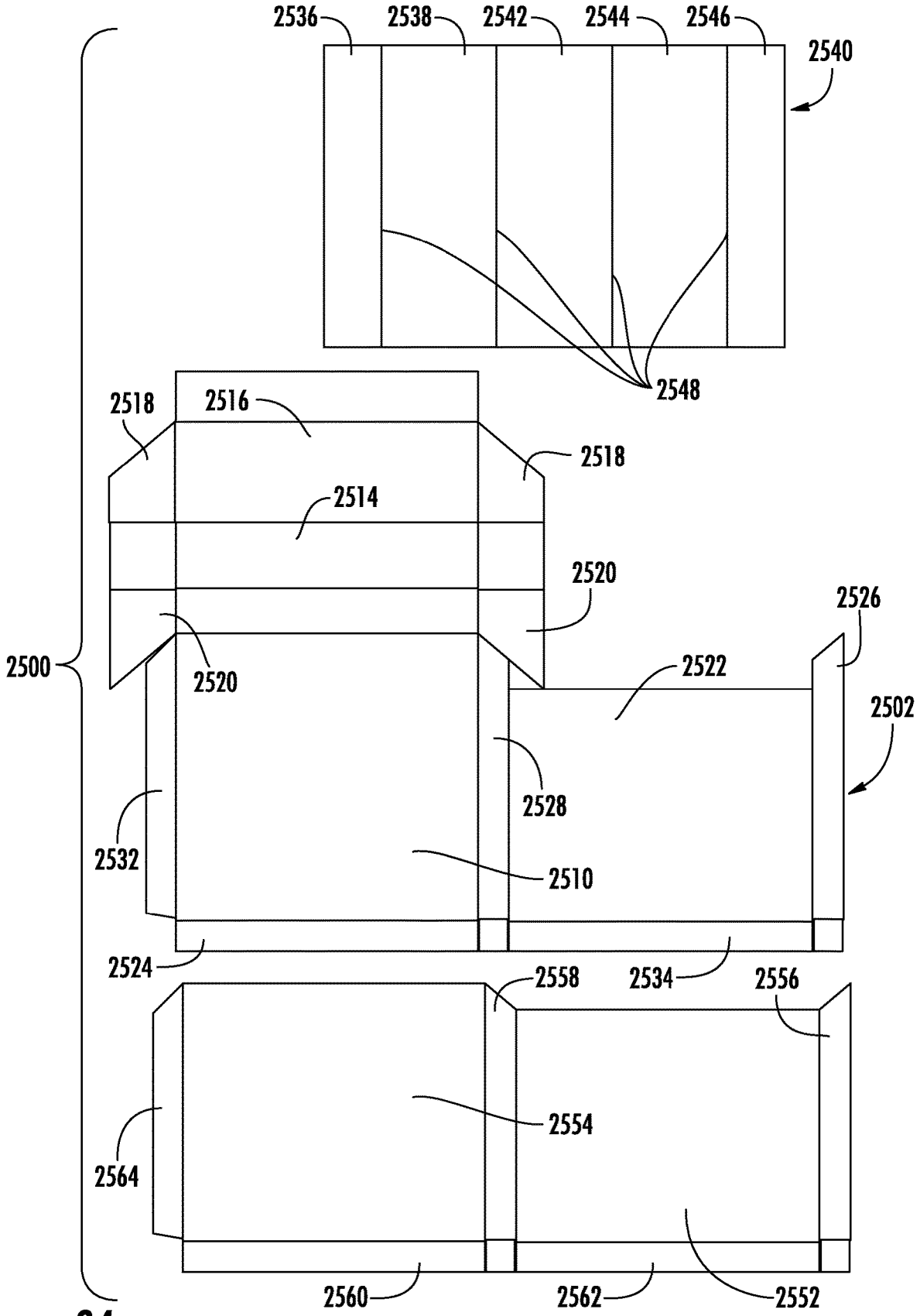
FIG. 94 is a top plan view of a blank used for the package of FIG. 90.

The box 2502 may be moved from the first box open position to the second box open position shown in FIG. 93 by pivoting the first base segment 2530, via the connecting portion 2540, further upward and back toward the second base segment 2550. In the second box open position, the information display area (i.e., the outer exposed surface area) of the box 2502 is greater than in the compact position. In this position, the information display area includes the surfaces that were visible in the compact position, as well as at least a portion (e.g., the upper portion) of the first base front wall 2522, at least a portion (e.g., the lower portion) of the second base rear wall 2554, outer surfaces of the panels 2538 and 2544, and the outer surface of the first base bottom wall 2534. From a front view of the box 2502, the second base front wall 2552, the portion of the first base front wall 2522 not covered by the connecting portion 2540, and at least a portion of the outer surface of the panel 2538 are visible simultaneously. In this position, the exposed portion of the first base front wall 2522 and the outer surface of the panel 2538 are viewable from the front of the box 2502 as a single, continuous display surface. The viewable surface area provided by the first base front wall 2522 and the outer surface of the panel 2538 in this position may be approximately equal to the outer surface area of the second base front wall 2552. The lid top wall 2514 may also be visible.

From a rear view of the box 2502 in the second box open position, the first base rear wall 2510, the portion of the second base rear wall 2554 not covered by the connecting portion 2540, and at least a portion of the outer surface of the panel 2544 are visible simultaneously. In this position, the exposed portion of the second base rear wall 2554 and the outer surface of the panel 2544 are viewable as a single, continuous display surface. The viewable surface area provided by the second base rear wall 2554 and the outer surface of the panel 2544 in this position may be approximately equal to the visible surface area of the first base rear wall 2510. Outer surfaces of the lid rear wall 2512, the lid top wall 2514, and the lid front wall 2516 may also be visible depending on the position of the lid 2504. From the front perspective of the box 2502 shown in FIG. 92, the second base front wall 2552, the base side walls 2528 and 2558, one of the lid side walls 2518, and at least a portion of the first base front wall 2522 and panels 2538, 2542, and 2544 are visible simultaneously. Outer surfaces of the lid top wall 2514 and the lid front wall 2516 may also be visible depending on the position of the lid 2504.

It should be noted that the product packages described herein may be fabricated using numerous substrates, including but not limited to, single-ply and multi-ply folding boxboards, metalized polyester laminations (metpol), transfer-metalized folding boxboard (transmet) and various polyesters. The product packages include a display area for product messaging, which may include graphical effects such as holography and coherent diffractive imaging, which can be applied through hot-foil stamping, transmet, cast and cure, metpol and cold foil systems. Coherent diffractive imaging, for instance, may be utilized to provide various optical effects within the information display area on the product packages described herein. Examples of the advantages provided by coherent diffractive imaging include a fully digital fringe writing system for the display, efficient multi-site exposures, control of fringe thicknesses and pitches, and brighter images. Examples of the types of systems and processes that may be utilized to display information on the product packages described herein can be found in U.S. Pat. No. 6,011,767 to Abraham; U.S. Pub. Pat. App. No. 2013/0234364 to Abraham et al.; and U.S. Pat. No. 8,921,011 to Abraham et al., each of which is incorporated herein by reference.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the outer case 11 as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A package configured to contain a product, the package comprising:

a first box section including a first connecting panel having a planar surface, the first box section with the first connecting panel formed from a single contiguous blank of material, the first box section defining a first storage volume configured to store units of the product;

a second box section, the second box section defining a second storage volume configured to store other units of the product, the second box section including a second connecting panel having a planar surface, the planar surface of the second connecting panel adhered to the planar surface of the first connecting panel so as to form a two-way living hinge, the second box section including the second connecting panel formed from a single contiguous blank of material;

wherein the first box section and the second box section are pivotable relative to each other among a package closed position, a first package extended position, and a second package extended position.

2. The package of claim 1, wherein each of the first box section and the second box section comprises a base and a lid, each lid pivotally connected to a respective base such that the product is positionable within the respective box section.

3. The package of claim 2, wherein:

each base comprises a plurality of base side walls;

each lid comprises a plurality of lid side walls and a lid top wall; and wherein, when the first box section and the second box section are in the package closed position, the plurality of base side walls of each base, the plurality of lid walls of each lid, and the lid top wall of each lid are visible and provide an information display area.

4. The package of claim 3, wherein a first hinge portion connects a base side wall of the first box section and the first connecting panel, the first box section pivotable about the first hinge portion relative to the first connecting panel to move the first box section between the package closed position and the first package extended position.

5. The package of claim 4, wherein when in the package closed position, the first connecting panel and a base rear wall of the first box section are not visible, and wherein when in the first package extended position, an outer surface of the first connecting panel and an outer surface of the base rear wall are visible.

6. The package of claim 4, wherein a second hinge portion connects a base side wall of the second box section and the second connecting panel, the second box section pivotable about the second hinge portion relative to the second connecting panel to move the second box section between the package closed position and the second package extended open position.

7. The package of claim 6, wherein when in the package closed position, the second connecting panel and a base rear wall of the second box section are not visible, and wherein when in the second package extended position, an outer surface of the second connecting panel and an outer surface of the base rear wall are visible.

8. The package of claim 6, wherein each base comprises:

a base bottom wall; and a plurality of base bottom tabs, each of the plurality of base bottom tabs coupled to a respective base side wall, wherein for each base, when the base is in a folded form, each of the plurality of base bottom tabs are coupled to an inner surface of the base bottom wall so as to form the base.

9. The package of claim 3, wherein, for each lid, the plurality of lid side walls are directly coupled to each other.

10. The package of claim 9, wherein, for each base, the plurality of base side walls are directly coupled to each other.

11. The package of claim 10, wherein the package is formed from a single contiguous blank of material.

12. The package of claim 2, wherein each base comprises a base front wall, a base bottom wall, a base rear wall, a first base side wall, and a second base side wall.

13. The package of claim 12, wherein each base comprises:

a plurality of first base bottom tabs, each of the plurality of first base bottom tabs coupled to a respective base side wall; and a second base bottom tab coupled to an inner surface of the base bottom wall, wherein for each base, when the base is in a folded form, the plurality of first base bottom tabs and the second base bottom tab are coupled to an inner surface of the base bottom wall so as to form a bottom wall of the respective box section.

14. The package of claim 13, wherein each lid comprises a lid top wall including a plurality of lid top tabs coupled thereto, a lid front wall, and a plurality of lid side walls, wherein when the lid is in a folded form, an outer surface of the plurality of lid top tabs are coupled to an inner surface of the plurality of lid side walls so as to form the lid.

15. The package of claim 14, wherein, for each of the first box section and the second box section, a hinge portion is formed between the base rear wall and the lid top wall, the lid pivotable in a rearward direction about an axis formed by the hinge portion between an open lid position and a closed lid position.

16. The package of claim 12, further comprising a first hinge portion connecting the base side wall of the first box section and the first connecting panel, the first box pivotable about the first hinge portion relative to the first connecting panel so as to move the first box section between the package closed position and the first package extended open position.

17. The package of claim 16, further comprising a second hinge portion connecting the base side wall of the second box section and the second connecting panel, the second box pivotable about the second hinge portion relative to the second connecting panel so as to move the second box section between the package closed position and the second package extended position.

18. The package of claim 17, wherein the package is formed from a single contiguous blank of material.

* * * * *